US009670756B2

(12) United States Patent
Yeh

(10) Patent No.: US 9,670,756 B2
(45) Date of Patent: Jun. 6, 2017

(54) WELLBORE APPARATUS AND METHOD FOR SAND CONTROL USING GRAVEL RESERVE

(71) Applicant: Charles S. Yeh, Spring, TX (US)

(72) Inventor: Charles S. Yeh, Spring, TX (US)

(73) Assignee: ExxonMobil Upstream Research Company, spring, TX (US)

( * ) Notice: Subject to any disclaimer, the term of this patent is extended or adjusted under 35 U.S.C. 154(b) by 516 days.

(21) Appl. No.: 14/247,945

(22) Filed: Apr. 8, 2014

(65) Prior Publication Data

US 2015/0285038 A1 Oct. 8, 2015

(51) Int. Cl.
*E21B 43/04* (2006.01)

(52) U.S. Cl.
CPC ..... *E21B 43/04* (2013.01)

(58) Field of Classification Search
CPC ..... E21B 43/04; E21B 43/045; E21B 23/06; E21B 43/084; E21B 33/1243; E21B 43/082; E21B 43/086; E21B 43/088; E21B 43/106
USPC ..... 166/278
See application file for complete search history.

(56) References Cited

U.S. PATENT DOCUMENTS 4,945,991 A 8/1990 Jones
5,113,935 A 5/1992 Jones et al.
5,348,091 A 9/1994 Tchakarov et al.
5,390,966 A 2/1995 Cox et al.
5,396,954 A 3/1995 Brooks
5,476,143 A 12/1995 Sparlin et al.
5,588,487 A 12/1996 Bryant
5,636,689 A 6/1997 Rubbo et al.
5,868,200 A 2/1999 Bryant et al.
5,887,660 A 3/1999 Yokley et al.
5,890,533 A * 4/1999 Jones ..... E21B 43/088 166/233
5,909,774 A 6/1999 Griffith et al.
5,975,205 A 11/1999 Carisella
6,003,834 A 12/1999 Read
6,179,056 B1 1/2001 Smith
6,298,916 B1 10/2001 Tibbles et al.
6,325,144 B1 12/2001 Turley et al.
6,354,378 B1 3/2002 Patel
6,409,219 B1 6/2002 Broome et al.
6,464,261 B1 10/2002 Dybevik et al.
(Continued)

*Primary Examiner* — Michael Wills, III
(74) *Attorney, Agent, or Firm* — ExxonMobil Upstream Research Company—Law Department

(57) ABSTRACT

A method and system for completing a wellbore in a subsurface formation including first and second sand screens and intermediate tubular joint for gravel transport and/or gravel packing. The assembly provides transport conduits for carrying gravel slurry and packing conduits for gravel slurry placement. The method also includes running the sand screens and intermediately connected joint assembly into the wellbore, and gravel packing not only in the wellbore annulus behind the sand screens, but also behind the intermediate joint assembly to provide a reserve of packing sand behind the intermediate joint assembly to supplement or repack any annular packing sand in the annulus behind the sand screens that may be lost due to sand screen breach, partial collapse of tubular, or other shifting of the gravel pack sand. A wellbore completion apparatus and system is also provided that allows for placement of such gravel reserve.

20 Claims, 28 Drawing Sheets

(56) References Cited

U.S. PATENT DOCUMENTS 6,513,599 B1 2/2003 Bixenman et al.
6,516,881 B2 2/2003 Hailey, Jr.
6,520,254 B2 2/2003 Hurst et al.
6,557,634 B2 5/2003 Hailey, Jr. et al.
6,575,251 B2 6/2003 Watson et al.
6,581,689 B2 6/2003 Hailey, Jr.
6,588,506 B2 * 7/2003 Jones ..... E21B 43/08 166/276
6,601,646 B2 8/2003 Streich et al.
6,644,404 B2 11/2003 Schultz et al.
6,644,406 B1 * 11/2003 Jones ..... E21B 43/088 166/235
6,666,274 B2 12/2003 Hughes
6,695,067 B2 2/2004 Johnson et al.
6,705,402 B2 3/2004 Proctor
6,749,023 B2 6/2004 Nguyen et al.
6,749,024 B2 6/2004 Bixenman
6,752,206 B2 6/2004 Watson et al.
6,752,207 B2 6/2004 Danos et al.
6,755,245 B2 6/2004 Nguyen et al.
6,789,621 B2 9/2004 Wetzel et al.
6,789,623 B2 9/2004 Hill, Jr. et al.
6,789,624 B2 9/2004 McGregor et al.
6,814,139 B2 11/2004 Hejl et al.
6,817,410 B2 11/2004 Wetzel et al.
6,830,104 B2 12/2004 Nguyen et al.
6,883,608 B2 4/2005 Parlar et al.
6,923,262 B2 8/2005 Broome et al.
6,935,432 B2 8/2005 Nguyen
6,983,796 B2 1/2006 Bayne et al.
6,986,390 B2 1/2006 Doanne et al.
6,997,263 B2 2/2006 Campbell et al.
7,044,231 B2 5/2006 Doane et al.
7,048,061 B2 5/2006 Bode et al.
7,051,805 B2 5/2006 Doane et al.
7,055,598 B2 6/2006 Ross et al.
7,096,945 B2 8/2006 Richards et al.
7,100,691 B2 9/2006 Nguyen et al.
7,104,324 B2 9/2006 Wetzel et al.
7,147,054 B2 12/2006 Wang et al.
7,152,677 B2 12/2006 Parlar et al.
7,207,383 B2 4/2007 Hurst et al.
7,222,676 B2 5/2007 Patel et al.
7,243,715 B2 7/2007 Wang et al.
7,243,723 B2 7/2007 Surjaatmadja et al.
7,243,724 B2 7/2007 McGregor et al.
7,243,732 B2 7/2007 Richard
7,252,142 B2 8/2007 Brezinski et al.
7,264,061 B2 9/2007 Dybevik et al.
7,278,479 B2 10/2007 Kvernstuen et al.
7,343,983 B2 3/2008 Livingstone
7,363,974 B2 4/2008 Wang et al.
7,367,395 B2 5/2008 Vidrine et al.
7,370,700 B2 5/2008 Hurst et al.
7,373,978 B2 5/2008 Barry et al.
7,392,852 B2 7/2008 Richard
7,407,007 B2 8/2008 Tibbles
7,426,962 B2 9/2008 Moen et al.
7,431,058 B2 10/2008 Holting
7,431,085 B2 10/2008 Coronado et al.
7,431,091 B2 10/2008 Themig et al.
7,431,098 B2 10/2008 Ohmer et al.
7,441,605 B2 10/2008 Coronado et al.
7,493,959 B2 2/2009 Johnson et al.
7,497,267 B2 3/2009 Setterberg, Jr. et al.
7,562,709 B2 7/2009 Saebi et al.
7,584,799 B2 9/2009 Coronado et al.
7,591,321 B2 9/2009 Whitsitt et al.
7,597,141 B2 10/2009 Rouse et al.
7,624,810 B2 12/2009 Fould et al.
7,661,476 B2 2/2010 Yeh et al.
7,681,652 B2 3/2010 Gaudette et al.
7,735,559 B2 6/2010 Malone
7,828,056 B2 11/2010 Dybevik et al.
7,832,472 B2 11/2010 Themig
7,886,819 B2 2/2011 Setterberg, Jr. et al.
7,938,184 B2 5/2011 Yeh et al.
7,971,642 B2 7/2011 Yeh et al.
8,215,406 B2 7/2012 Dale et al.
2003/0127227 A1 7/2003 Fehr et al.
2003/0173075 A1 9/2003 Morvant et al.
2004/0007829 A1 1/2004 Ross
2004/0140089 A1 7/2004 Gunneroed
2005/0028977 A1 2/2005 Ward
2005/0039917 A1 2/2005 Hailey, Jr.
2005/0061501 A1 3/2005 Ward et al.
2005/0082060 A1 4/2005 Ward et al.
2005/0241855 A1 11/2005 Wylie et al.
2005/0263287 A1 12/2005 Achee, Jr. et al.
2007/0056750 A1 3/2007 John et al.
2008/0125335 A1 5/2008 Bhavsar
2008/0128126 A1 6/2008 Dagenais et al.
2008/0142222 A1 6/2008 Howard et al.
2008/0314589 A1 12/2008 Guignard et al.
2009/0008084 A1 1/2009 Dybevik et al.
2009/0084556 A1 4/2009 Richards et al.
2009/0159279 A1 6/2009 Assal
2009/0159298 A1 6/2009 Assal
2009/0283279 A1 11/2009 Patel et al.
2009/0308592 A1 12/2009 Mercer et al.
2010/0032158 A1 2/2010 Dale et al.
2010/0065284 A1 3/2010 Freyer
2010/0096119 A1 4/2010 Sevre et al.
2010/0147538 A1 6/2010 Gaudette et al.
2010/0155064 A1 6/2010 Nutley et al.
2010/0218948 A1 9/2010 Mickelburgh et al.
2010/0252252 A1 10/2010 Harris et al.
2011/0042106 A1 2/2011 MacLeod
2011/0284208 A1 11/2011 MacLeod et al.
2012/0018153 A1 1/2012 Yeh et al.
2012/0181024 A1 * 7/2012 Edwards ..... E21B 43/045 166/278

* cited by examiner

WELLBORE APPARATUS AND METHOD FOR SAND CONTROL USING GRAVEL RESERVE

CROSS REFERENCE TO RELATED APPLICATIONS

This application is related to pending U.S. Patent Pub. No. 2012/0217010, entitled "Open-Hole Packer for Alternate Path Gravel Packing, and Method for Completing an Open-Hole Wellbore."

This application is also related to International Publication No. WO2012/082303 entitled "Packer for Alternate Flow Channel Gravel Packing and Method for Completing a Wellbore." These applications are also incorporated by reference herein in their entireties.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Field of the Invention

The present disclosure relates to the field of well completions. More specifically, the present invention relates to the isolation of formations in connection with wellbores that have been completed using gravel-packing. The application also relates to a wellbore completion apparatus which incorporates bypass technology for installing a gravel pack having zonal isolation.

Discussion of Technology

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the formation. A cementing operation is typically conducted in order to fill or "squeeze" the annular area with cement. The combination of cement and casing strengthens the wellbore and facilitates the isolation of formations behind the casing.

It is common to place several strings of casing having progressively smaller outer diameters into the wellbore. The process of drilling and then cementing progressively smaller strings of casing is repeated several times until the well has reached total depth. The final string of casing, referred to as a production casing, is cemented in place and perforated. In some instances, the final string of casing is a liner, that is, a string of casing that is not tied back to the surface.

As part of the completion process, a wellhead is installed at the surface. The wellhead controls the flow of production fluids to the surface, or the injection of fluids into the wellbore. Fluid gathering and processing equipment such as pipes, valves and separators are also provided. Production operations may then commence.

It is sometimes desirable to leave the bottom portion of a wellbore open. In open-hole completions, a production casing is not extended through the producing zones and perforated; rather, the producing zones are left uncased, or "open." A production string or "tubing" is then positioned inside the open wellbore extending down below the last string of casing.

There are certain advantages to open-hole completions versus cased-hole completions. First, because open-hole completions have no perforation tunnels, formation fluids can converge on the wellbore radially 360 degrees. This has the benefit of eliminating the additional pressure drop associated with converging radial flow and then linear flow through particle-filled perforation tunnels. The reduced pressure drop associated with an open-hole completion virtually guarantees that it will be more productive than an unstimulated, cased hole in the same formation.

Second, open-hole techniques are oftentimes less expensive than cased hole completions. For example, the use of gravel packs eliminates the need for cementing, perforating, and post-perforation clean-up operations.

A common problem in open-hole completions is the immediate exposure of the wellbore to the surrounding formation. If the formation is unconsolidated or heavily sandy, the flow of production fluids into the wellbore may carry with it formation particles, e.g., sand and fines. Such particles can be erosive to production equipment downhole and to pipes, valves and separation equipment at the surface.

To control the invasion of sand and other particles, sand control devices may be employed. Sand control devices are usually installed downhole across formations to retain solid materials larger than a certain diameter while allowing fluids to be produced. A sand control device typically includes an elongated tubular body, known as a base pipe, having numerous slots or openings. The base pipe is then typically wrapped with a filtration medium such as a wire wrap or wire mesh.

To augment sand control devices it is common to install a gravel pack. Gravel packing a well involves placing gravel or other particulate matter around the sand control device after the sand control device is hung or otherwise placed in the wellbore. To install a gravel pack, a particulate material is delivered downhole by means of a carrier fluid. The carrier fluid with the gravel together forms a gravel slurry. The slurry dries in place, leaving a circumferential packing of gravel. The gravel not only aids in particle filtration but also helps maintain wellbore integrity.

In an open-hole gravel pack completion, the gravel is positioned between a sand screen that surrounds the perforated base pipe and a surrounding wall of the wellbore. During production, formation fluids flow from the subterranean formation, through the gravel, through the screen, and into the inner base pipe. The base pipe thus serves as a part of the production string.

A problem historically encountered with gravel-packing is that an inadvertent loss of carrier fluid from the slurry during the delivery process can result in premature sand or gravel bridges being formed at various locations along open-hole intervals. For example, in an interval having high permeability or in an interval that has been fractured, a poor distribution of gravel may occur due to an excessive loss of carrier fluid from the gravel slurry into the formation. Premature sand bridging can block the flow of gravel slurry, causing voids to form along the completion interval. Similarly, a packer for zonal isolation in the annulus between the screen and the wellbore can also block the flow of gravel slurry, causing voids to form along the completion interval. Thus, a complete gravel-pack from bottom to top is not achieved, leaving portions of the sand screen directly exposed to sand and fines infiltration and the possibility of erosion.

The problems of sand bridging and of bypassing zonal isolation have been addressed through the use of gravel bypass technology. This technology is practiced under the name Alternate Path®. Alternate Path technology employs shunt tubes or flow channels that allow the gravel slurry to bypass selected areas, e.g., premature sand bridges or packers, along a wellbore. Such fluid bypass technology is described, for example, in U.S. Pat. No. 5,588,487 entitled "Tool for Blocking Axial Flow in Gravel-Packed Well Annulus," and U.S. Pat. No. 7,938,184 entitled "Wellbore Method and Apparatus for Completion, Production, and Injection," each of which is incorporated herein by reference in its entirety. Additional references which discuss alternate flow channel technology include U.S. Pat. Nos. 8,215,406; 8,186,429; 8,127,831; 8,011,437; 7,971,642; 7,938,184; 7,661,476; 5,113,935; 4,945,991; U.S. Pat. Publ. No. 2012/0217010; U.S. Pat. Publ. No. 2009/0294128; M. T. Hecker, et al., "Extending Openhole Gravel-Packing Capability: Initial Field Installation of Internal Shunt Alternate Path Technology," SPE Annual Technical Conference and Exhibition, SPE Paper No. 135,102 (September 2010); and M. D. Barry, et al., "Open-hole Gravel Packing with Zonal Isolation," SPE Paper No. 110,460 (November 2007). The Alternate Path technology enables a true zonal isolation in multi-zone, openhole gravel pack completions.

The efficacy of a gravel pack in controlling the influx of sand and fines into a wellbore is well-known. However, it is also sometimes desirable with open-hole completions to isolate selected intervals along the open-hole portion of a wellbore in order to control the inflow of fluids. For example, in connection with the production of condensable hydrocarbons, water may sometimes invade an interval. This may be due to the presence of native water zones, coning (rise of near-well hydrocarbon-water contact), high permeability streaks, natural fractures, or fingering from injection wells. Depending on the mechanism or cause of the water production, the water may be produced at different locations and times during a well's lifetime. Similarly, a gas cap above an oil reservoir may expand and break through, causing gas production with oil. The gas breakthrough reduces gas cap drive and suppresses oil production.

In these and other instances, it is desirable to isolate an interval from the production of formation fluids into the wellbore. Annular zonal isolation may also be desired for production allocation, production/injection fluid profile control, selective stimulation, or gas control. However, there is concern with the use of an annular zonal isolation apparatus that sand may not completely fill the annulus up to the bottom of the zonal isolation apparatus after gravel packing operations are completed. Alternatively, gravel packing may be shifted by reservoir inflow. Alternatively still, there is a concern that sand may gravitationally settle below the zonal isolation apparatus. In any of these instances, a portion of the sand screen is immediately exposed to the surrounding formation.

Therefore, a need exists for an improved sand control system that provides fluid bypass technology for the placement of gravel that bypasses a packer. A need further exists for a zonal isolation apparatus that not only provides isolation of selected subsurface intervals along an open-hole wellbore, but that also provides a reservoir of gravel packing material above a next sand screen assembly downstream. Stated another way, a need exists for a method of placing a reserve of gravel packing material within a wellbore upstream of a sand screen assembly.

SUMMARY OF THE INVENTION

A wellbore completion apparatus is first provided herein. The wellbore completion apparatus resides within a wellbore. The wellbore completion apparatus has particular utility in connection with the placement of a gravel pack within an open-hole portion of the wellbore. The open-hole portion extends through one, two, or more subsurface intervals.

The wellbore completion apparatus first includes a sand screen assembly. The sand assembly includes one or more sand control segments connected in series. Each of the one or more sand control segments includes a base pipe. The base pipes of the sand control segments define joints of perforated (or slotted) tubing. Each sand control segment further comprises a filtering medium. The filtering media surround the bases pipe along a substantial portion of the sand control segments. The filtering media of the sand control segments comprise, for example, a wire-wrapped screen, a membrane screen, an expandable screen, a sintered metal screen, a wire-mesh screen, a shape memory polymer, or a pre-packed solid particle bed. Together, the base pipe and the filtering medium form a sand screen.

The sand control segments are arranged to have alternate flow path technology. In this respect, the sand screens include at least one transport conduit configured to bypass the base pipe. The transport conduits extend substantially along the base pipe of each segment. Each sand control segment further comprises at least one packing conduit. Each packing conduit has a nozzle configured to release gravel packing slurry into an annular region between the filtering medium and a surrounding subsurface formation.

The wellbore completion apparatus also includes a joint assembly. The joint assembly comprises a non-perforated base pipe, at least one transport conduit extending substantially along the length of the non-perforated base pipe, and at least one packing conduit. The transport conduits carry gravel packing slurry through the joint assembly, while the packing conduits each have a nozzle configured to release gravel packing slurry into an annular region between the non-perforated base pipe and the surrounding subsurface formation.

The wellbore completion apparatus also includes a packer assembly. The packer assembly comprises at least one sealing element. The sealing elements are configured to be actuated to engage a surrounding wellbore wall. The packer assembly also has an inner mandrel. Further the packer assembly has at least one transport conduit. The transport conduits extend along the inner mandrel and carry gravel packing material through the packer assembly.

The sealing element for the packer assembly may include a mechanically-set packer. More preferably, the packer assembly has two mechanically-set packers or annular seals. These represent an upper packer and a lower packer. Each mechanically-set packer has a sealing element that may be, for example, from about 6 inches (15.2 cm) to 24 inches (61.0 cm) in length. Each mechanically-set packer also has an inner mandrel in fluid communication with the base pipe of the sand screens and the base pipe of the joint assembly.

Intermediate the at least two mechanically-set packers may optionally be at least one swellable packer element. The swellable packer element is preferably about 3 feet (0.91 meters) to 40 feet (12.2 meters) in length. In one aspect, the swellable packer element is fabricated from an elastomeric material. The swellable packer element is actuated over time in the presence of a fluid such as water, gas, oil, or a chemical. Swelling may take place, for example, should one of the mechanically-set packer elements fails. Alternatively, swelling may take place over time as fluids in the formation surrounding the swellable packer element contact the swellable packer element.

The sand screen assembly, the joint assembly and the packer assembly are connected in series. The connection is such that the perforated base pipe of the one or more sand control segments, the non-perforated base pipe of the joint assembly, and the inner mandrel of the packer assembly are in fluid communication. The connection is further such that the at least one transport conduit in the one or more sand control segments, the at least one transport conduit in the joint assembly, and the at least one transport conduit in the packer assembly are in fluid communication. The transport conduits provide alternate flow paths for gravel slurry, and deliver slurry to packing conduits. Thus, gravel packing material may be diverted to different depths and intervals along a subsurface formation.

A method for completing a wellbore in a subsurface formation is also provided herein. The wellbore preferably includes a lower portion completed as an open-hole. In one aspect, the method includes providing a sand screen assembly. The sand screen assembly may be in accordance with the sand screen assembly described above.

The method also includes providing a joint assembly or system or method as described herein, but which does not include a packer therewith. The joint assembly or system may be used in accordance with the a method A method for completing a wellbore in a subsurface formation, the method comprising providing a first sand screen assembly having one or more sand control segments; providing a second sand screen assembly having one or more sand control segments; providing a first joint assembly comprising: a non-perforated base pipe, at least one transport conduit extending substantially along the non-perforated base pipe, and at least one packing conduit having at least one nozzle configured to release gravel packing slurry into an annular region between the non-perforated base pipe and the subsurface formation; connecting the first joint assembly in series between the first sand screen assembly and the second sand screen assembly; running the first sand screen assembly, the first joint assembly, and the second sand screen assembly into the wellbore; and injecting a gravel slurry into the wellbore to form a gravel pack around the first and the second sand screen assemblies and at least a portion of the injected gravel slurry released introduced into the annular region through the at least one nozzle.

A system for completing a wellbore in a subsurface formation is provided, the system comprising: a first sand screen assembly having one or more sand control segments; second sand screen assembly having one or more sand control segments; a first joint assembly comprising a non-perforated base pipe, at least one transport conduit extending substantially along the non-perforated base pipe, and at least one packing conduit having at least one nozzle configured to release gravel packing slurry into an annular region between the non-perforated base pipe and the subsurface formation; the first joint assembly connected in series between the first sand screen assembly and the second sand screen assembly; running the first sand screen assembly, the first joint assembly, and the second sand screen assembly into the wellbore; and injecting a gravel slurry into the wellbore to form a gravel pack around the first and the second sand screen assemblies and at least a portion of the injected gravel slurry released introduced into the annular region through the at least one nozzle.

The method may further include providing a packer assembly in accordance with the packer assembly described above in its various embodiments. The packer assembly includes at least one mechanically-set packer. Some embodiments may provide two packers or one packer having multiple packer sealing elements. For example, each packer will have an inner mandrel, alternate flow channels around the inner mandrel, and a sealing element external to the inner mandrel. The method also includes connecting the sand screen assembly, the joint assembly, and a packer assembly in series. The connection is such that the perforated base pipe of the one or more sand control segments, the non-perforated base pipe of the joint assembly, and the inner mandrel of the packer assembly are in fluid communication. The connection is further such that the at least one transport conduit in the one or more sand control segments, the at least one transport conduit in the joint assembly, and the at least one transport conduit in the packer assembly are in fluid communication.

The method additionally includes running the sand screen assembly and connected joint assembly and packer assembly into the wellbore. Additionally, the method includes setting the sealing element of the packer assembly into engagement with the surrounding wellbore. The method next includes injecting a gravel slurry into the wellbore. This is done in order to form a gravel pack below the packer assembly after the at least sealing element has been set. Specifically, gravel packing material is injected into an annular region formed between the sand screens and the surrounding wellbore. The method additionally includes further injecting gravel slurry into the wellbore in order to deposit a reserve of gravel packing material around the non-perforated base pipe of the joint assembly above the sand screen assembly. Preferably, about six feet of reserve packing material is deposited.

Also provided is a method for completing a wellbore in a subsurface formation, the method comprising: providing a first sand screen assembly having one or more sand control segments; providing a second sand screen assembly having one or more sand control segments; providing a first joint assembly comprising, a non-perforated base pipe, at least one transport conduit extending substantially along the non-perforated base pipe, and at least one packing conduit having at least one nozzle configured to release gravel packing slurry into an annular region between the non-perforated base pipe and the subsurface formation; connecting the first joint assembly in series between the first sand screen assembly and the second sand screen assembly; running the first sand screen assembly, the first joint assembly, and the second sand screen assembly into the wellbore; and injecting a gravel slurry into the wellbore to form a gravel pack around the first and the second sand screen assemblies and at least a portion of the injected gravel slurry released introduced into the annular region through the at least one nozzle. A system is also provided for completing a wellbore in a subsurface formation, the system comprising: a first sand screen assembly having one or more sand control segments; second sand screen assembly having one or more sand control segments; a first joint assembly comprising a non-perforated base pipe, at least one transport conduit extending substantially along the non-perforated base pipe, and at least one packing conduit having at least one nozzle configured to release gravel packing slurry into an annular region between the non-perforated base pipe and the subsurface formation; the first joint assembly connected in series between the first sand screen assembly and the second sand screen assembly; running the first sand screen assembly, the first joint assembly, and the second sand screen assembly into the wellbore; and injecting a gravel slurry into the wellbore to form a gravel pack around the first and the second sand screen assemblies and at least a portion of the injected gravel slurry released introduced into the annular region through the at least one nozzle.

The method may also include producing hydrocarbon fluids from at least one interval along the wellbore. The method may also include allowing the reserve gravel packing material to settle around an upper sand control segment.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

Figure 1:
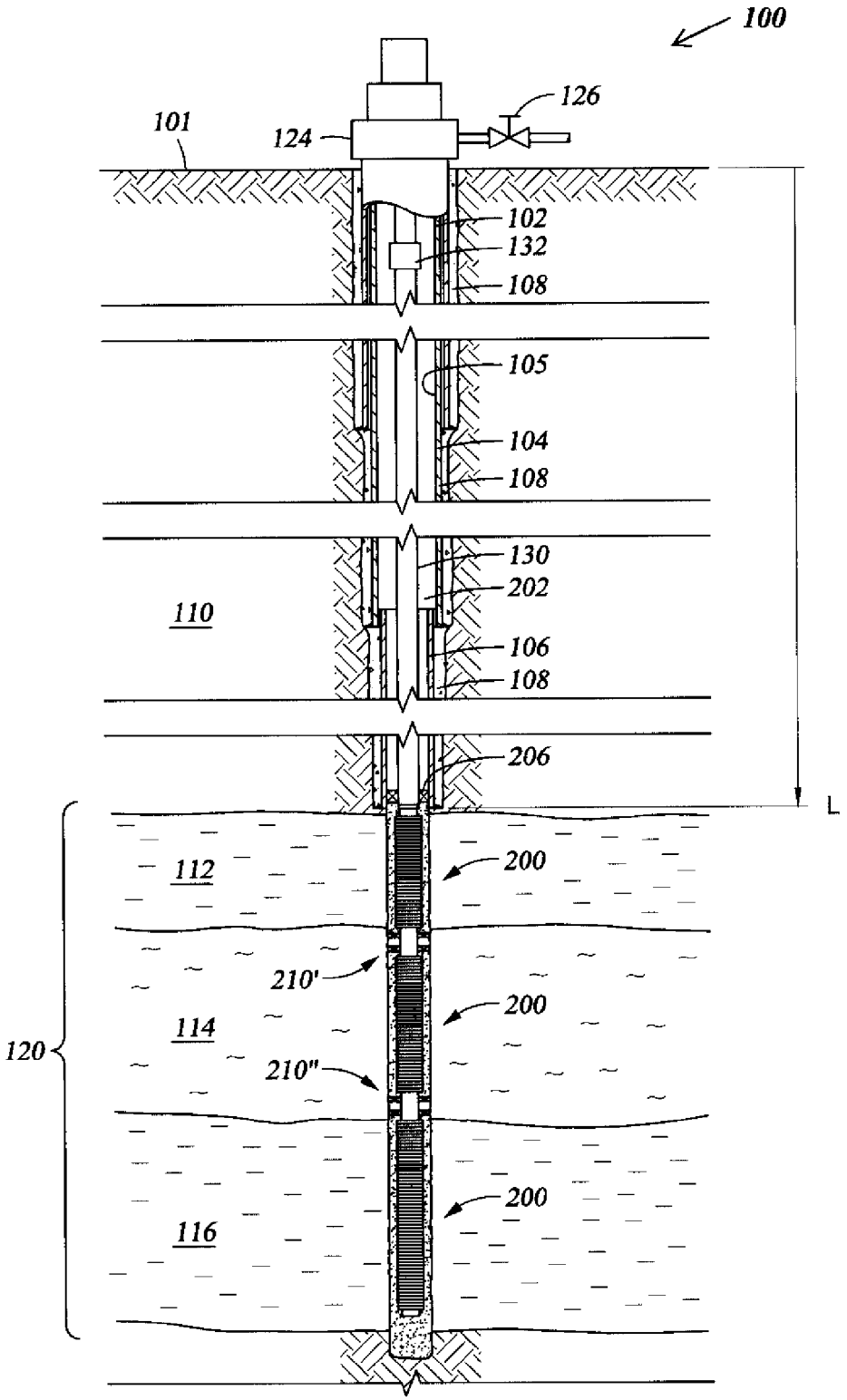
FIG. 1 is a cross-sectional view of an illustrative wellbore. The wellbore has been drilled through three different subsurface intervals, each interval being under formation pressure and containing fluids.

As used herein, the term "hydrocarbon" refers to an organic compound that includes primarily, if not exclusively, the elements hydrogen and carbon. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. and 1 atm pressure). Hydrocarbon fluids may include, for example, oil, natural gas, coal bed methane, shale oil, pyrolysis oil, pyrolysis gas, a pyrolysis product of coal, and other hydrocarbons that are in a gaseous or liquid state.

As used herein, the term "fluid" refers to gases, liquids, and combinations of gases and liquids, as well as to combinations of gases and solids, and combinations of liquids and solids.

As used herein, the term "subsurface" refers to geologic strata occurring below the earth's surface. The term "subsurface interval" refers to a formation or a portion of a formation wherein formation fluids may reside. The fluids may be, for example, hydrocarbon liquids, hydrocarbon gases, aqueous fluids, or combinations thereof.

As used herein, the term "wellbore" refers to a hole in the subsurface made by drilling or insertion of a conduit into the subsurface. A wellbore may have a substantially circular cross section, or other cross-sectional shape. As used herein, the term "well," when referring to an opening in the formation, may be used interchangeably with the term "wellbore."

The terms "tubular member" or "tubular body" refer to any pipe or tubular device, such as a joint of casing or base pipe, a portion of a liner, or a pup joint.

The terms "sand control device" or "sand control segment" mean any elongated tubular body that permits an inflow of fluid into an inner bore or a base pipe while filtering out predetermined sizes of sand, fines and granular debris from a surrounding formation. A wire wrap screen around a slotted base pipe is an example of a sand control segment.

The term "alternate flow channels" means any collection of manifolds and/or transport conduits that provide fluid communication through or around a tubular wellbore tool to allow a gravel slurry to by-pass the wellbore tool or any premature sand bridge in the annular region and continue gravel packing further downstream. Examples of such wellbore tools include (i) a packer having a sealing element, (ii) a sand screen or slotted pipe, and (iii) a blank pipe, with or without an outer protective shroud.

Description Of Specific Embodiments

The inventions are described herein in connection with certain specific embodiments. However, to the extent that the following detailed description is specific to a particular embodiment or a particular use, such is intended to be illustrative only and is not to be construed as limiting the scope of the inventions.

Certain aspects of the inventions are also described in connection with various figures. In certain of the figures, the top of the drawing page is intended to be toward the surface, and the bottom of the drawing page toward the well bottom. While wells commonly are completed in substantially vertical orientation, it is understood that wells may also be inclined and or even horizontally completed. When the descriptive terms "up and down" or "upper" and "lower" or similar terms are used in reference to a drawing or in the claims, they are intended to indicate relative location on the drawing page or with respect to claim terms, and not necessarily orientation in the ground, as the present inventions have utility no matter how the wellbore is orientated.

FIG. 1 is a cross-sectional view of an illustrative wellbore 100. The wellbore 100 defines a bore 105 that extends from a surface 101, and into the earth's subsurface 110. The wellbore 100 is completed to have an open-hole portion 120 at a lower end of the wellbore 100. The wellbore 100 has been formed for the purpose of producing hydrocarbons for processing or commercial sale. A string of production tubing 130 is provided in the bore 105 to transport production fluids from the open-hole portion 120 up to the surface 101.

The wellbore 100 includes a well tree, shown schematically at 124. The well tree 124 includes a shut-in valve 126. The shut-in valve 126 controls the flow of production fluids from the wellbore 100. In addition, a subsurface safety valve 132 is provided to block the flow of fluids from the production tubing 130 in the event of a rupture or catastrophic event above the subsurface safety valve 132. The wellbore 100 may optionally have a pump (not shown) within or just above the open-hole portion 120 to artificially lift production fluids from the open-hole portion 120 up to the well tree 124.

The wellbore 100 has been completed by setting a series of pipes into the subsurface 110. These pipes include a first string of casing 102, sometimes known as surface casing or a conductor. These pipes also include at least a second 104 and a third 106 string of casing. These casing strings 104, 106 are intermediate casing strings that provide support for walls of the wellbore 100. Intermediate casing strings 104, 106 may be hung from the surface, or they may be hung from a next higher casing string using an expandable liner or liner hanger. It is understood that a pipe string that does not extend back to the surface (such as casing string 106) is normally referred to as a "liner."

In the illustrative wellbore arrangement of FIG. 1, intermediate casing string 104 is hung from the surface 101, while casing string 106 is hung from a lower end of casing string 104. Additional intermediate casing strings (not shown) may be employed. The present inventions are not limited to the type of casing arrangement used.

Each string of casing 102, 104, 106 is set in place through a cement column 108. The cement column 108 isolates the various formations of the subsurface 110 from the wellbore 100 and each other. The column of cement 108 extends from the surface 101 to a depth "L" at a lower end of the casing string 106. It is understood that some intermediate casing strings may not be fully cemented.

An annular region 204 (seen in FIG. 2) is formed between the production tubing 130 and the casing string 106. A production packer 206 seals the annular region 204 near the lower end "L" of the casing string 106.

In many wellbores, a final casing string known as production casing is cemented into place at a depth where subsurface production intervals reside. However, the illustrative wellbore 100 is completed as an open-hole wellbore. Accordingly, the wellbore 100 does not include a final casing string along the open-hole portion 120.

In the illustrative wellbore 100, the open-hole portion 120 traverses three different subsurface intervals. These are indicated as upper interval 112, intermediate interval 114, and lower interval 116. Upper interval 112 and lower interval 116 may, for example, contain valuable oil deposits sought to be produced, while intermediate interval 114 may contain primarily water or other aqueous fluid within its pore volume. This may be due to the presence of native water zones, high permeability streaks or natural fractures in the aquifer, or fingering from injection wells. In this instance, there is a probability that water will invade the wellbore 100.

Alternatively, upper 112 and intermediate 114 intervals may contain hydrocarbon fluids sought to be produced, processed and sold, while lower interval 116 may contain some oil along with ever-increasing amounts of water. This may be due to coning, which is a rise of near-well hydrocarbon-water contact. In this instance, there is again the possibility that water will invade the wellbore 100.

Alternatively still, upper 112 and lower 116 intervals may be producing hydrocarbon fluids from a sand or other permeable rock matrix, while intermediate interval 114 may represent a non-permeable shale or otherwise be substantially impermeable to fluids.

In any of these events, it is desirable for the operator to isolate selected intervals. In the first instance, the operator will want to isolate the intermediate interval 114 from the production string 130 and from the upper 112 and lower 116 intervals (by use of packer assemblies 210' and 210") so that primarily hydrocarbon fluids may be produced through the wellbore 100 and to the surface 101. In the second instance, the operator will eventually want to isolate the lower interval 116 from the production string 130 and the upper 112 and intermediate 114 intervals so that primarily hydrocarbon fluids may be produced through the wellbore 100 and to the surface 101. In the third instance, the operator will want to isolate the upper interval 112 from the lower interval 116, but need not isolate the intermediate interval 114. Solutions to these needs in the context of an open-hole completion are provided herein, and are demonstrated more fully in connection with the proceeding drawings.

In connection with the production of hydrocarbon fluids from a wellbore having an open-hole completion, it is not only desirable to isolate selected intervals, but also to limit the influx of sand particles and other fines. In order to prevent the migration of formation particles into the production string 130 during operation, sand control devices 200 (or segments) have been run into the wellbore 100. These are described more fully below in connection with FIG. 2 and with FIGS. 8A through 8J.

Figure 2:
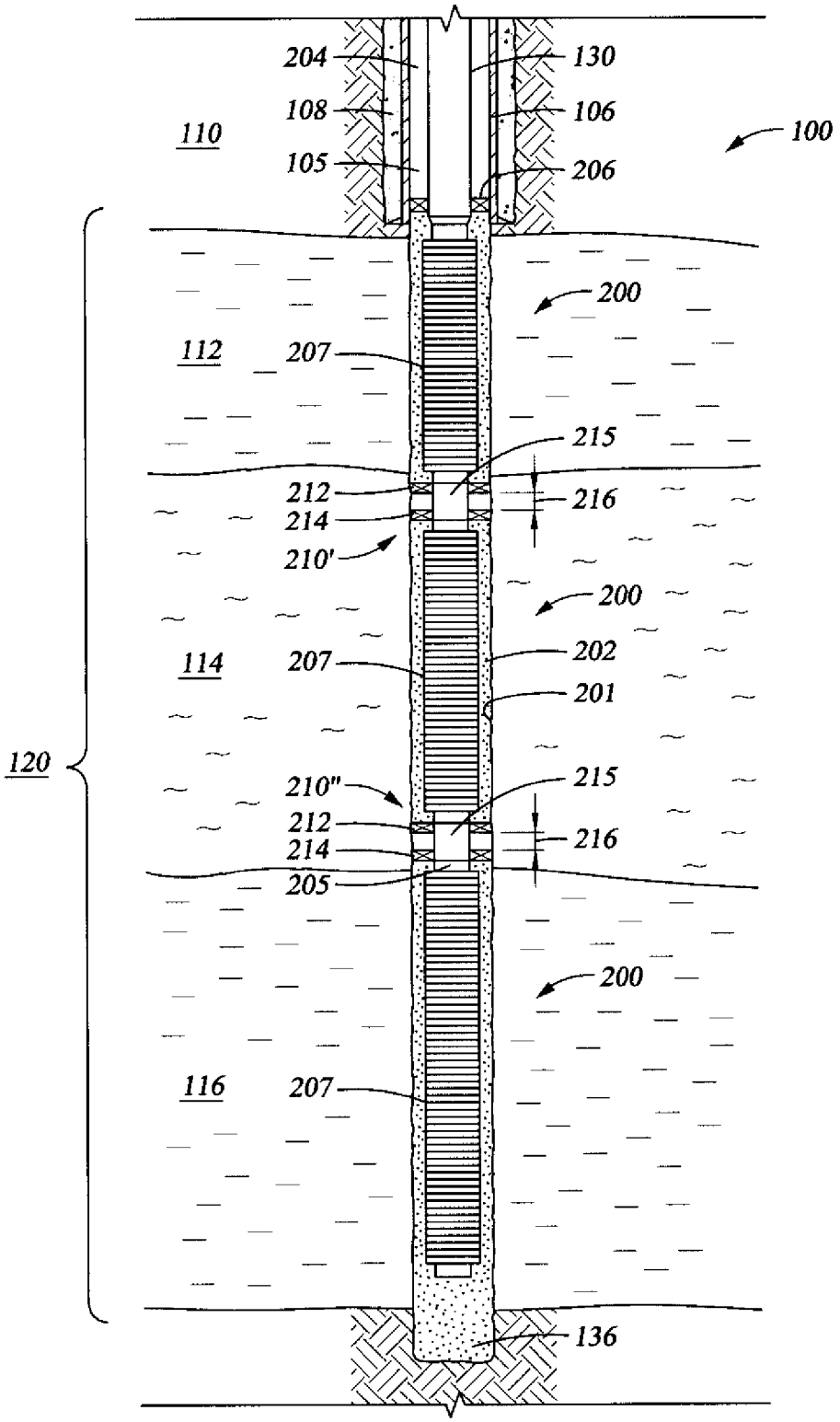
FIG. 2 is an enlarged cross-sectional view of an open-hole completion of the wellbore of FIG. 1. The open-hole completion at the depth of the three illustrative intervals is more clearly seen.

Referring now to FIG. 2, the sand control devices 200 contain an elongated tubular body referred to as a base pipe 205. The base pipe 205 typically is made up of a plurality of pipe joints. The base pipe 205 (or each pipe joint making up the base pipe 205) typically has small perforations or slots to permit the inflow of production fluids.

The sand control devices 200 also contain a filter medium 207 wound or otherwise placed radially around the base pipes 205. The filter medium 207 may be a wire mesh screen or wire wrap fitted around the base pipe 205. Alternatively, the filtering medium of the sand screen may comprise a membrane screen, an expandable screen, a sintered metal screen, a porous media made of shape-memory polymer (such as that described in U.S. Pat. No. 7,926,565), a porous media packed with fibrous material, or a pre-packed solid particle bed. The filter medium 207 prevents the inflow of sand or other particles above a pre-determined size into the base pipe 205 and the production tubing 130.

In addition to the sand control devices 200, the wellbore 100 includes one or more packer assemblies 210. In the illustrative arrangement of FIGS. 1 and 2, the wellbore 100 has an upper packer assembly 210' and a lower packer assembly 210". However, additional packer assemblies 210 or just one packer assembly 210 may be used. The packer assemblies 210', 210" are uniquely configured to seal an annular region (seen at 202 of FIG. 2) between the various sand control devices 200 and a surrounding wall 201 of the open-hole portion 120 of the wellbore 100.

FIG. 2 provides an enlarged cross-sectional view of the open-hole portion 120 of the wellbore 100 of FIG. 1. The open-hole portion 120 and the three intervals 112, 114, 116 are more clearly seen. The upper 210' and lower 210" packer assemblies are also more clearly visible proximate upper and lower boundaries of the intermediate interval 114, respectively. Gravel has been placed within the annular region 202. Finally, the sand control devices, or segments, 200 along each of the intervals 112, 114, 116 are shown.

Concerning the packer assemblies themselves, each packer assembly 210', 210" may have two separate packers. The packers are preferably set through a combination of mechanical manipulation and hydraulic forces. For purposes of this disclosure, the packers are referred to as being mechanically-set packers. The illustrative packer assemblies 210 represent an upper packer 212 and a lower packer 214. Each packer 212, 214 has an expandable portion or element fabricated from an elastomeric or a thermoplastic material capable of providing at least a temporary fluid seal against a surrounding wellbore wall 201.

The elements for the upper 212 and lower 214 packers should be able to withstand the pressures and loads associated with a gravel packing process. Typically, such pressures are from about 2,000 psi to 3,000 psi. The elements for the packers 212, 214 should also withstand pressure load due to differential wellbore and/or reservoir pressures caused by natural faults, depletion, production, or injection. Production operations may involve selective production or production allocation to meet regulatory requirements. Injection operations may involve selective fluid injection for strategic reservoir pressure maintenance. Injection operations may also involve selective stimulation in acid fracturing, matrix acidizing, or formation damage removal.

The sealing surface or elements for the mechanically-set packers 212, 214 need only be on the order of inches in order to affect a suitable hydraulic seal. In one aspect, the elements are each about 6 inches (15.2 cm) to about 24 inches (61.0 cm) in length.

It is preferred for the elements of the packers 212, 214 to be able to expand to at least an 11-inch (about 28 cm) outer diameter surface, with no more than a 1.1 ovality ratio. The elements of the packers 212, 214 should preferably be able to handle washouts in an 8½ inch (about 21.6 cm) or 9⅞ inch (about 25.1 cm) open-hole section 120. The expandable portions of the packers 212, 214 will assist in maintaining at least a temporary seal against the wall 201 of the intermediate interval 114 (or other interval) as pressure increases during the gravel packing operation.

The upper 212 and lower 214 packers are set prior to a gravel pack installation process. As described more fully below, the packers 212, 214 may be set by sliding a release sleeve. This, in turn, allows hydrostatic pressure to act downwardly against a piston mandrel. The piston mandrel acts down upon a centralizer and/or packer elements, causing the same to expand against the wellbore wall 201. The elements of the upper 212 and lower 214 packers are expanded into contact with the surrounding wall 201 so as to straddle the annular region 202 at a selected depth along the open-hole completion 120.

FIG. 2 shows a mandrel at 215 in the packers 212, 214. This may be representative of the piston mandrel, and other mandrels used in the packers 212, 214 as described more fully below.

As a "back-up" to the expandable packer elements within the upper 212 and lower 214 packers, the packer assemblies 210', 210" also may include an intermediate packer element 216. The intermediate packer element 216 defines a swelling elastomeric material fabricated from synthetic rubber compounds. Suitable examples of swellable materials may be found in Easy Well Solutions' Constrictor™ or Swell-Packer™, and SwellFix's E-ZIP™. The swellable packer 216 may include a swellable polymer or swellable polymer material, which is known by those skilled in the art and which may be set by one of a conditioned drilling fluid, a completion fluid, a production fluid, an injection fluid, a stimulation fluid, or any combination thereof.

The upper 212 and lower 214 packers may generally be mirror images of each other, except for the release sleeves that shear the respective shear pins or other engagement mechanisms. Unilateral movement of a setting tool (shown in FIG. 7C and discussed in connection with FIGS. 7A and 7B) will allow the packers 212, 214 to be activated in sequence or simultaneously. The lower packer 214 is activated first, followed by the upper packer 212 as the shifting tool is pulled upward through an inner mandrel (shown in and discussed in connection with FIGS. 6A and 6B). A short spacing is preferably provided between the upper 212 and lower 214 packers.

The packer assemblies 210', 210" help control and manage fluids produced from different zones. In this respect, the packer assemblies 210', 210" allow the operator to seal off an interval from either production or injection, depending on well function. Installation of the packer assemblies 210', 210" in the initial completion allows an operator to shut-off the production from one or more zones during the well lifetime to limit the production of water or, in some instances, an undesirable non-condensable fluid such as hydrogen sulfide.

Packers historically have not been installed when an open-hole gravel pack is utilized because of the difficulty in forming a seal along an open-hole portion, and because of the difficulty in forming a complete gravel pack above and below the packer. Related patents U.S. Pat. Nos. 8,215,406 and 8,517,098 disclose apparatus' and methods for gravel-packing an open-hole wellbore after a packer has been set at a completion interval. Zonal isolation in open-hole, gravel-packed completions may be provided by using a packer element and secondary (or "alternate") flow paths to enable both zonal isolation and alternate flow path gravel packing.

Certain technical challenges have remained with respect to the methods disclosed in U.S. Pat. Publ. No. 2009/0294128 and 2010/0032518, particularly in connection with the packer. The applications state that the packer may be a hydraulically actuated inflatable element. Such an inflatable element may be fabricated from an elastomeric material or a thermoplastic material. However, designing a packer element from such materials requires the packer element to meet a particularly high performance level. In this respect, the packer element needs to be able to maintain zonal isolation for a period of years in the presence of high pressures and/or high temperatures and/or acidic fluids. As an alternative, the applications state that the packer may be a swelling rubber element that expands in the presence of hydrocarbons, water, or other stimulus. However, known swelling elastomers typically require about 30 days or longer to fully expand into sealed fluid engagement with the surrounding rock formation. Therefore, improved packers and zonal isolation apparatus' are offered herein.

Figure 3A:
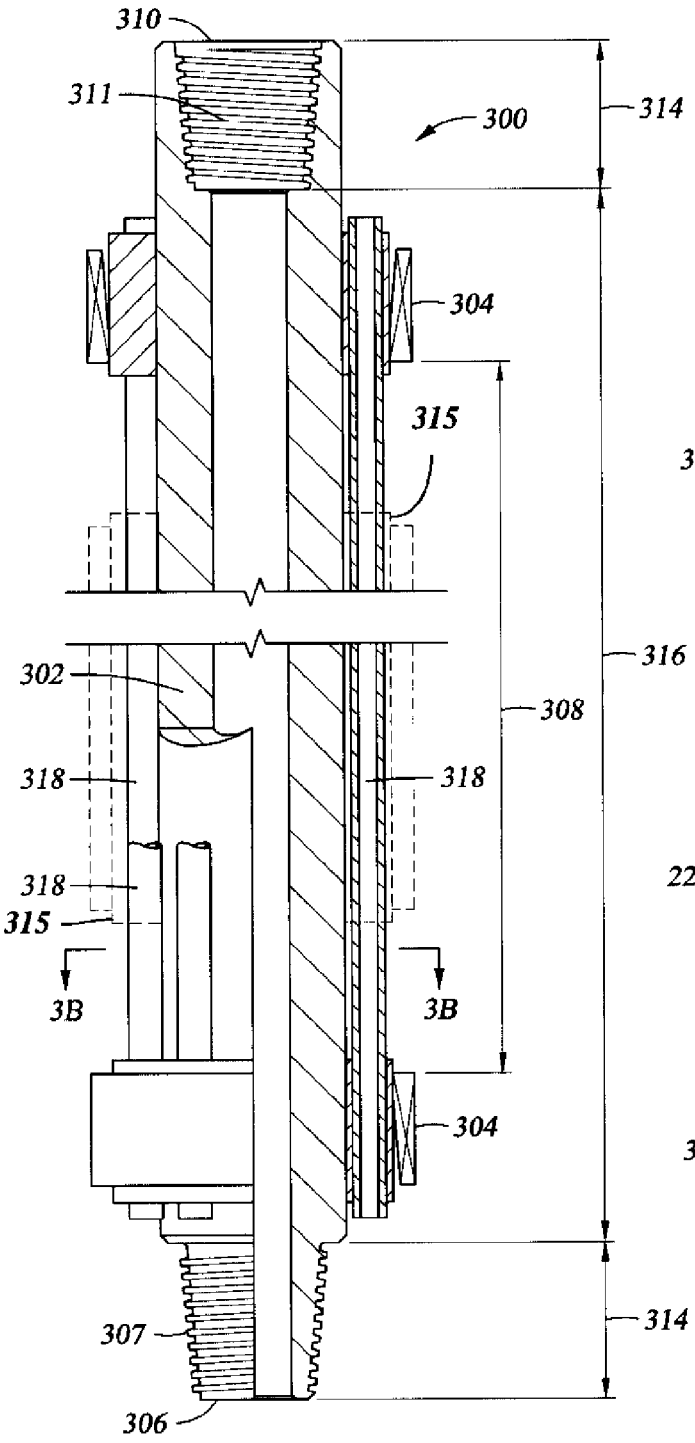
FIG. 3A is a cross-sectional side view of a packer assembly, in one embodiment. Here, a base pipe is shown, with surrounding packer elements. Two mechanically-set packers are shown.

FIG. 3A presents an illustrative packer assembly 300 providing an alternate flowpath for a gravel slurry. The packer assembly 300 is generally seen in cross-sectional side view. The packer assembly 300 includes various components that may be utilized to seal an annulus along the open-hole portion 120.

The packer assembly 300 first includes a main body section 302. The main body section 302 is preferably fabricated from steel or from steel alloys. The main body section 302 is configured to be a specific length 316, such as about 40 feet (12.2 meters). The main body section 302 comprises individual pipe joints that will have a length that is between about 10 feet (3.0 meters) and 50 feet (15.2 meters). The pipe joints are typically threadedly connected end-to-end to form the main body section 302 according to length 316.

The packer assembly 300 also includes opposing mechanically-set packers 304. The mechanically-set packers 304 are shown schematically, and are generally in accordance with mechanically-set packer elements 212 and 214 of FIG. 2. The packers 304 preferably include cup-type elastomeric elements that are less than 1 foot (0.3 meters) in length. As described further below, the packers 304 have alternate flow channels that uniquely allow the packers 304 to be set before a gravel slurry is circulated into the wellbore.

The packer assembly 300 also optionally includes a swellable packer. Alternatively, a short spacing 308 may be provided between the mechanically-set packers 304 in lieu of the swellable packer. When the packers 304 are mirror images of one another, the cup-type elements are able to resist fluid pressure from either above or below the packer assembly.

The packer assembly 300 also includes a plurality of shunt tubes. The shunt tubes are seen in phantom at 318. The shunt tubes 318 may also be referred to as transport tubes or alternate flow channels or even jumper tubes. The transport tubes 318 are blank sections of pipe having a length that extends along the length 316 of the mechanically-set packers 304 and the swellable packer 308. The transport tubes 318 on the packer assembly 300 are configured to couple to and form a seal with shunt tubes on connected sand screens, as discussed further below.

The shunt tubes 318 provide an alternate flowpath through the mechanically-set packers 304 and the intermediate spacing 308. This enables the shunt tubes 318 to transport a carrier fluid along with gravel to different intervals 112, 114 and 116 of the open-hole portion 120 of the wellbore 100.

The packer assembly 300 also includes connection members. These may represent traditional threaded couplings. First, a neck section 306 is provided at a first end of the packer assembly 300. The neck section 306 has external threads for connecting with a threaded coupling box of a sand screen or other pipe. Then, a notched or externally threaded section 310 is provided at an opposing second end. The threaded section 310 serves as a coupling box for receiving an external threaded end of a sand screen or other tubular member.

The neck section 306 and the threaded section 310 may be made of steel or steel alloys. The neck section 306 and the threaded section 310 are each configured to be a specific length 314, such as 4 inches (10.2 cm) to 4 feet (1.2 meters) (or other suitable distance). The neck section 306 and the threaded section 310 also have specific inner and outer diameters. The neck section 306 has external threads 307, while the threaded section 310 has internal threads 311. These threads 307 and 311 may be utilized to form a seal between the packer assembly 300 and sand control devices or other pipe segments.

Figure 3B:
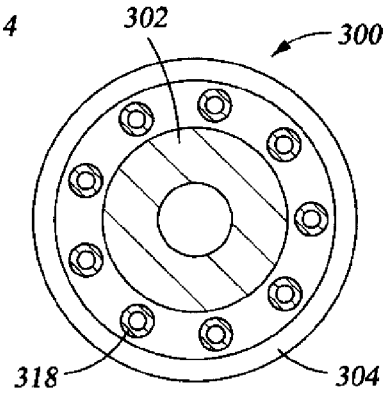
FIG. 3B is a cross-sectional view of the packer assembly of FIG. 3A, taken across lines 3B-3B of FIG. 3A. Shunt tubes are seen within the swellable packer element.

A cross-sectional view of the packer assembly 300 is shown in FIG. 3B. FIG. 3B is taken along the line 3B-3B of FIG. 3A. In FIG. 3B, the swellable packer 308 is seen circumferentially disposed around the base pipe 302. Various shunt tubes 318 are placed radially and equidistantly around the base pipe 302. A central bore 305 is shown within the base pipe 302. The central bore 305 receives production fluids during production operations and conveys them to the production tubing 130.

Figure 4A:
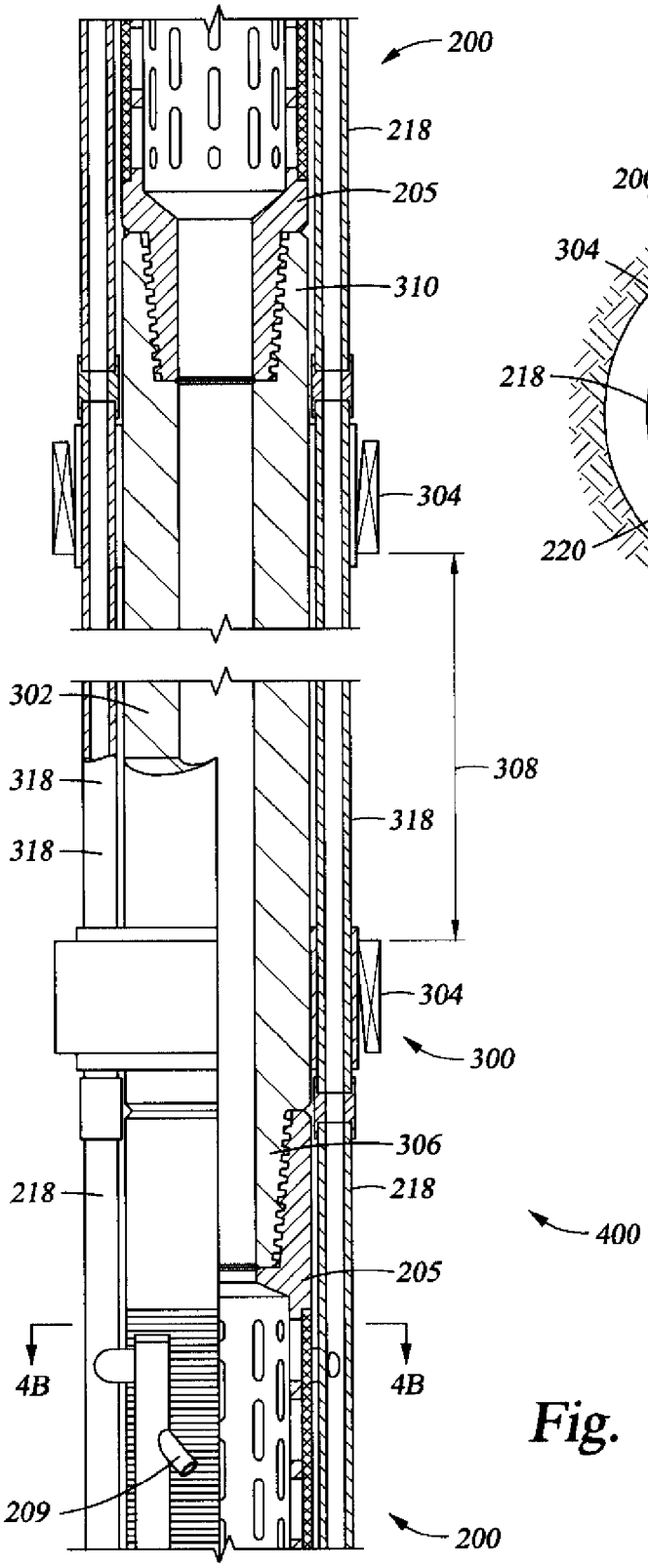
FIG. 4A is a cross-sectional side view of the packer assembly of FIG. 3A. Here, sand control devices, or sand screens, have been placed at opposing ends of the packer assembly. The sand control devices utilize external shunt tubes.

FIG. 4A presents a cross-sectional side view of a zonal isolation apparatus 400, in one embodiment. The zonal isolation apparatus 400 includes the packer assembly 300 from FIG. 3A. In addition, sand control devices 200 have been connected at opposing ends to the neck section 306 and the notched section 310, respectively. Transport tubes 318 from the packer assembly 300 are seen connected to shunt tubes 218 on the sand control devices 200. The shunt tubes 218 represent packing tubes (or conduits) that allow the flow of gravel slurry between a wellbore annulus and the tubes 218. The shunt tubes 218 on the sand control devices 200 optionally include nozzles 209 to control the flow of gravel slurry such as to packing tubes (shown at 218 in FIG. 5A).

Figure 4B:
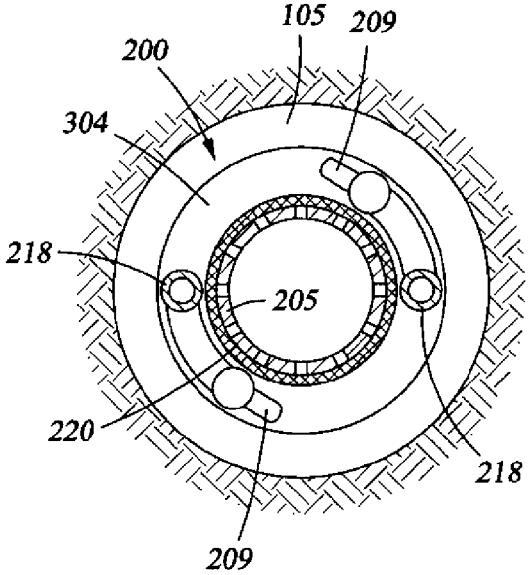
FIG. 4B provides a cross-sectional view of the screen assembly in FIG. 4A, taken across lines 4B-4B of FIG. 4A. Shunt tubes are seen outside of the sand screen to provide an alternative flowpath for a particulate slurry.

FIG. 4B provides a cross-sectional side view of the zonal isolation apparatus 400. FIG. 4B is taken along the line 4B-4B of FIG. 4A. This is cut through one of the sand screens 200. In FIG. 4B, the slotted or perforated base pipe 205 is seen. This is in accordance with base pipe 205 of FIGS. 1 and 2. The central bore 105 is shown within the base pipe 205 for receiving production fluids during production operations.

An outer mesh 220 is disposed immediately around the base pipe 205. The outer mesh 220 preferably comprises a wire mesh or wires helically wrapped around the base pipe 205, and serves as a screen. In addition, shunt tubes 218 are placed radially and equidistantly around the outer mesh 205. This means that the sand control devices 200 provide an external embodiment for the shunt tubes 218 (or alternate flow channels).

The configuration of the shunt tubes 218 is preferably concentric. This is seen in the cross-sectional views of FIGS. 3B and 4B. However, the shunt tubes 218 may be eccentrically designed. For example, FIG. 2B in U.S. Pat. No. 7,661,476 presents a "Prior Art" arrangement for a sand control device wherein packing tubes 208*a* and transport tubes 208*b* are placed external to the base pipe 202 and surrounding filter medium 204, forming an eccentric arrangement.

In the arrangement of FIGS. 4A and 4B, the shunt tubes 218 are external to the filter medium, or outer mesh 220. However, the configuration of the sand control device 200 may be modified. In this respect, the shunt tubes 218 may be moved internal to the filter medium 220.

Figure 5A:
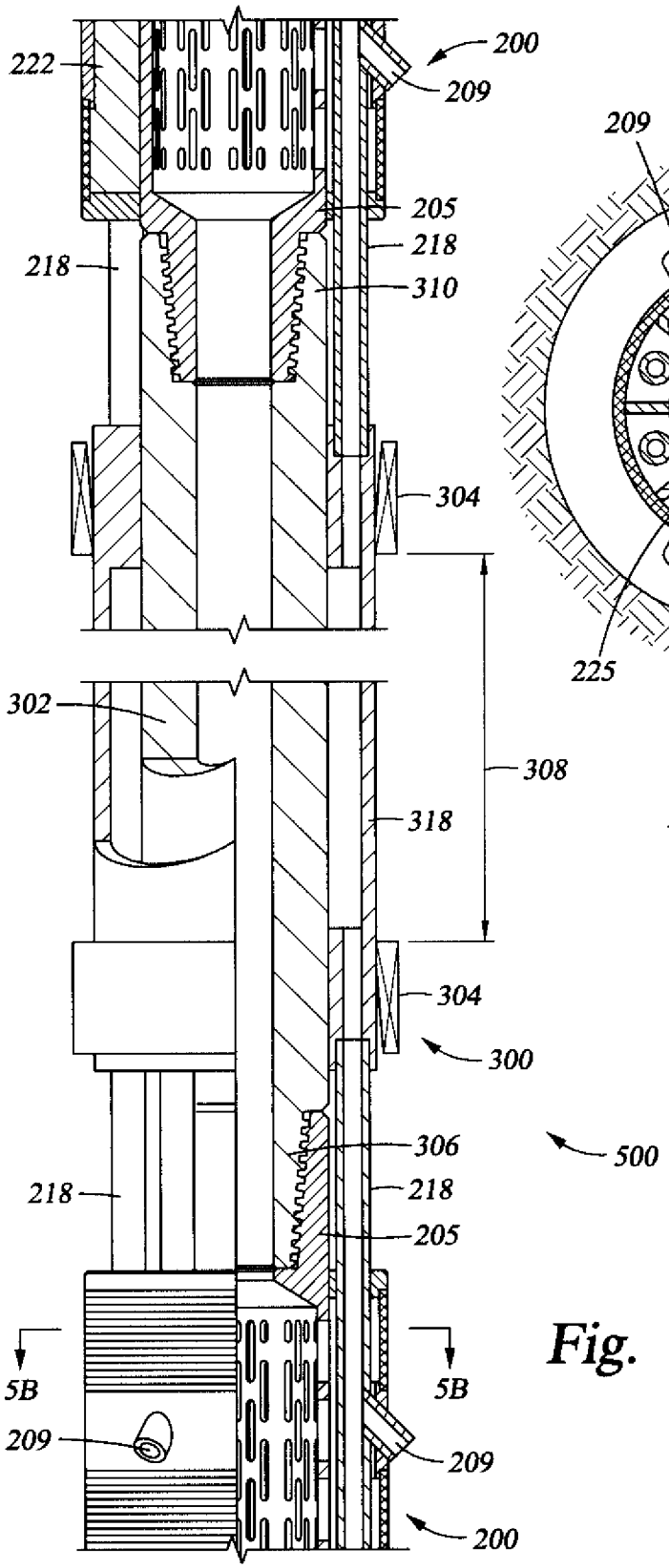
FIG. 5A is another cross-sectional side view of the packer assembly of FIG. 3A and a sand screen assembly. Here, sand control devices, or sand screens, have again been placed at opposing ends of the packer assembly. However, the sand control devices utilize internal shunt tubes.

FIG. 5A presents a cross-sectional side view of a zonal isolation apparatus 500, in an alternate embodiment. In this embodiment, sand control devices 200 are again connected at opposing ends to the neck section 306 and the notched section 310, respectively, of the packer assembly 300. In addition, transport tubes 318 on the packer assembly 300 are seen connected to shunt tubes 218 on the sand screen assembly 200. However, in FIG. 5A, the sand screen assembly 200 utilizes internal shunt tubes 218, meaning that the shunt tubes 218 are disposed between the base pipe 205 and the surrounding filter medium 220.

Figure 5B:
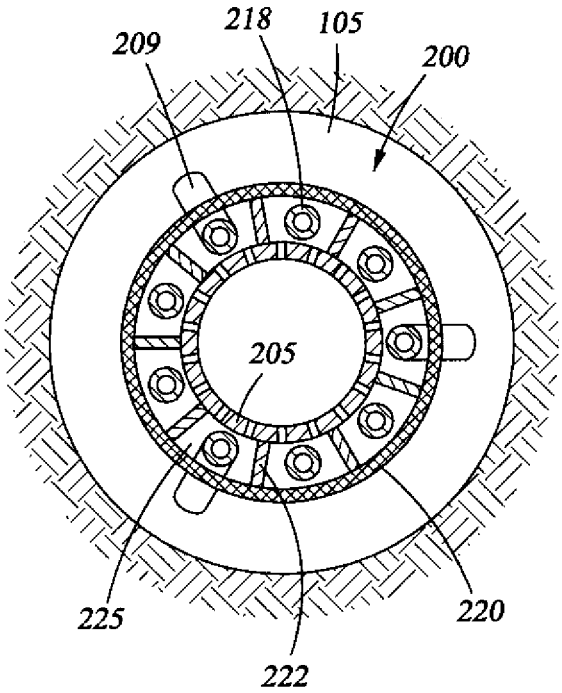
FIG. 5B provides a cross-sectional view of the packer assembly of FIG. 5A, taken across lines 5B-5B of FIG. 5A. Shunt tubes are seen within the sand screen to provide an alternative flowpath for a particulate slurry.

FIG. 5B provides a cross-sectional side view of the zonal isolation apparatus 500. FIG. 5B is taken along the line B-B of FIG. 5A. This is cut through one of the sand screens 200. In FIG. 5B, the slotted or perforated base pipe 205 is again seen. This is in accordance with base pipe 205 of FIGS. 1 and 2. The central bore 105 is shown within the base pipe 205 for receiving production fluids during production operations.

Shunt tubes 218 are placed radially and equidistantly around the base pipe 205. The shunt tubes 218 reside immediately around the base pipe 205, and within a surrounding filter medium 220. This means that the sand control devices 200 of FIGS. 5A and 5B provide an internal embodiment for the shunt tubes 218.

An annular region 225 is created between the base pipe 205 and the surrounding outer mesh or filter medium 220. The annular region 225 accommodates the inflow of production fluids in a wellbore. The outer wire wrap 220 is supported by a plurality of radially extending support ribs 222. The ribs 222 extend through the annular region 225. Nozzles 209 delivery slurry outside of the sand control devices 200.

Figure 3C:
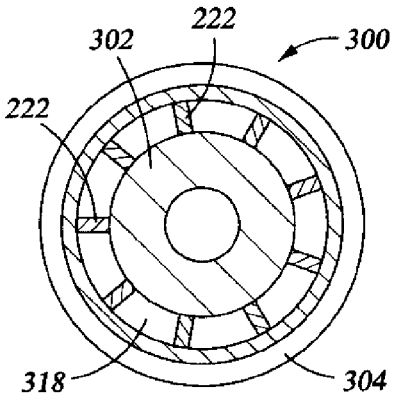
FIG. 3C is a cross-sectional view of the packer assembly of FIG. 3A, in an alternate embodiment. In lieu of shunt tubes, transport tubes are seen manifolded around the base pipe.

FIGS. 4A and 5A present arrangements for connecting sand screens 200 to the packer assembly 300 of FIG. 3A. Transport tubes 318 (or alternate flow channels) within the packer assembly 300 fluidly connect to shunt tubes 218 along the sand screens 200. It is understood that the present apparatus and methods are not confined by the particular design and arrangement of shunt tubes 318 so long as slurry bypass is provided for the packer assembly 210. FIG. 3C is a cross-sectional view of the packer assembly 300 of FIG. 3A, in an alternate embodiment. In this arrangement, shunt tubes 318 are manifolded around the base pipe 302. A support ring 315 is provided around the shunt tubes 318.

Coupling sand control devices 200 with a packer assembly 300 requires alignment of the transport tubes 318 in the packer assembly 300 with the shunt tubes 218 along the sand control devices 200. In this respect, the flow path of the shunt tubes 218 in the sand control devices should be un-interrupted when engaging the transport tubes 318 of a packer. FIG. 4A (described above) illustrates sand control devices 200 connected to an intermediate packer assembly 300, with the tubes 218, 318 in alignment. To expedite making this connection, special sleeves have been developed.

U.S. Pat. No. 7,661,476, entitled "Gravel Packing Methods," discloses a production string (referred to as a joint assembly) that employs a series of sand screen joints. The sand screen joints are placed between a "load sleeve" and a "torque sleeve." The load sleeve defines an elongated body comprising an outer wall (serving as an outer diameter) and an inner wall (providing an inner diameter). The inner wall forms a bore through the load sleeve. Similarly, the torque sleeve defines an elongated body comprising an outer wall (serving as an outer diameter) and an inner wall (providing an inner diameter). The inner wall also forms a bore through the torque sleeve. The load sleeve and the torque sleeve may be used for making the connection with a packer assembly, and thereby providing fluid communication with transport tubes along the packers.

Figure 9A:
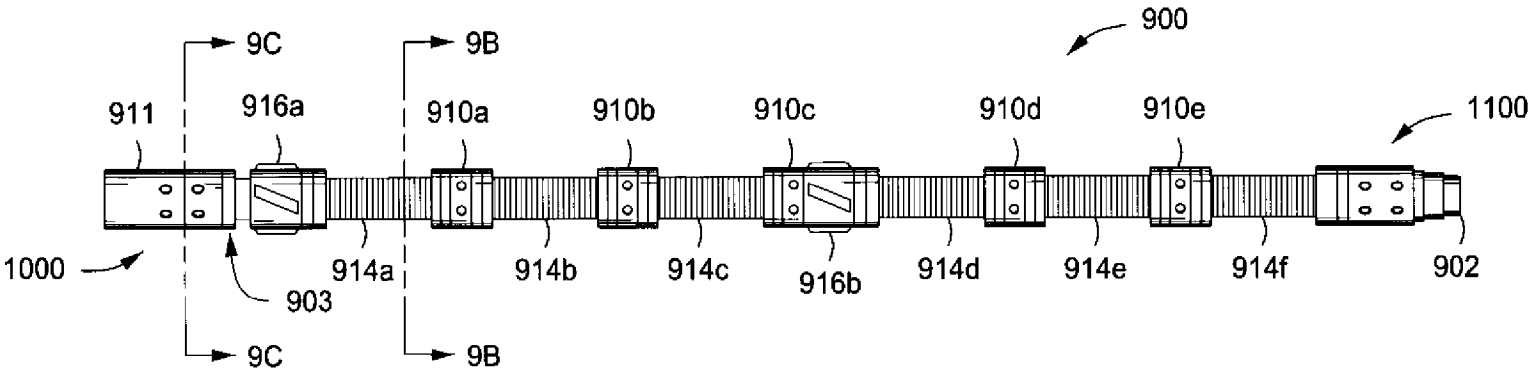
FIG. 9A is a side view of a sand screen assembly as may be used in the wellbore completion apparatus of the present invention, in one embodiment. The sand screen assembly includes a plurality of sand control segments, or sand screens, connected using nozzle rings.

FIG. 9A offers a side view of a sand screen assembly 900 as may be used in the wellbore completion apparatus of the present invention, in one embodiment. The illustrative sand screen assembly 900 is taken from the '476 patent, above. The sand screen assembly 900 includes a plurality of sand control segments, or sand screens 914*a*, 914*b*, . . . 914*n*. The sand screens 914*a*, 914*b*, . . . 914*n* are connected in series using nozzle rings 910*a*, 910*b*, . . . 910*n*. The sand screen assembly 900 employs a main body portion 902 having a first or upstream end and a second or downstream end. A load sleeve 1000 is operably attached at or near the first end, while a torque sleeve 1100 is operably attached at or near the second end.

The load sleeve 1000 includes at least one transport conduit and at least one packing conduit. The at least one transport conduit and the at least one packing conduit are disposed exterior to the inner diameter and interior to the outer diameter. Similarly, the torque sleeve 1100 includes at least one conduit. The at least one conduit is also disposed exterior to the inner diameter and interior to the outer diameter. The coupling joints 910*a*, 910*b*, . . . 910*n* provide aligned openings (seen at 1204 in FIG. 12). The benefit of the load sleeve 1000, the torque sleeve 1100, and the nozzle rings 910*a*, 910*b*, . . . 910*n* is that they enable a series of sand screen joints 914*a*, 914*b*, . . . 914*n* to be connected and run into the wellbore in a faster and less expensive manner.

FIG. 9A demonstrates the placement of a load sleeve 1000 and a torque sleeve 1100 at opposing ends of a sand screen assembly 900. However, these assemblies 1000, 1100 may also be used at opposing ends of an elongated joint assembly, as discussed more fully below in connection with FIG. 14. Each of the load sleeve 1000 and the torque sleeve 1100 have transport tubes as shown and discussed more fully below in connection with FIGS. 10A and 11, respectively.

Figure 9C:
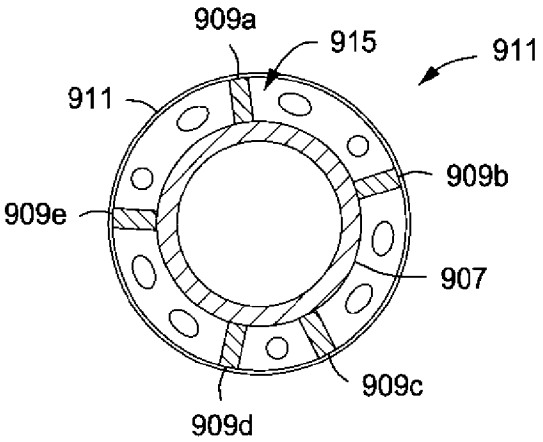
FIG. 9C is another cross-sectional view of the sand screen assembly of FIG. 9A, this time taken across lines 9C-9C of FIG. 9A. This shows a coupling assembly.
Figure 9B:
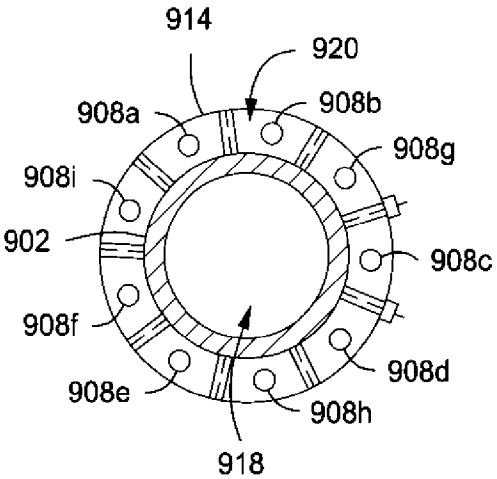
FIG. 9B is a cross-sectional view of the sand screen assembly of FIG. 9A, taken across lines 9B-9B of FIG. 9A. This shows one of the sand screen segments.

FIG. 9B is a cross-sectional view of the sand screen assembly 900 of FIG. 9A, taken across lines 9B-9B of FIG. 9A. Specifically, the view is taken through a sand control device 914*a*. A filtering media is shown at 914. FIG. 9C is another cross-sectional view of the sand screen assembly 900 of FIG. 9A, this time taken across lines 9C-9C of FIG. 9A. Here, the view is taken through a coupling assembly 911.

The coupling assembly 911 is operably attached to the first end of the sand screen assembly 900. The coupling assembly 911 includes a manifold 915, shown in the cross-sectional view of FIG. 9C. The manifold 915 enables transport tubes in the load sleeve 1000 and transport tubes in a connected joint assembly (shown at 1400 in FIG. 14) to be placed in fluid communication.

Returning to FIG. 3A, as noted, the packer assembly 300 includes a pair of mechanically-set packers 304. When using the packer assembly 300, the packers 304 are beneficially set before the slurry is injected and the gravel pack is formed. This requires a unique packer arrangement wherein shunt tubes are provided for an alternate flow channel.

The packers 304 of FIG. 3A are shown schematically. However, FIGS. 6A and 6B provide more detailed views of a suitable mechanically-set packer 600 that may be used in the packer assembly of FIG. 3A, in one embodiment.

Figure 6A:
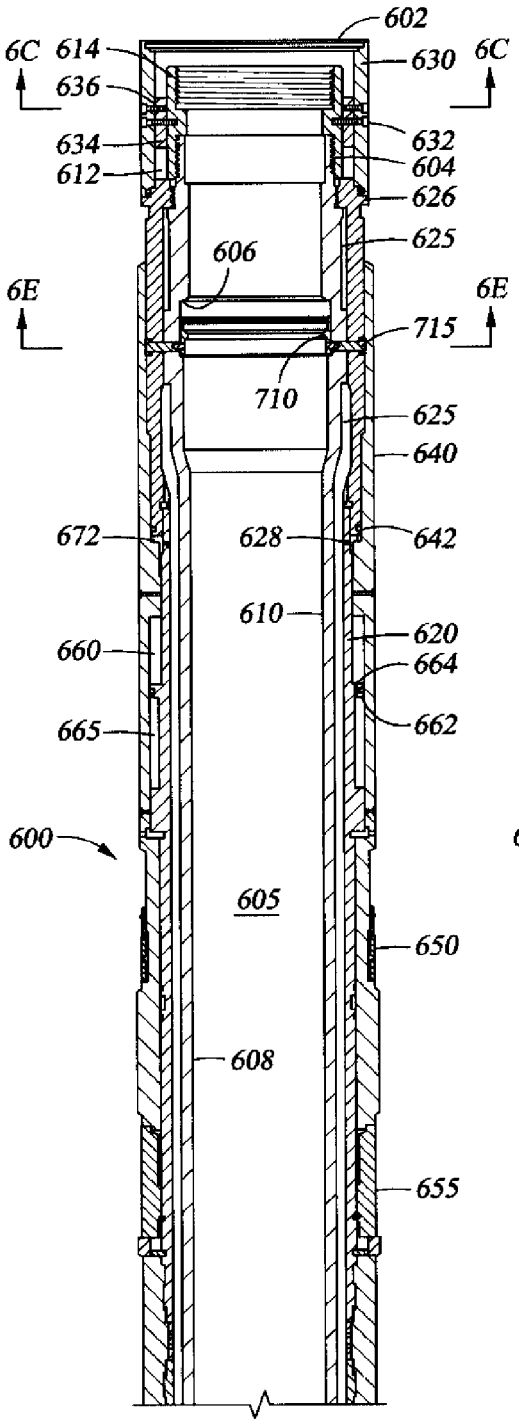
FIG. 6A is a cross-sectional view of one of the mechanically-set packers of FIG. 3A. Here, the mechanically-set packer is in its run-in position.
Figure 6B:
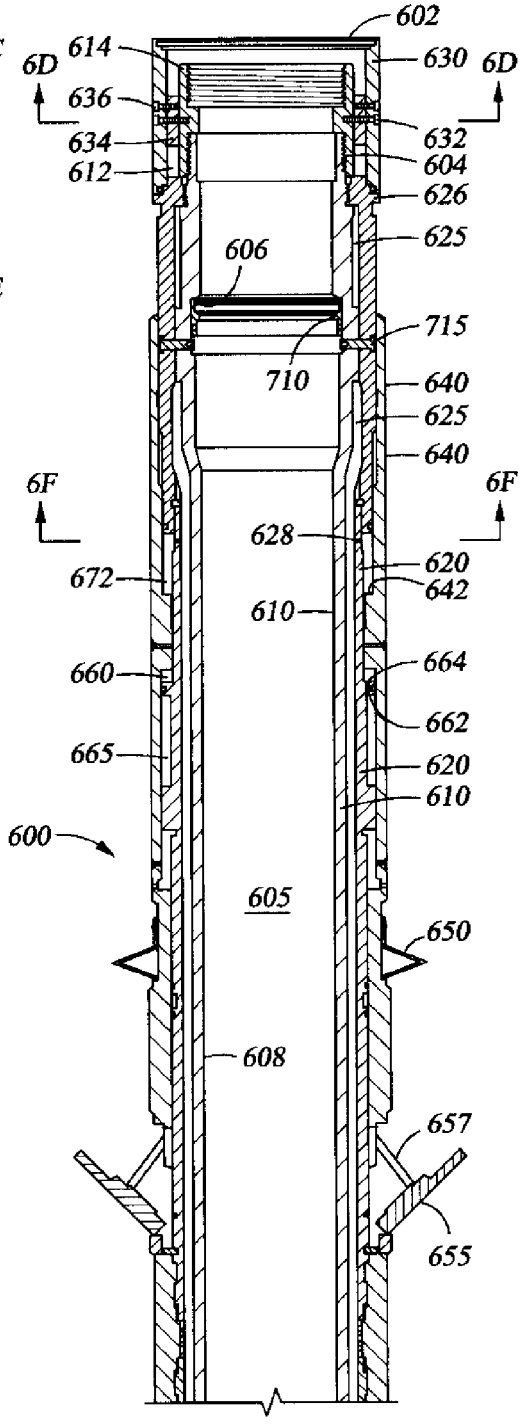
FIG. 6B is a cross-sectional view of the mechanically-set packers of FIG. 6A. Here, the mechanically-set packer has been activated and is in its set position.

The views of FIGS. 6A and 6B provide cross-sectional views. In FIG. 6A, the packer 600 is in its run-in position, while in FIG. 6B the packer 600 is in its set position.

The packer 600 first includes an inner mandrel 610. The inner mandrel 610 defines an elongated tubular body forming a central bore 605. The central bore 605 provides a primary flow path of production fluids through the packer 600. After installation and commencement of production, the central bore 605 transports production fluids to the bore 105 of the sand screens 200 (seen in FIGS. 4A and 4B) and the production tubing 130 (seen in FIGS. 1 and 2).

The packer 600 also includes a first end 602. Threads 604 are placed along the inner mandrel 610 at the first end 602. The illustrative threads 604 are external threads. A box connector 614 having internal threads at both ends is connected or threaded on threads 604 at the first end 602. The first end 602 of inner mandrel 610 with the box connector 614 is called the box end. The second end (not shown) of the inner mandrel 610 has external threads and is called the pin end. The pin end (not shown) of the inner mandrel 610 allows the packer 600 to be connected to the box end of a sand screen or other tubular body such as a stand-alone screen, a sensing module, a production tubing, or a blank pipe.

The box connector 614 at the box end 602 allows the packer 600 to be connected to the pin end of a sand screen or other tubular body such as a stand-alone screen, a sensing module, a production tubing, or a blank pipe.

The inner mandrel 610 extends along the length of the packer 600. The inner mandrel 610 may be composed of multiple connected segments, or joints. The inner mandrel 610 has a slightly smaller inner diameter near the first end 602. This is due to a setting shoulder 606 machined into the inner mandrel. As will be explained more fully below, the setting shoulder 606 catches a release sleeve 710 in response to mechanical force applied by a setting tool.

The packer 600 also includes a piston mandrel 620. The piston mandrel 620 extends generally from the first end 602 of the packer 600. The piston mandrel 620 may be composed of multiple connected segments, or joints. The piston mandrel 620 defines an elongated tubular body that resides circumferentially around and substantially concentric to the inner mandrel 610. An annulus 625 is formed between the inner mandrel 610 and the surrounding piston mandrel 620. The annulus 625 beneficially provides a secondary flow path or alternate flow channels for fluids.

The annulus 625 is in fluid communication with the secondary flow path of another downhole tool (not shown in FIGS. 6A and 6B). Such a separate tool may be, for example, the joint assembly 1400 of FIG. 14, or a blank pipe, or other tubular body.

The packer 600 also includes a coupling 630. The coupling 630 is connected and sealed (e.g., via elastomeric "o" rings) to the piston mandrel 620 at the first end 602. The coupling 630 is then threaded and pinned to the box connector 614, which is threadedly connected to the inner mandrel 610 to prevent relative rotational movement between the inner mandrel 610 and the coupling 630. A first torque bolt is shown at 632 for pinning the coupling to the box connector 614.

In one aspect, a NACA (National Advisory Committee for Aeronautics) key 634 is also employed. The NACA key 634 is placed internal to the coupling 630, and external to a threaded box connector 614. A first torque bolt is provided at 632, connecting the coupling 630 to the NACA key 634 and then to the box connector 614. A second torque bolt is provided at 636 connecting the coupling 630 to the NACA key 634. NACA-shaped keys can (a) fasten the coupling 630 to the inner mandrel 610 via box connector 614, (b) prevent the coupling 630 from rotating around the inner mandrel 610, and (c) streamline the flow of slurry along the annulus 612 to reduce friction.

Within the packer 600, the annulus 625 around the inner mandrel 610 is isolated from the main bore 605. In addition, the annulus 625 is isolated from a surrounding wellbore annulus (not shown). The annulus 625 enables the transfer of gravel slurry from alternative flow channels (such as shunt tubes 218) through the packer 600. Thus, the annulus 625 becomes the alternative flow channel(s) for the packer 600.

In operation, an annular space 612 resides at the first end 602 of the packer 600. The annular space 612 is disposed between the box connector 614 and the coupling 630. The annular space 612 receives slurry from alternate flow channels of a connected tubular body, and delivers the slurry to the annulus 625. The tubular body may be, for example, an adjacent sand screen, a blank pipe, or a zonal isolation device.

The packer 600 also includes a load shoulder 626. The load shoulder 626 is placed near the end of the piston mandrel 620 where the coupling 630 is connected and sealed. A solid section at the end of the piston mandrel 620 has an inner diameter and an outer diameter. The load shoulder 626 is placed along the outer diameter. The inner diameter has threads and is threadedly connected to the inner mandrel 610. At least one alternate flow channel is formed between the inner and outer diameters to connect flow between the annular space 612 and the annulus 625.

The load shoulder 626 provides a load-bearing point. During rig operations, a load collar or harness (not shown) is placed around the load shoulder 626 to allow the packer 600 to be picked up and supported with conventional elevators. The load shoulder 626 is then temporarily used to support the weight of the packer 600 (and any connected completion devices such as sand screen joints already run into the well) when placed in the rotary floor of a rig. The load may then be transferred from the load shoulder 626 to a pipe thread connector such as box connector 614, then to the inner mandrel 610 or base pipe 205, which is pipe threaded to the box connector 614.

The packer 600 also includes a piston housing 640. The piston housing 640 resides around and is substantially concentric to the piston mandrel 620. The packer 600 is configured to cause the piston housing 640 to move axially along and relative to the piston mandrel 620. Specifically, the piston housing 640 is driven by the downhole hydrostatic pressure. The piston housing 640 may be composed of multiple connected segments, or joints.

The piston housing 640 is held in place along the piston mandrel 620 during run-in. The piston housing 640 is secured using a release sleeve 710 and release key 715. The release sleeve 710 and release key 715 prevent relative translational movement between the piston housing 640 and the piston mandrel 620. The release key 715 penetrates through both the piston mandrel 620 and the inner mandrel 610.

Figure 7A:
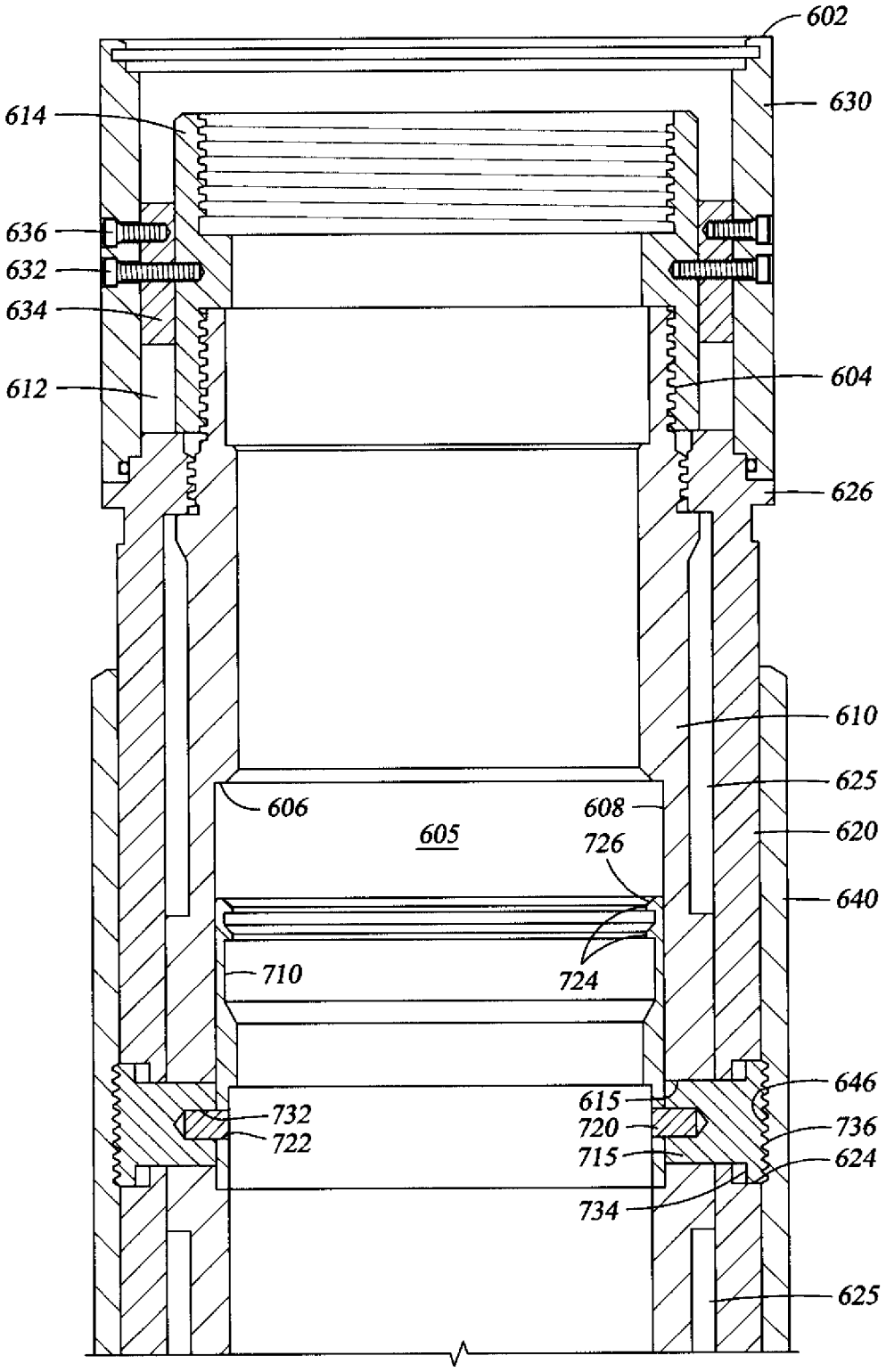
FIG. 7A is an enlarged view of the release key portion of FIG. 6A. The release key is in its run-in position along the inner mandrel. The shear pin has not yet been sheared.
Figure 7B:
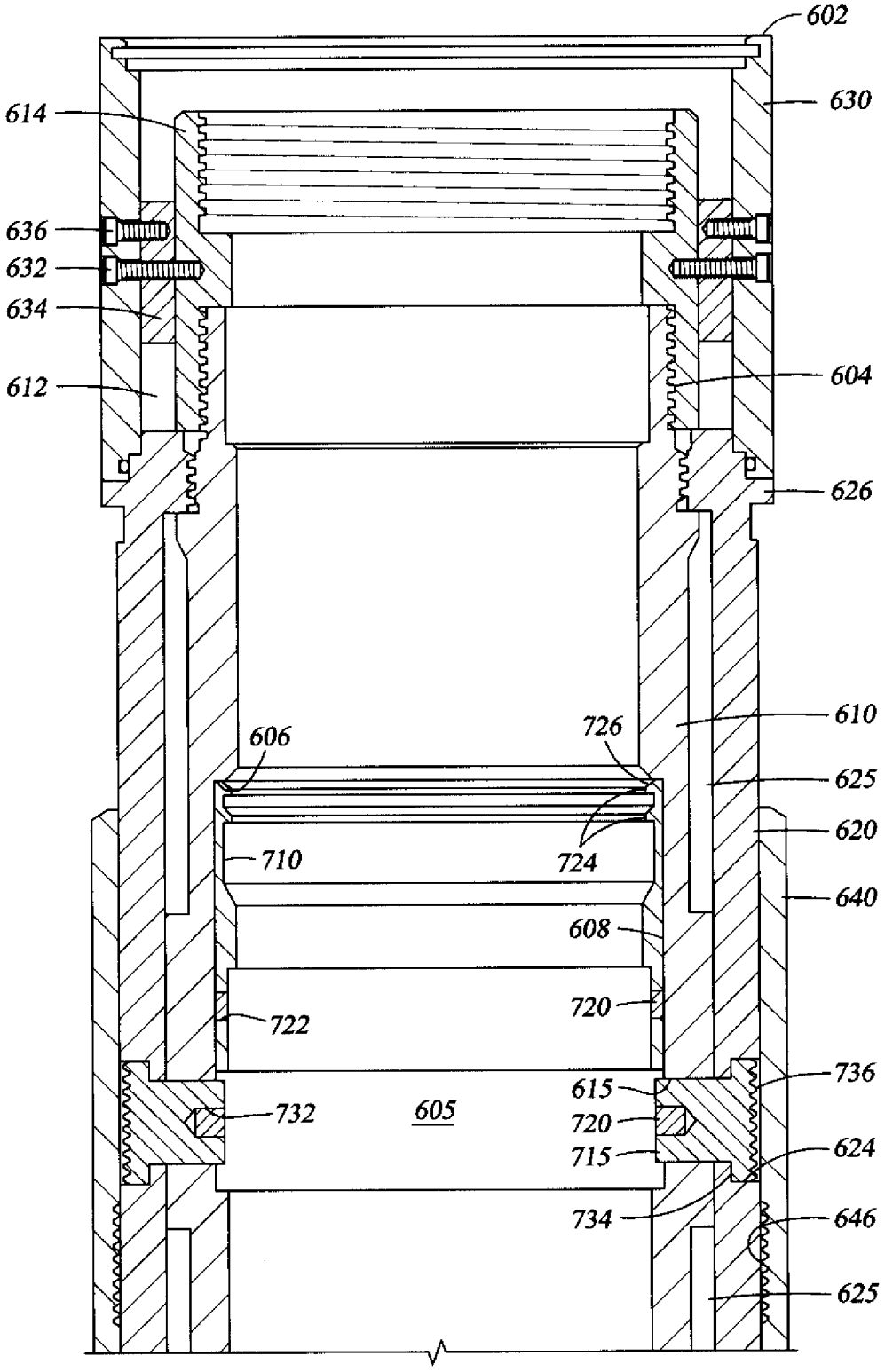
FIG. 7B is another enlarged view of the release key portion of FIG. 6A. Here, the shear pin has been sheared and the release key has dropped away from the inner mandrel.

FIGS. 7A and 7B provide enlarged views of the release sleeve 710 and the release key 715 for the packer 600. The release sleeve 710 and the release key 715 are held in place by a shear pin 720. In FIG. 7A, the shear pin 720 has not been sheared, and the release sleeve 710 and the release key 715 are held in place along the inner mandrel 610. However, in FIG. 7B the shear pin 720 has been sheared, and the release sleeve 710 has been translated along an inner surface 608 of the inner mandrel 610.

In each of FIGS. 7A and 7B, the inner mandrel 610 and the surrounding piston mandrel 620 are seen. In addition, the piston housing 640 is seen outside of the piston mandrel 620. The three tubular bodies representing the inner mandrel 610, the piston mandrel 620, and the piston housing 640 are secured together against relative translational or rotational movement by four release keys 715. Only one of the release keys 715 is seen in FIG. 7A; however, four separate keys 715 are radially visible in the cross-sectional view of FIG. 6E, described below.

The release key 715 resides within a keyhole 615. The keyhole 615 extends through the inner mandrel 610 and the piston mandrel 620. The release key 715 includes a shoulder 734. The shoulder 734 resides within a shoulder recess 624 in the piston mandrel 620. The shoulder recess 624 is large enough to permit the shoulder 734 to move radially inwardly. However, such play is restricted in FIG. 7A by the presence of the release sleeve 710.

It is noted that the annulus 625 between the inner mandrel 610 and the piston mandrel 620 is not seen in FIG. 7A or 7B. This is because the annulus 625 does not extend through this cross-section, or is very small. Instead, the annulus 625 employs separate radially-spaced channels that preserve the support for the release keys 715. Stated another way, the large channels making up the annulus 625 are located away from the material of the inner mandrel 610 that surrounds the keyholes 615.

At each release key location, a keyhole 615 is machined through the inner mandrel 610. The keyholes 615 are drilled to accommodate the respective release keys 715. If there are four release keys 715, there will be four discrete bumps spaced circumferentially to significantly reduce the annulus 625. The remaining area of the annulus 625 between adjacent bumps allows flow in the alternate flow channel 625 to by-pass the release key 715.

Bumps may be machined as part of the body of the inner mandrel 610. More specifically, material making up the inner mandrel 610 may be machined to form the bumps. Alternatively, bumps may be machined as a separate, short release mandrel (not shown), which is then threaded to the inner mandrel 610. Alternatively still, the bumps may be a separate spacer secured between the inner mandrel 610 and the piston mandrel 620 by welding or other means.

It is also noted here that in FIG. 6A, the piston mandrel 620 is shown as an integral body. However, the portion of the piston mandrel 620 where the keyholes 615 are located may be a separate, short release housing. This separate housing is then connected to the main piston mandrel 620.

Each release key 715 has an opening 732. Similarly, the release sleeve 710 has an opening 722. The opening 732 in the release key 715 and the opening 722 in the release sleeve 710 are sized and configured to receive a shear pin. The shear pin is seen at 720. In FIG. 7A, the shear pin 720 is held within the openings 732, 722 by the release sleeve 710. However, in FIG. 7B the shear pin 720 has been sheared, and only a small portion of the pin 720 remains visible.

An outer edge of the release key 715 has a niggled surface, or teeth. The teeth for the release key 715 are shown at 736. The teeth 736 of the release key 715 are angled and configured to mate with a reciprocal niggled surface within the piston housing 640. The mating niggled surface (or teeth) for the piston housing 640 are shown at 646. The teeth 646 reside on an inner face of the piston housing 640. When engaged, the teeth 736, 646 prevent movement of the piston housing 640 relative to the piston mandrel 620 or the inner mandrel 610. Preferably, the mating niggled surface or teeth 646 reside on the inner face of a separate, short outer release sleeve, which is then threaded to the piston housing 640.

Returning now to FIGS. 6A and 6B, the packer 600 includes a centralizing member 650. The centralizing member 650 is actuated by the movement of the piston housing 640. The centralizing member 650 may be, for example, as described in U.S. Patent Publication No. 2011/0042106.

The packer 600 further includes a sealing element 655. As the centralizing member 650 is actuated and centralizes the packer 600 within the surrounding wellbore, the piston housing 640 continues to actuate the sealing element 655 as described in U.S. Patent Publication No. 2009/0308592.

In FIG. 6A, the centralizing member 650 and sealing element 655 are in their run-in position. In FIG. 6B, the centralizing member 650 and connected sealing element 655 have been actuated. This means the piston housing 640 has moved along the piston mandrel 620, causing both the centralizing member 650 and the sealing element 655 to engage the surrounding wellbore wall.

As noted, movement of the piston housing 640 takes place in response to hydrostatic pressure from wellbore fluids, including the gravel slurry. In the run-in position of the packer 600 (shown in FIG. 6A), the piston housing 640 is held in place by the release sleeve 710 and associated piston key 715. This position is shown in FIG. 7A. In order to set the packer 600 (in accordance with FIG. 6B), the release sleeve 710 must be moved out of the way of the release key 715 so that the teeth 736 of the release key 715 are no longer engaged with the teeth 646 of the piston housing 640. This position is shown in FIG. 7B.

To move the release the release sleeve 710, a setting tool is used. An illustrative setting tool is shown at 750 in FIG. 7C. The setting tool 750 defines a short cylindrical body 755. Preferably, the setting tool 750 is run into the wellbore with a washpipe string (not shown). Movement of the washpipe string along the wellbore can be controlled at the surface.

An upper end 752 of the setting tool 750 is made up of several radial collet fingers 760. The collet fingers 760 collapse when subjected to sufficient inward force. In operation, the collet fingers 760 latch into a profile 724 formed along the release sleeve 710. The collet fingers 760 include raised surfaces 762 that mate with or latch into the profile 724 of the release key 710. Upon latching, the setting tool 750 is pulled or raised within the wellbore. The setting tool 750 then pulls the release sleeve 710 with sufficient force to cause the shear pins 720 to shear. Once the shear pins 720 are sheared, the release sleeve 710 is free to translate upward along the inner surface 608 of the inner mandrel 610.

Figure 7C:
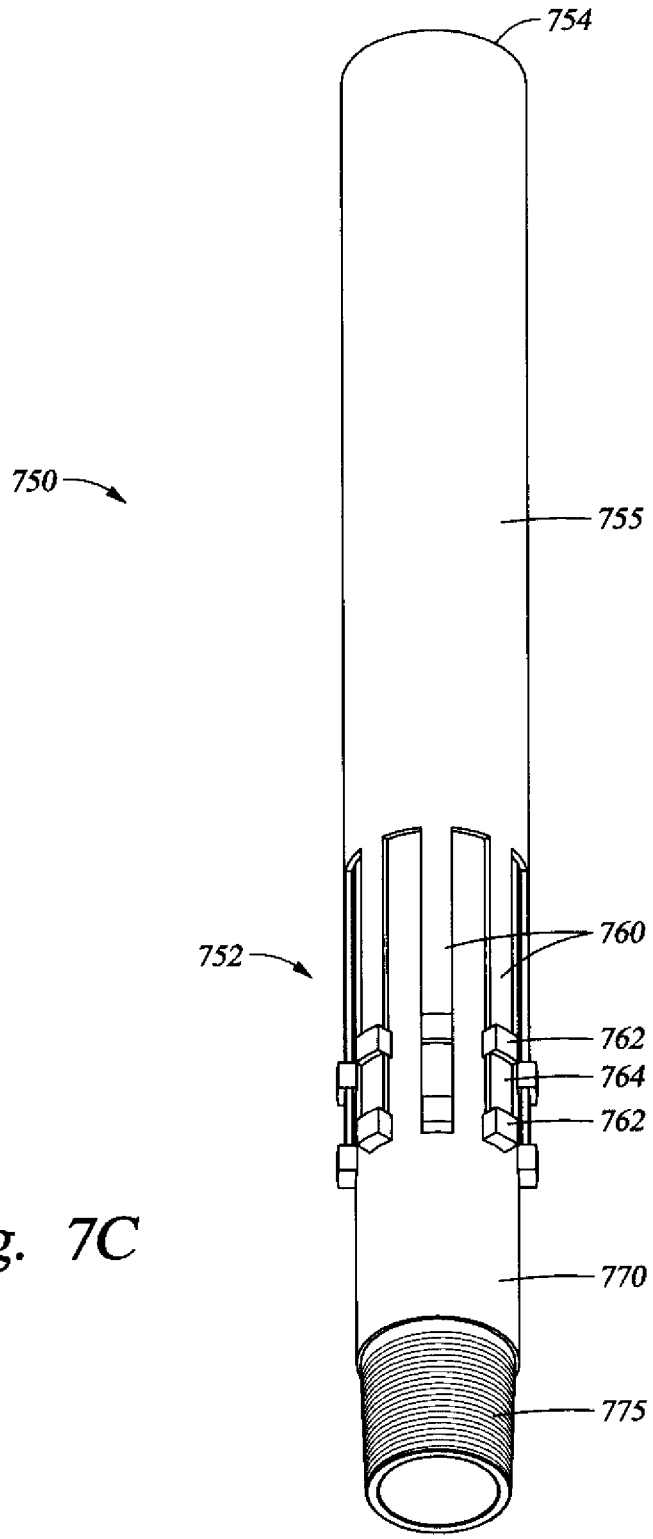
FIG. 7C is a perspective view of a setting tool as may be used to latch onto a release sleeve, and thereby shear a shear pin within the release key.

As noted, the setting tool 750 may be run into the wellbore with a washpipe. The setting tool 750 may simply be a profiled portion of the washpipe body. Preferably, however, the setting tool 750 is a separate tubular body 755 that is threadedly connected to the washpipe. In FIG. 7C, a connection tool is provided at 770. The connection tool 770 includes external threads 775 for connecting to a drill string or other run-in tubular. The connection tool 770 extends into the body 755 of the setting tool 750. The connection tool 770 may extend all the way through the body 755 to connect to the washpipe or other device, or it may connect to internal threads (not seen) within the body 755 of the setting tool 750.

Returning to FIGS. 7A and 7B, the travel of the release sleeve 710 is limited. In this respect, a first or top end 726 of the release sleeve 710 stops against the shoulder 606 along the inner surface 608 of the inner mandrel 610. The length of the release sleeve 710 is short enough to allow the release sleeve 710 to clear the opening 732 in the release key 715. When fully shifted, the release key 715 moves radially inward, pushed by the niggled profile in the piston housing 640 when hydrostatic pressure is present.

Shearing of the pin 720 and movement of the release sleeve 710 also allows the release key 715 to disengage from the piston housing 640. The shoulder recess 624 is dimensioned to allow the shoulder 734 of the release key 715 to drop or to disengage from the teeth 646 of the piston housing 640 once the release sleeve 710 is cleared. Hydrostatic pressure then acts upon the piston housing 640 to translate it downward relative to the piston mandrel 620.

After the shear pins 720 have been sheared, the piston housing 640 is free to slide along an outer surface of the piston mandrel 620. To accomplish this, hydrostatic pressure from the annulus 625 acts upon a shoulder 642 in the piston housing 640. This is seen best in FIG. 6B. The shoulder 642 serves as a pressure-bearing surface. A fluid port 628 is provided through the piston mandrel 620 to allow fluid to access the shoulder 642. Beneficially, the fluid port 628 allows a pressure higher than hydrostatic pressure to be applied during gravel packing operations. The pressure is applied to the piston housing 640 to ensure that the packer elements 655 engage against the surrounding wellbore.

The packer 600 also includes a metering device. As the piston housing 640 translates along the piston mandrel 620, a metering orifice 664 regulates the rate the piston housing translates along the piston mandrel therefore slowing the movement of the piston housing and regulating the setting speed for the packer 600.

To further understand features of the illustrative mechanically-set packer 600, reference is made to International Publication No. WO2012/082303. This co-pending application presents additional cross-sectional views, shown at FIGS. 6C, 6D, 6E, and 6F of this application. Descriptions of the cross-sectional views need not be repeated herein.

Figure 8A:
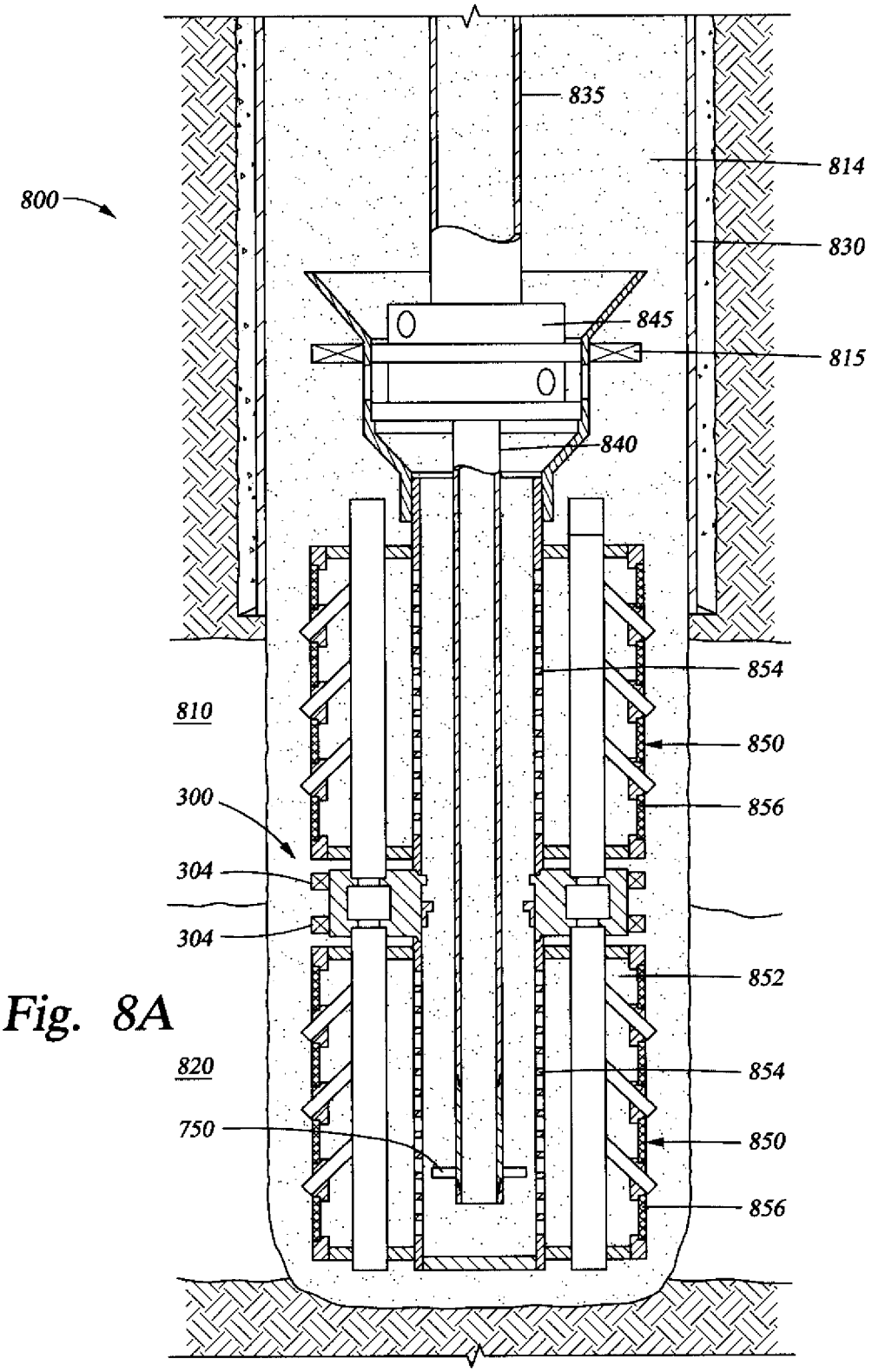
FIGS. 8A through 8J present stages of a gravel packing procedure using one of the packer assemblies of the present invention, in one embodiment. Alternate flowpath channels are provided through the packer elements of the packer assembly and through the sand control segments.

Once the fluid bypass packer 600 is set, gravel packing operations may commence. FIGS. 8A through 8N present stages of a gravel packing procedure, in one embodiment. The gravel packing procedure uses a packer assembly having alternate flow channels. The packer assembly may be in accordance with packer assembly 300 of FIG. 3A. The packer assembly 300 will have mechanically-set packers 304. These mechanically-set packers may be in accordance with packer 600 of FIGS. 6A and 6B.

In FIGS. 8A through 8J, sand control devices are utilized with an illustrative gravel packing procedure. In FIG. 8A, a wellbore 800 is shown. The wellbore 800 includes a wall. Two different production intervals are indicated along the horizontal wellbore 800, which may be either horizontal or vertical. These are shown at 810 and 820. Two sand control devices 850 have been run into the wellbore 800. Separate sand control devices 850 are provided in each production interval 810, 820.

Each of the sand control devices 850 is comprised of a base pipe 854 and a surrounding sand screen 856. The base pipes 854 have slots or perforations to allow fluid to flow into the base pipe 854. The sand control devices 850 also each include alternate flow paths. These may be in accordance with shunt tubes 218 from either FIG. 4B or FIG. 5B. Preferably, the shunt tubes are internal concentric shunt tubes disposed between the base pipes 854 and the sand screens 856 in the annular region shown at 852.

The sand control devices 850 are connected via an intermediate packer assembly 300. In the arrangement of FIG. 8A, the packer assembly 300 is installed at the interface between production intervals 810 and 820. More than one packer assembly 300 can be incorporated. The connection between the sand control devices 850 and a packer assembly 300 may be in accordance with U.S. Pat. No. 7,661,476, mentioned above.

In addition to the sand control devices 850, a washpipe 840 has been lowered into the wellbore 800. The washpipe 840 is run into the wellbore 800 below a crossover tool or a gravel pack service tool (not shown) which is attached to the end of a drill pipe 835 or other working string. The washpipe 840 is an elongated tubular member that extends into the sand screens 850. The washpipe 840 aids in the circulation of the gravel slurry during a gravel packing operation, and is subsequently removed. Attached to the washpipe 840 is a shifting tool, such as the shifting tool 750 presented in FIG. 7C. The shifting tool 750 is positioned below the packer 300.

In FIG. 8A, a crossover tool 845 is placed at the end of the drill pipe 835. The crossover tool 845 is used to direct the injection and circulation of the gravel slurry, as discussed in further detail below.

A separate packer 815 is connected to the crossover tool 845. The packer 815 and connected crossover tool 845 are temporarily positioned within a string of production casing 830. Together, the packer 815, the crossover tool 845, the elongated washpipe 840, the shifting tool 750, and the gravel pack screens 850 are run into the lower end of the wellbore 800. The packer 815 is then set in the production casing 830. The crossover tool 845 is then released from the packer 815 and is free to move as shown in FIG. 8B.

Figure 8B:
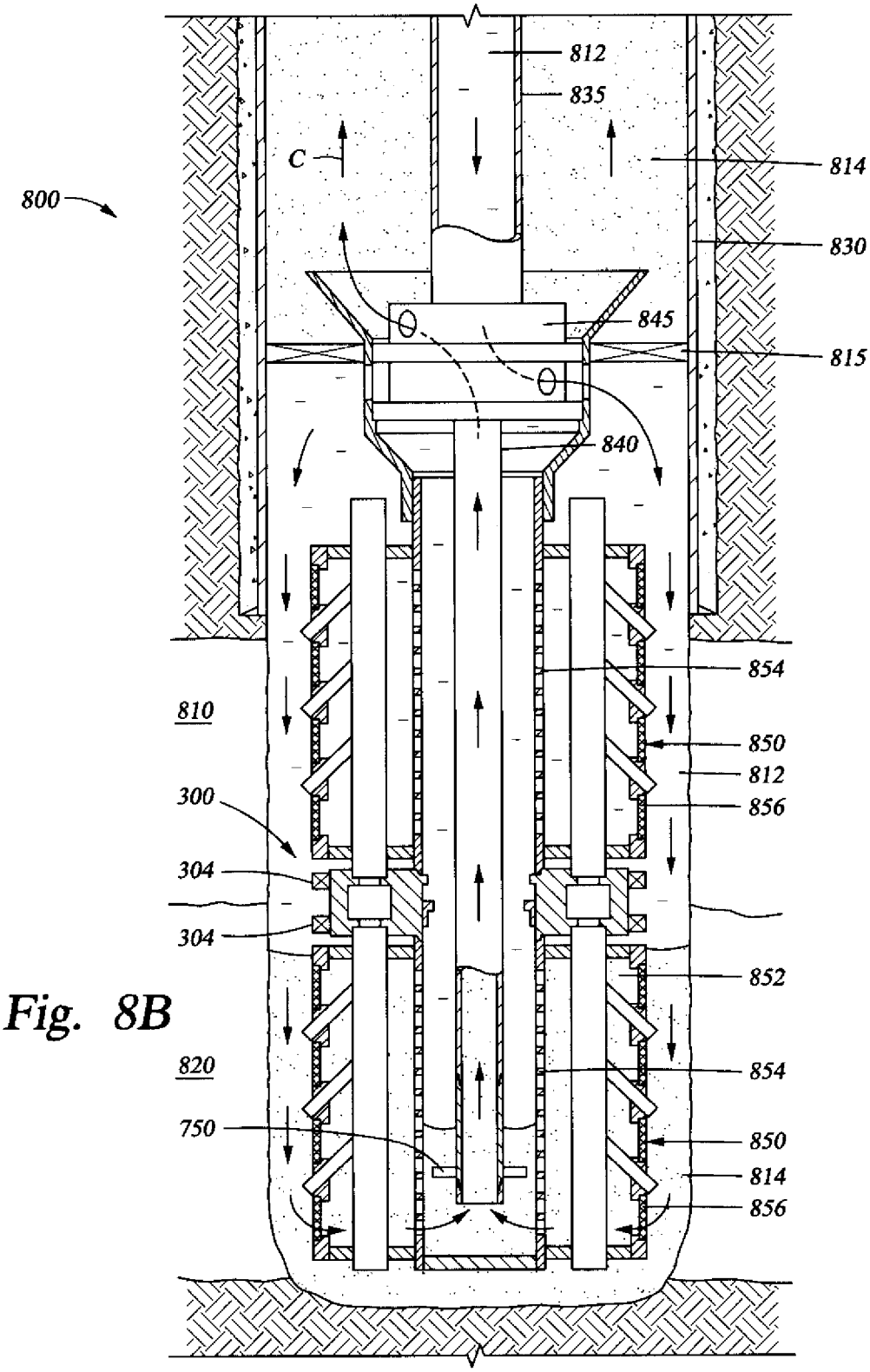

In FIG. 8B, the packer 815 is set in the production casing string 830. This means that the packer 815 is actuated to extend slips and an elastomeric sealing element against the surrounding casing string 830. The packer 815 is set above the intervals 810 and 820, which are to be gravel packed. The packer 815 seals the intervals 810 and 820 from the portions of the wellbore 800 above the packer 815.

After the packer 815 is placed along the casing, as shown in FIG. 8B, the crossover tool 845 is shifted up into a reverse position. Circulation pressures can be taken in this position. A carrier fluid 812 is pumped down the drill pipe 835 and placed into an annulus between the drill pipe 835 and the surrounding production casing 830 above the packer 815. The carrier fluid is a gravel carrier fluid, which is the liquid component of the gravel packing slurry. The carrier fluid 812 displaces the conditioned drilling fluid 814 above the packer 815, which again may be an oil-based fluid such as the conditioned NAF. The carrier fluid 812 displaces the drilling fluid 814 in the direction indicated by arrows "C."

Figure 8C:
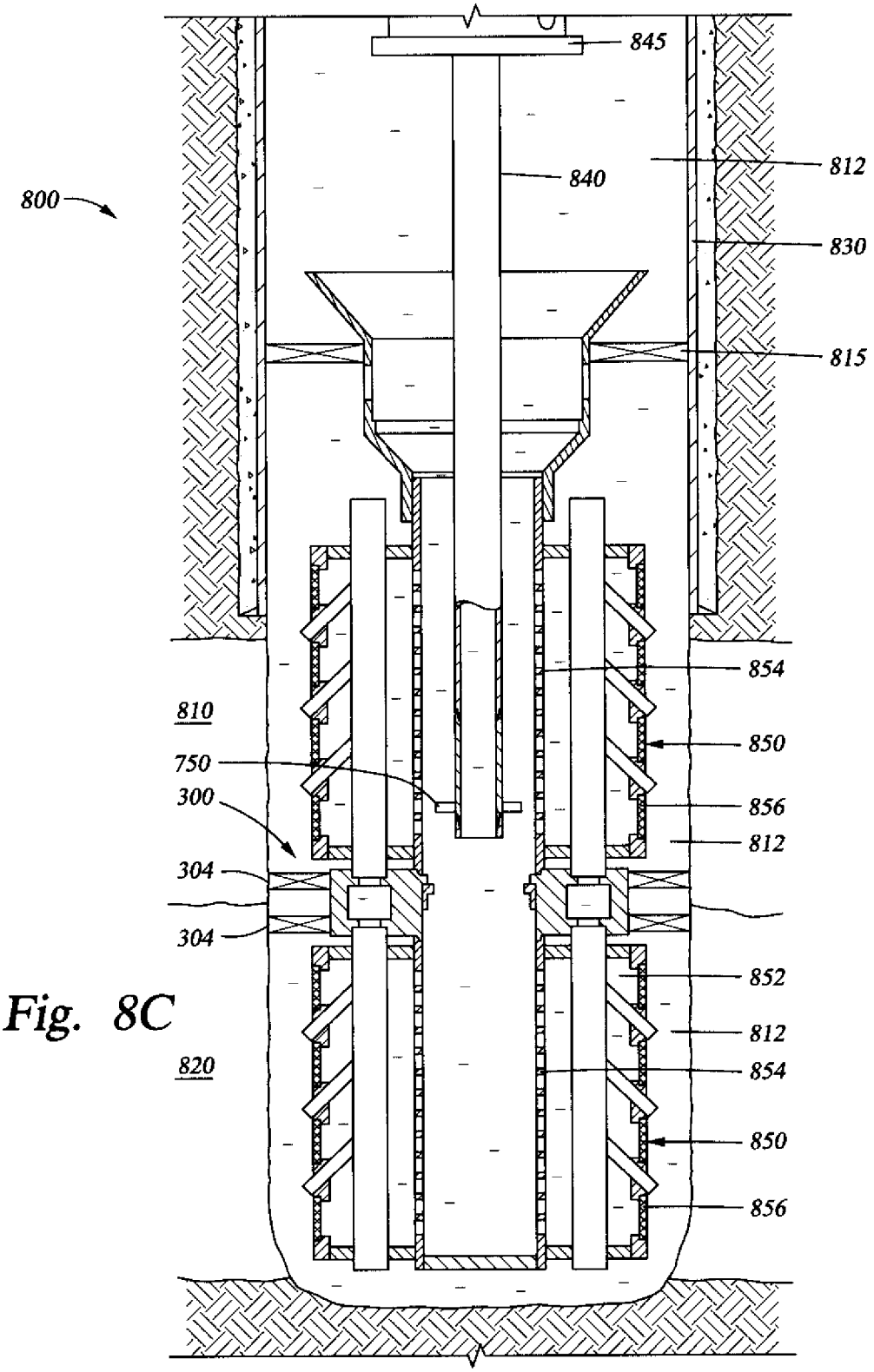

Next, the packers are set, as shown in FIG. 8C. This is done by pulling the shifting tool located below the packer assembly 300 on the washpipe 840 and up past the packer assembly 300. More specifically, the mechanically-set packers 304 of the packer assembly 300 are set. The packers 304 may be, for example, packer 600 of FIGS. 6A and 6B as described more fully in U.S. Prov. Pat. Appl. No. 61/424,427. As noted therein, the packers 600 each have a piston housing. The piston housing is held in place along a piston mandrel during run-in. The piston housing is secured using a release sleeve and a release key. The release sleeve and release key prevent relative translational movement between the piston housing and the piston mandrel.

During setting, as the piston housing travels along the inner mandrel, it also applies a force against the packing element. The centralizer and the expandable packing elements of the packers expand against the wellbore wall.

The packers 600 may be set using a setting tool that is run into the wellbore with a washpipe. The setting tool may simply be a profiled portion of the washpipe body for the gravel-packing operation. Preferably, however, the setting tool is a separate tubular body that is threadedly connected to the washpipe as shown in FIG. 7C.

The packer 600 is used to isolate the annulus formed between the sand screens 856 and the surrounding wall 805 of the wellbore 800. The washpipe 840 is lowered to a reverse position. While in the reverse position, as shown in FIG. 8D, the carrier fluid with gravel may be placed within the drill pipe 835 and utilized to force the clean displacement fluid 814 through the washpipe 840 and up the annulus formed between the drill pipe 835 and the production casing 830 above the packer, as shown by the arrows "C."

Figure 8D:
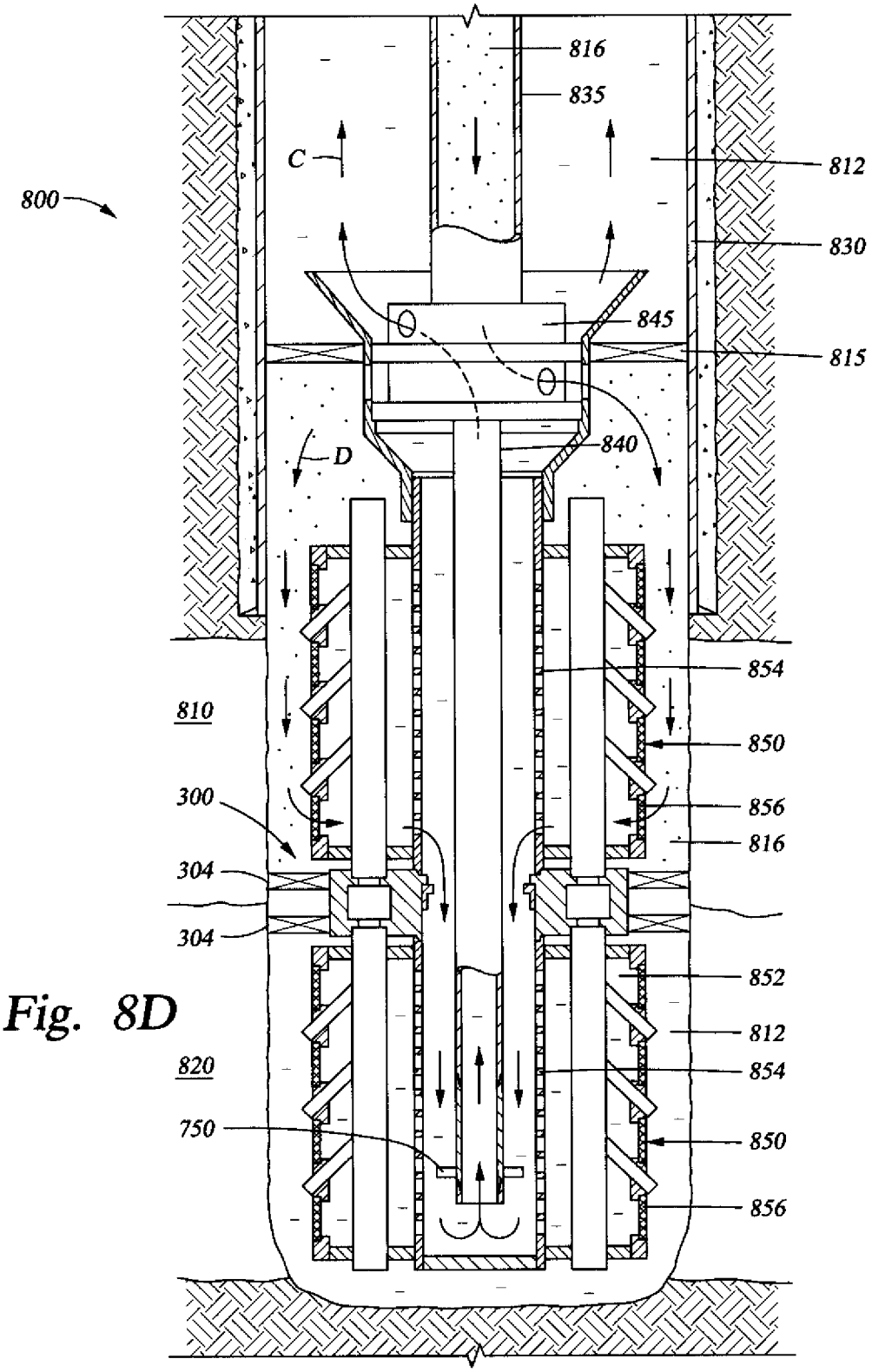
Figure 8E:
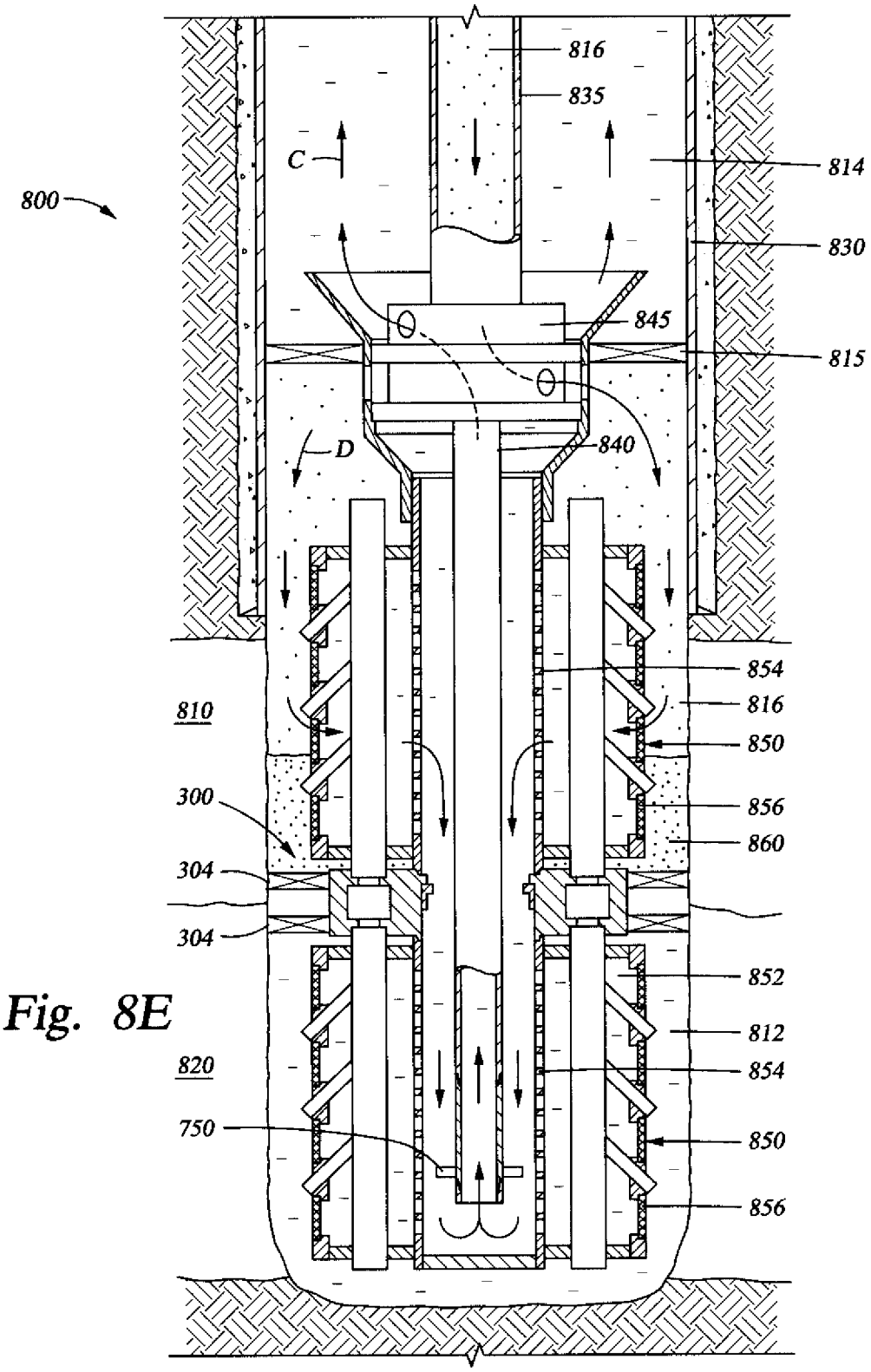
Figure 8F:
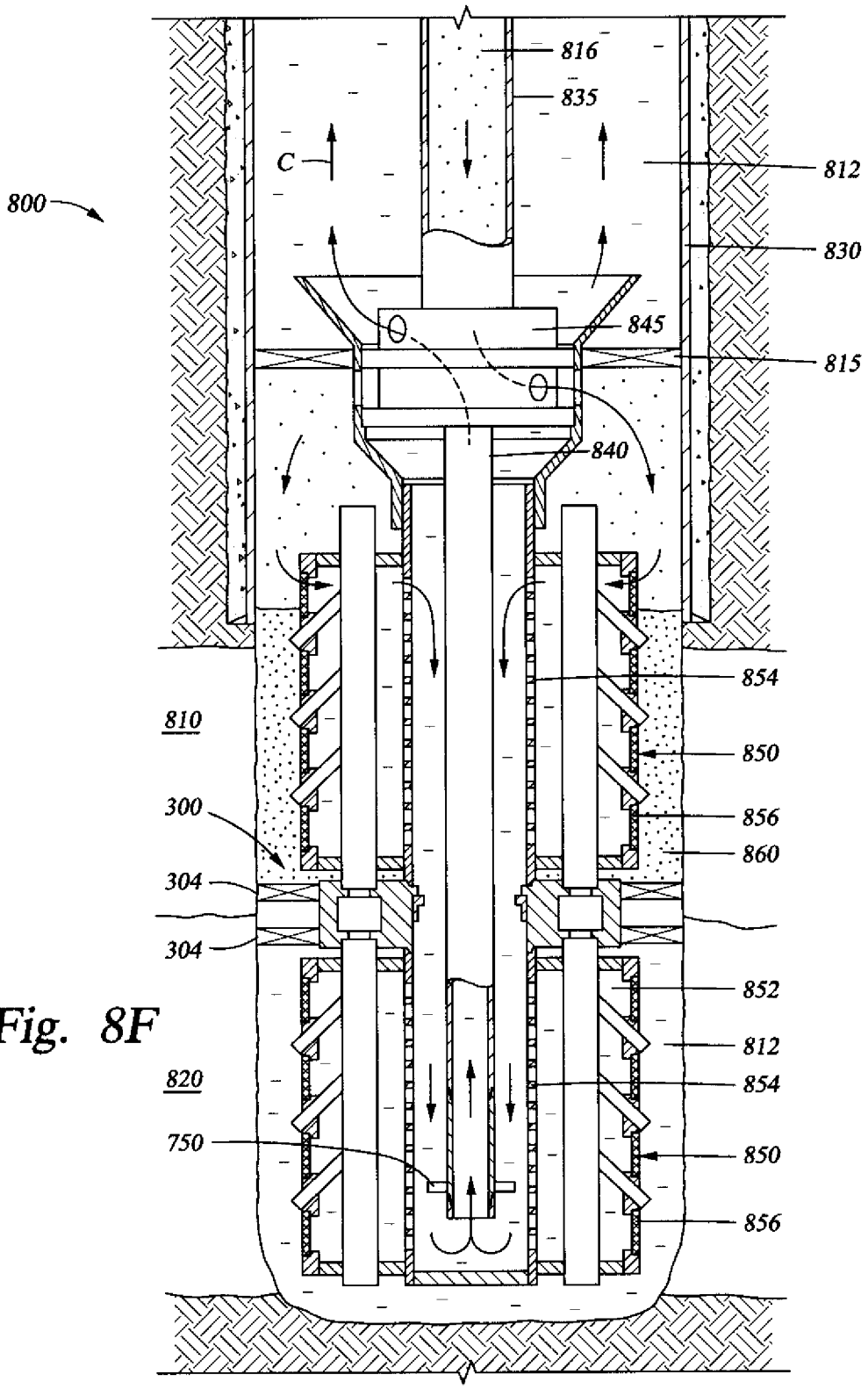

In FIGS. 8D through 8F, the crossover tool 845 may be shifted into the circulating position to gravel pack the first subsurface interval 810. In FIG. 8D, the carrier fluid with gravel 816 begins to create a gravel pack within the production interval 810 above the packer 300 in the annulus between the sand screen 856 and the wall 805 of the open-hole wellbore 800. The fluid flows outside the sand screen 856 and returns through the washpipe 840 as indicated by the arrows "D."

In FIG. 8E, a first gravel pack 860 begins to form above the packer 300. The gravel pack 860 is forming around the sand screen 856 and towards the packer 815. Carrier fluid 812 is circulated below the packer 300 and to the bottom of the wellbore 800. The carrier fluid 812 without gravel flows up the washpipe 840 as indicated by arrows "C."

In FIG. 8F, the gravel packing process continues to form the gravel pack 860 toward the packer 815. The sand screen 856 is now being fully covered by the gravel pack 860 above the packer 300. Carrier fluid 812 continues to be circulated below the packer 300 and to the bottom of the wellbore 800. The carrier fluid 812 sans gravel flows up the washpipe 840 as again indicated by arrows "C."

Once the gravel pack 860 is formed in the first interval 810 and the sand screens above the packer 300 are covered with gravel, the carrier fluid with gravel 816 is forced through the transport tubes (shown at 318 in FIG. 3B). The carrier fluid with gravel 816 forms the gravel pack 860 in FIGS. 8G through 8J.

Figure 8G:
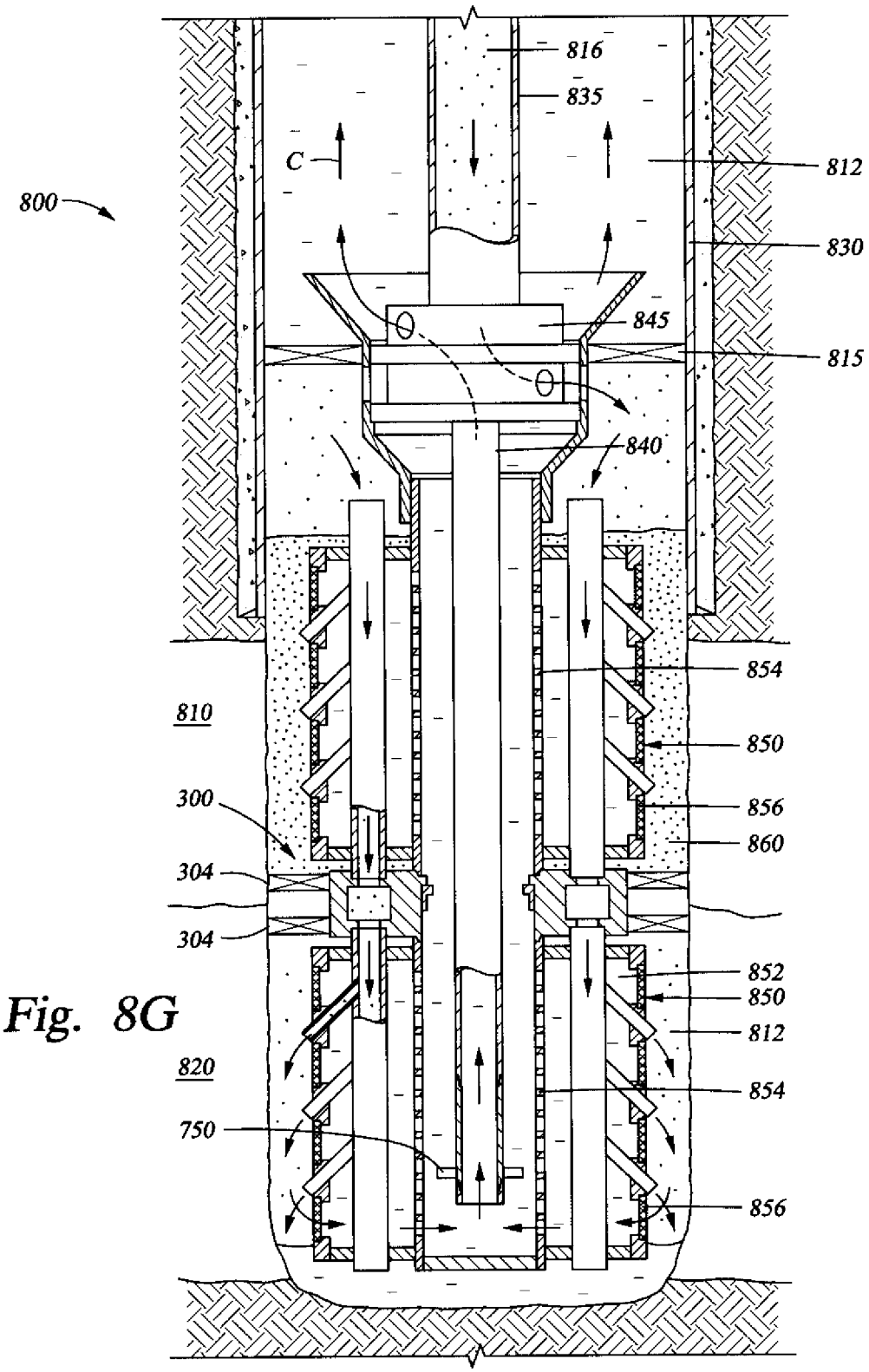

In FIG. 8G, the carrier fluid with gravel 816 now flows within the production interval 820 below the packer 300. The carrier fluid 816 flows through the shunt tubes and packer 300, and then outside the sand screen 856. The carrier fluid 816 then flows in the annulus between the sand screen 856 and the wall 805 of the wellbore 800, and returns through the washpipe 840. The flow of carrier fluid with gravel 816 is indicated by arrows "D," while the flow of carrier fluid in the washpipe 840 without the gravel is indicated at 812, shown by arrows "C."

It is noted here that slurry only flows through the bypass channels along the packer sections. After that, slurry will go into the alternate flow channels in the next, adjacent screen joint. Alternate flow channels have both transport and packing tubes manifolded together at each end of a screen joint. Packing tubes are provided along the sand screen joints. The packing tubes represent side nozzles that allow slurry to fill any voids in the annulus. Transport tubes will take the slurry further downstream.

Figure 8H:
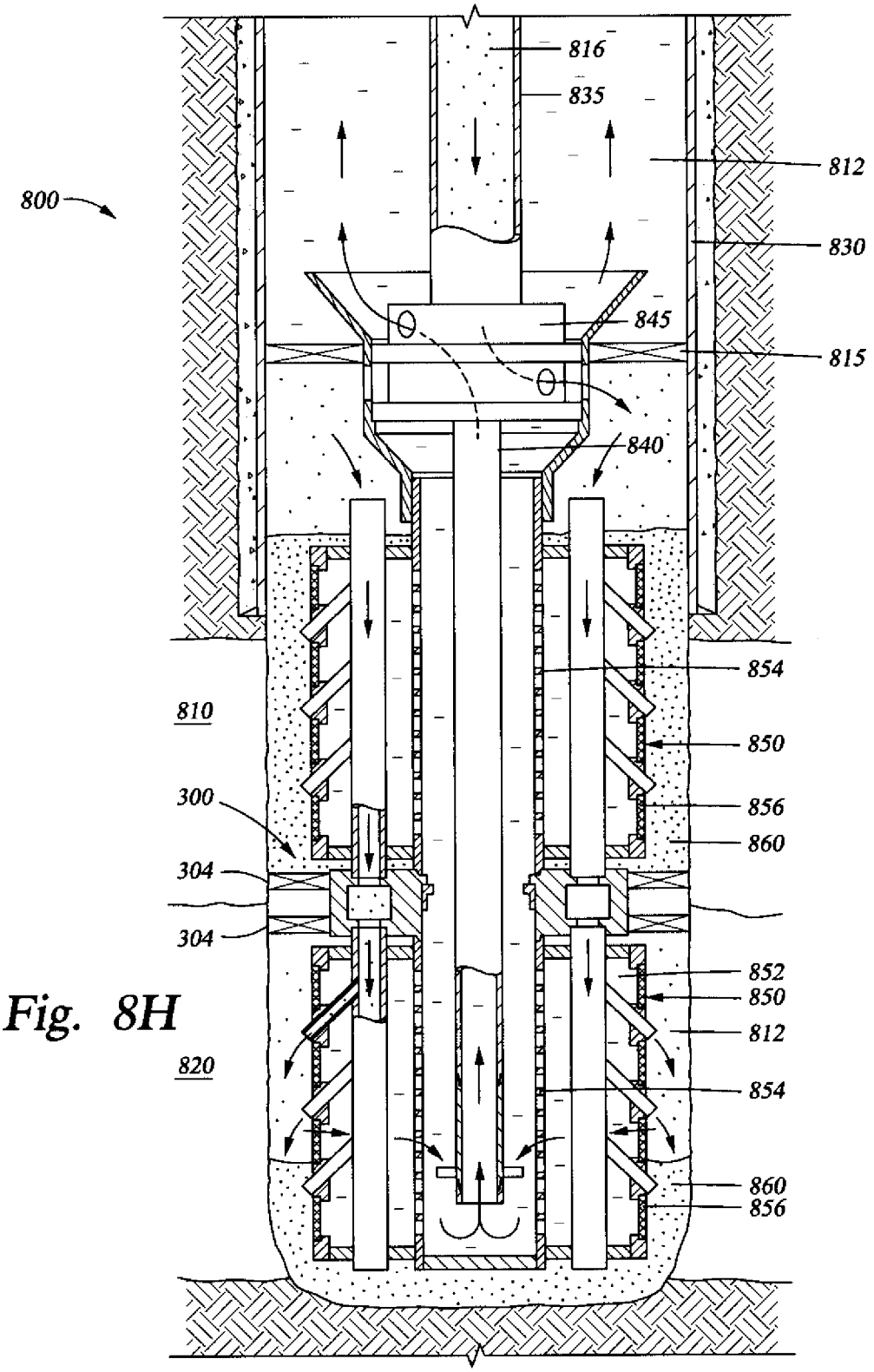
Figure 8I:
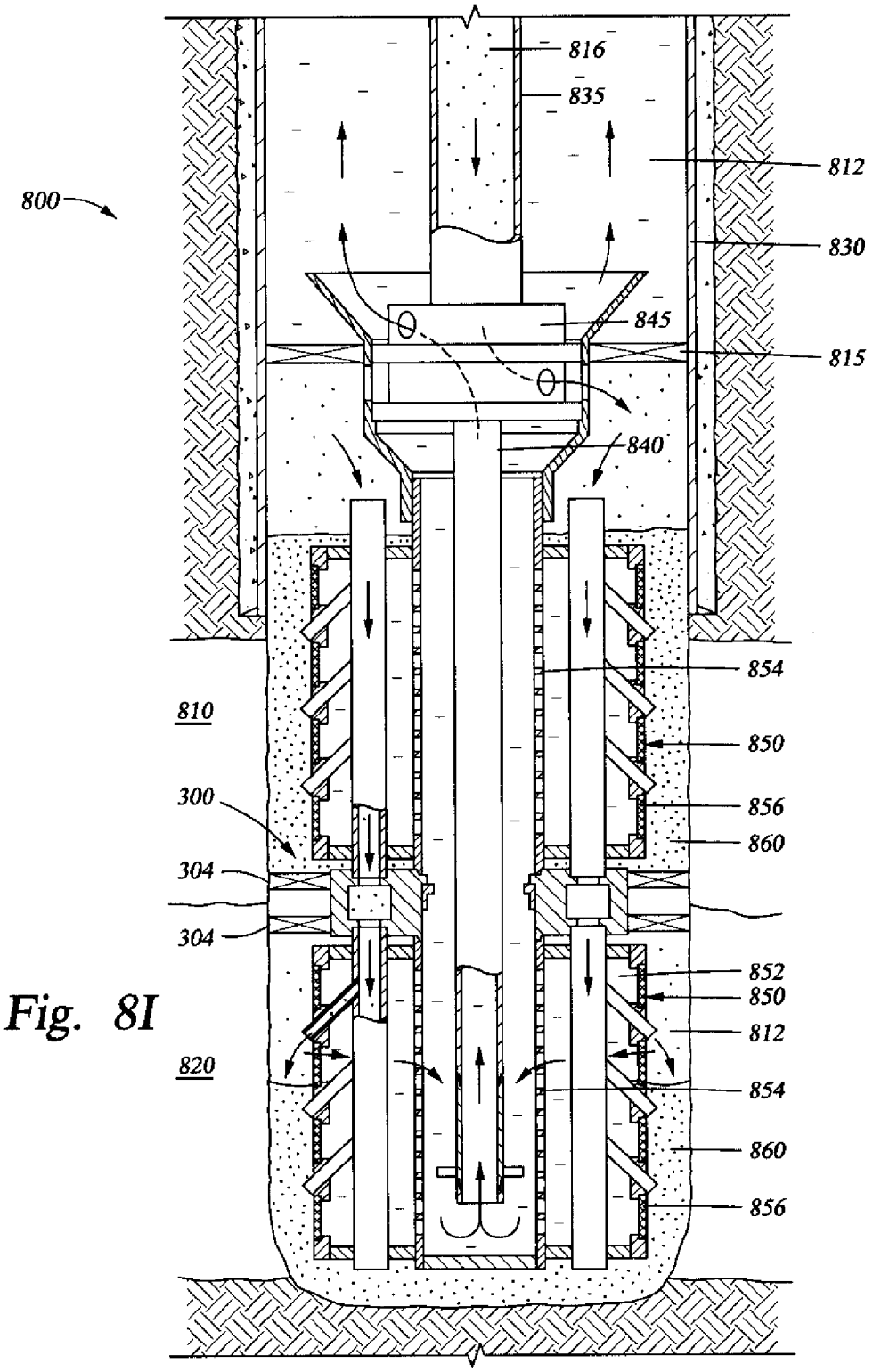
Figure 8J:
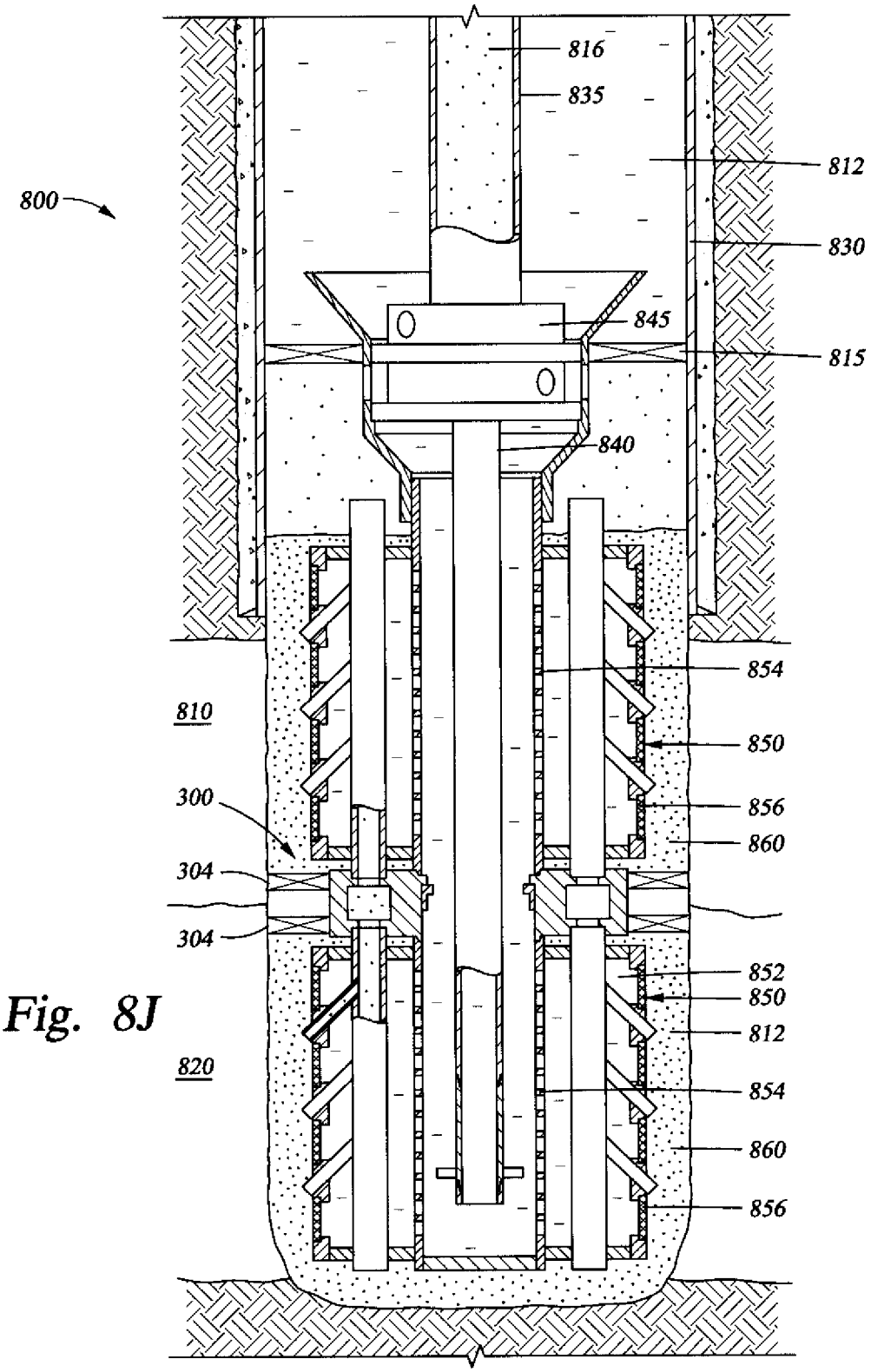

In FIG. 8H, the gravel pack 860 is beginning to form below the packer 300 and around the sand screen 856. In FIG. 8I, the gravel packing continues to grow the gravel pack 860 from the bottom of the wellbore 800 up toward the packer 300. In FIG. 8J, the gravel pack 860 has been formed from the bottom of the wellbore 800 up to the packer 300. The sand screen 856 below the packer 300 has been covered by gravel pack 860. The surface treating pressure increases to indicate that the annular space between the sand screens 856 and the wall 805 of the wellbore 800 is fully gravel packed.

Figure 8K:
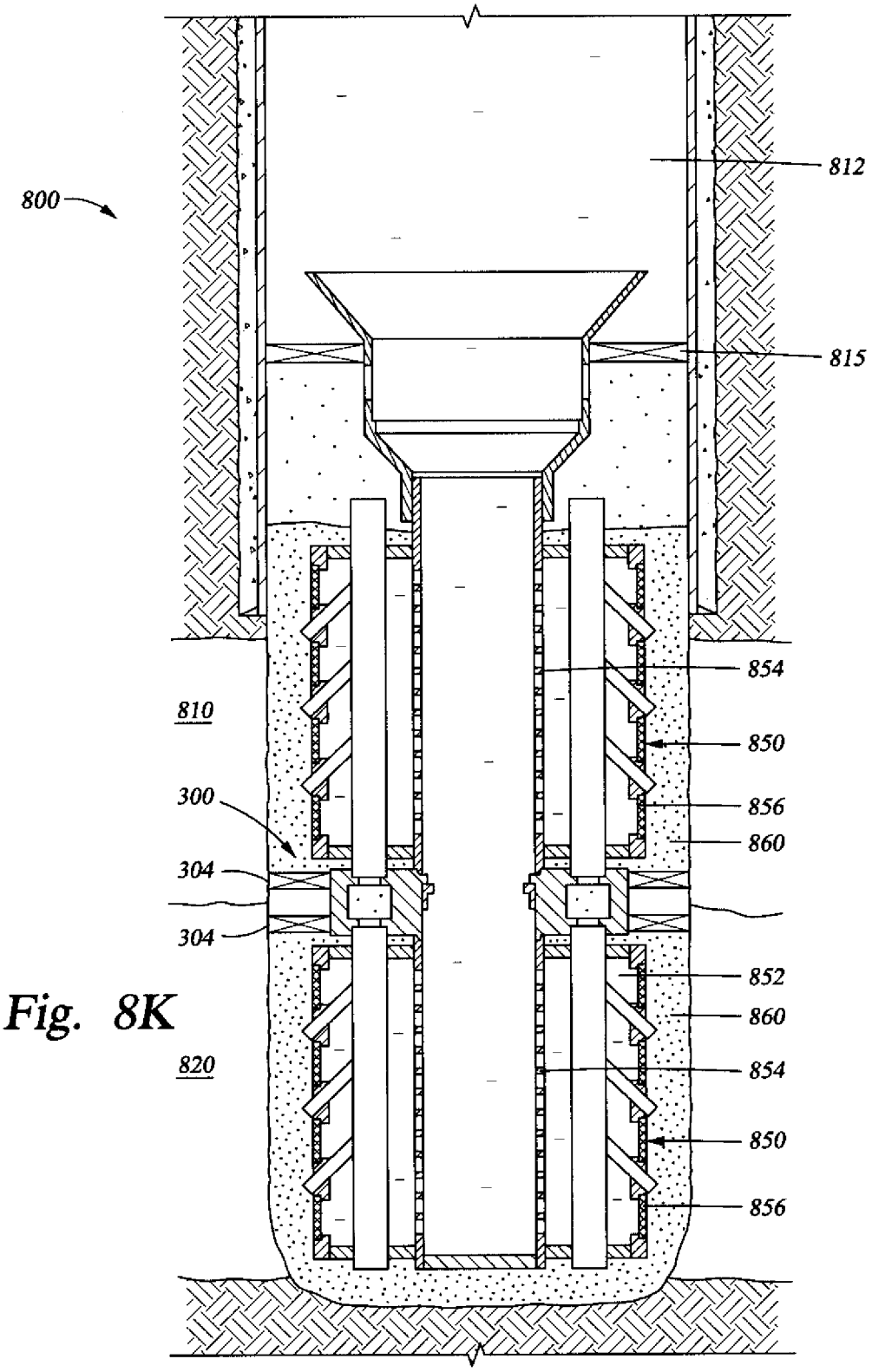
FIG. 8K shows the packer assembly and gravel pack having been set in an open-hole wellbore following completion of the gravel packing procedure from FIGS. 8A through 8J.

FIG. 8K shows the drill string 835 and the washpipe 840 from FIGS. 8A through 8N having been removed from the wellbore 800. The casing 830, the base pipes 854, and the sand screens 856 remain in the wellbore 800 along the upper 810 and lower 820 production intervals. Packer 300 and the gravel packs 860 remain set in the open hole wellbore 800 following completion of the gravel packing procedure from FIGS. 8A through 8J. The wellbore 800 is now ready for production operations.

Moving back to FIG. 9A, FIG. 9A again shows an elongated sand screen assembly 900 that may be placed in an open-hole wellbore 100 for restricting the inflow of sand and fines during production operations. The assembly 900 includes a base pipe 902 that preferably extends the axial length of the sand screen assembly 900. The base pipe 902 is operably attached to the torque sleeve 1100 at the downstream or second end of the base pipe 902. The sand screen assembly 900 further includes at least one nozzle ring 910*a*, 910*b*, . . . 910*e* positioned along its length. Sand control devices, or sand screen segments 914*a*, 914*b*, . . . 914*f*are positioned between the nozzle rings 910*a*, 910*b*, . . . 910*f*. Optionally, at least one centralizer 916*a*, 916*b* is placed around selected sand screen segments.

As shown in FIG. 9B, transport tubes 914*a*, 914*b*, . . . 914*e* and packing tubes 908*g*, 908*h*, 908*i* are employed along the sand control devices 914*a*, 914*b*, . . . 914*f*. In the view of FIG. 9B, nine separate tubes are shown; however, a greater or lesser number of tubes may be employed, depth. The transport tubes 908*a*, 908*b*, . . . 908*f* and packing tubes 908*g*, 908*h*, 908*i* are continuous for the entire length of the sand screen assembly 900. The transport tubes 908*a*, 908*b*, . . . 908*f* and packing tubes 908*g*, 908*h*, and 908*i* are preferably constructed from steel, such as a lower yield, weldable steel.

The packing tubes 908*g*, 908*h*, 908*i* include nozzle openings at regular intervals, for example, every approximately six feet, to facilitate the passage of gravel slurry from the packing tubes 908*g*, 908*h*, 908*i* to the wellbore annulus.

The preferred embodiment of the sand screen assembly 900 further includes a plurality of axial rods 912. The axial rods can be any integer, extending parallel to the tubes 908*a*, 908*b*, . . . 908*i*. The axial rods 912 provide additional structural integrity to the sand screen assembly 900 and at least partially support the sand screen segments 914*a*, 914*b*, . . . 914*f*. In one aspect, three axial rods 912 are disposed between each pair of tubes 908*a*, 908*b*, . . . 908*i*.

Additional details concerning the sand screen assembly 900 are provided in U.S. Pat. No. 7,938,184. Specifically, FIGS. 3A, 3B, 3C, 4A, 4B, 5A, 5B, 6 and 7 present details concerning components of the sand screen assembly 900. These figures and accompanying text are incorporated herein by reference.

As noted above, the sand screen assembly 900 also includes a load sleeve 1000 and a torque sleeve 1100. The load sleeve 1000 is operably attached at or near the first end, while the torque sleeve 1100 is operably attached at or near the second end. The load sleeve 1000 and the torque sleeve 1100 may be operably attached to the base pipe 902 utilizing any mechanism that effectively transfers forces from the sleeves 1000, 1100 to the base pipe 902, such as by welding, clamping, latching, or other techniques known in the art. One preferred mechanism for securing the sleeves 1000, 1100 to the base pipe 902 is a threaded connector, such as a torque bolt, driven through the sleeves 1000, 1100 into the base pipe 902. The sleeves 1000, 1100 are preferably manufactured from a material having sufficient strength to withstand the contact forces achieved during screen running operations. One preferred material is a high yield alloy material such as S165M.

The load sleeve 1000 and the torque sleeve 1100 enable immediate connections with packer assemblies or other elongated downhole tools while aligning shunt tubes.

Figure 10A:
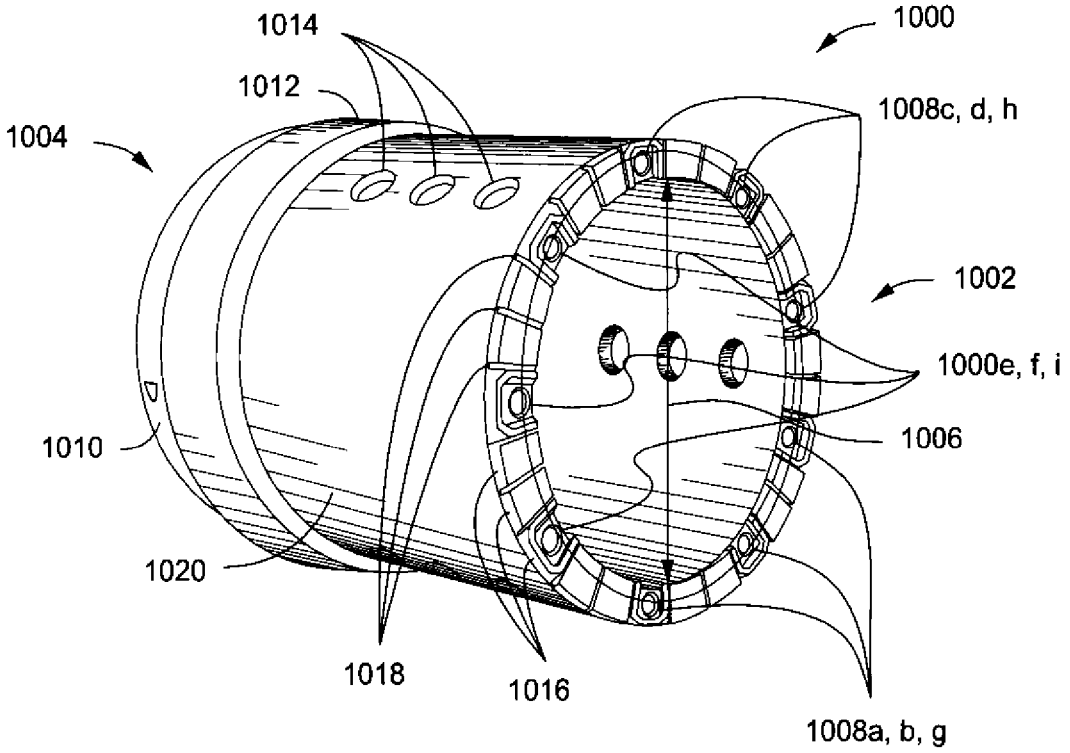
FIG. 10A is an isometric view of a load sleeve as utilized as part of the sand screen assembly of FIG. 9A, in one embodiment.
Figure 10B:
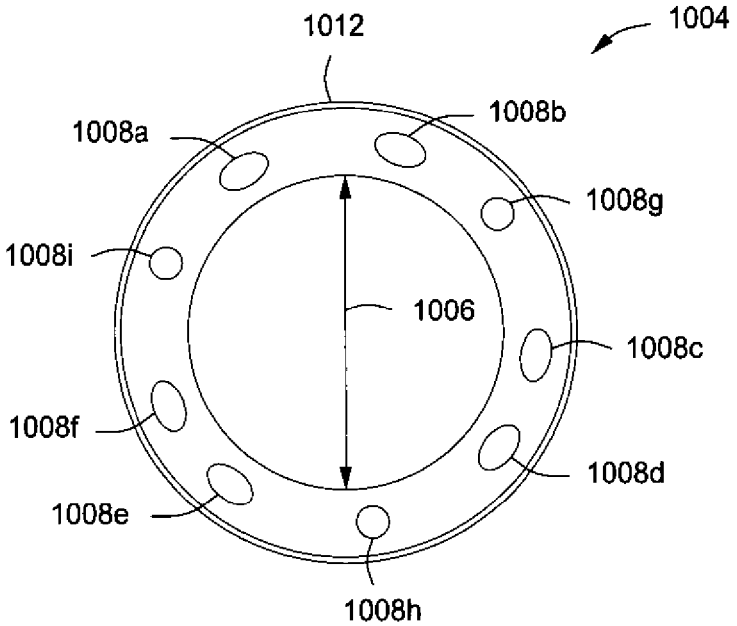
FIG. 10B is an end view of the load sleeve of FIG. 10A.

Referring to FIGS. 10A and 10B, FIG. 10A is an isometric view of a load sleeve 1000 as utilized as part of the sand screen assembly of FIG. 9A, in one embodiment. FIG. 10B is an end view of the load sleeve of FIG. 10A.

The load sleeve 1000 comprises an elongated body 1020 of substantially cylindrical shape having an outer diameter and a bore extending from a first end 1004 to a second end 1002. The load sleeve 1000 may also include at least one transport conduit 1008*a*, 1008*b*, . . . 1008*f* and at least one packing conduit 1008*g*, 1008*h*, 1008*i*, (although six transport conduits and three packing conduits are shown, the invention may include more or less such conduits) extending from the first end 1004 to the second end 1002 to form openings located at least substantially between the inner diameter 1006 and the outer diameter.

In some embodiments of the present techniques, the load sleeve 1000 includes beveled edges 1016 at the downstream end 1002 for easier welding of the shunt tubes 1008*a*, 1008*b*, . . . 1008*i* thereto. The preferred embodiment also incorporates a plurality of radial slots or grooves 1018 in the face of the downstream or second end 1002 to accept a plurality of axial rods.

Preferably, the load sleeve 1000 includes radial holes 1014*a*-1014*n* between its downstream end 1002 and the load shoulder 1012 to receive the threaded connectors 1006. For example, there may be nine holes 1014 in three groups of three spaced substantially equally around the outer circumference of the load sleeve 1000 to provide the most even distribution of weight transfer from the load sleeve 1000 to the base pipe 902.

Figure 11:
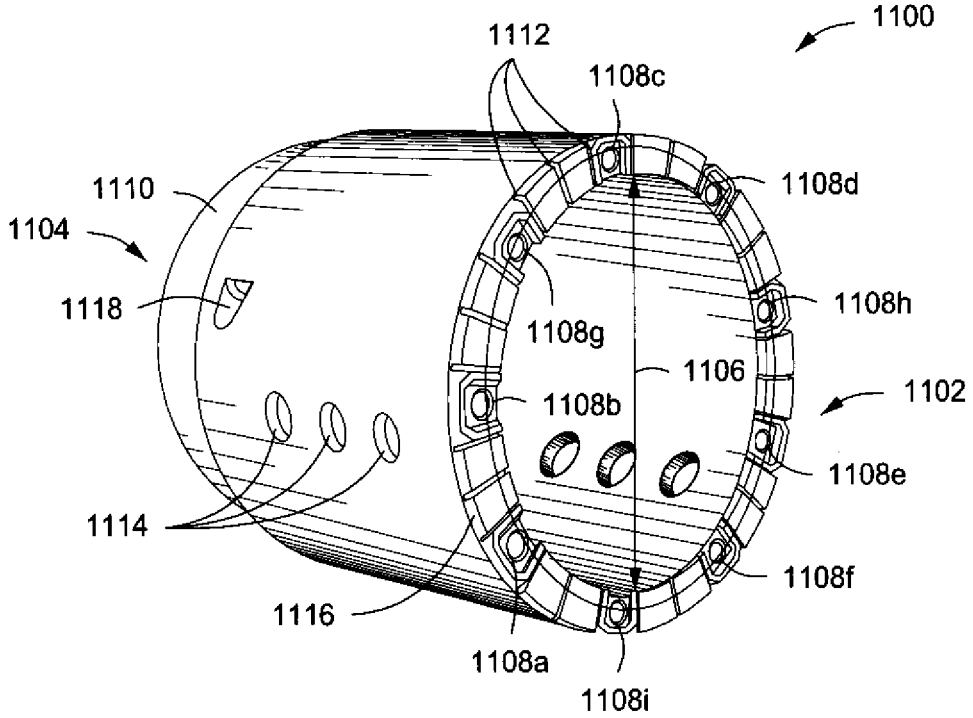
FIG. 11 is a perspective view of a torque sleeve as utilized as part of the sand screen assembly of FIG. 9A, in one embodiment.

Referring to FIG. 11, FIG. 11 is a perspective view of a torque sleeve 1100 utilized as part of the sand screen assembly 900 of FIG. 9A, in one embodiment. The torque sleeve 1100 is positioned at the downstream or second end of the sand screen assembly 900.

The torque sleeve 1100 includes an upstream or first end 1102, a downstream or second end 1104, an inner diameter 1106, and various alternate path channels, or conduits 1108*a*-1108*i*. The channels represent transport conduits 1108*a*-1108*f* that extend from the first end 1102 to the second end 1104, and packing conduits 1108*g*-1108*i* that terminate before reaching the second end 1104 and release slurry through nozzles 1118.

Preferably, the torque sleeve 1100 includes radial holes 1114 between the upstream end 1102 and a lip portion 1110 to accept threaded fasteners therein. For example, there may be nine holes 1114 in three groups of three, spaced equally around the outer circumference of the torque sleeve 1100.

In the embodiment of FIG. 11, the torque sleeve 1100 has beveled edges 1116 at the upstream end 1102 for easier attachment of the shunt tubes 1108 thereto. The preferred embodiment may also incorporate a plurality of radial slots or grooves 1112 in the face of the upstream end 1102 to accept a plurality of axial rods 912. For example, the torque sleeve 1100 may have three axial rods 912 between each pair of shunt tubes 1108 for a total of 27 axial rods attached to each torque sleeve 1100.

Figure 12:
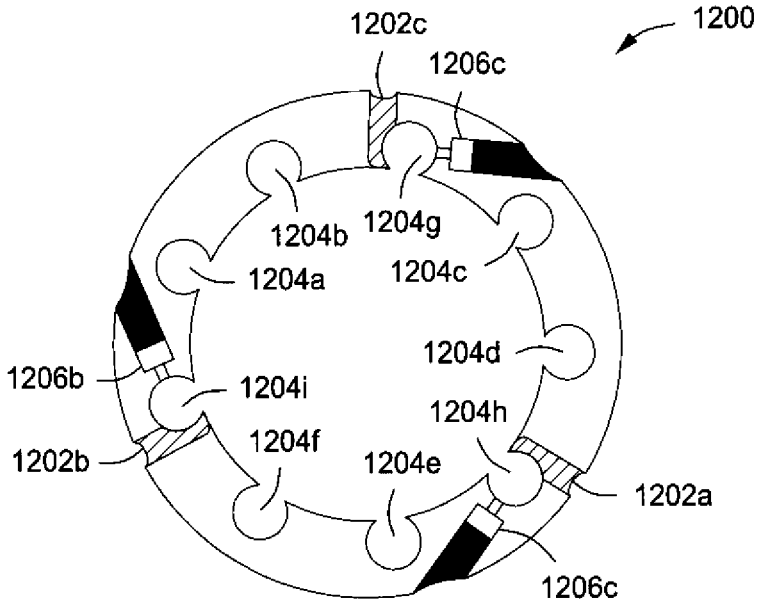
FIG. 12 is an end view of a nozzle ring utilized along the sand screen assembly of FIG. 9A.

FIG. 12 is an end view of a nozzle ring 1200 utilized as part of the sand screen assembly 900 of FIG. 9A. The nozzle ring 1200 is adapted and configured to fit around the base pipe 902, the transport tubes 914*a*, 914*b*, . . . 914*e* and the packing tubes 908*g*, 908*h*, 908*i*. The nozzle ring 1200 is shown in the side view of FIG. 9A as nozzle rings 910*a*, 910*b*, . . . 910*n*. Nozzle rings are preferably part of screen assembly during manufacturing so that no make-up of the nozzle rings in the field is required. Each nozzle ring 1200 is held in place by wire-wrap welds at the grooves similar to item 1112 in FIG. 11. Split rings (not shown) may be installed at the interface between each nozzle ring 1200 and the wire-wrap.

The nozzle ring 1200 includes a plurality of channels 1204*a*, 1204*b*, . . . 1204*i* to accept the transport tubes 914*a*, 914*b*, . . . 914*e* and the packing tubes 908*g*, 908*h*, 908*i*. Each channel 1204*a*, 1204*b*, . . . 1204*i* extends through the nozzle ring 1200 from an upstream or first end to a downstream or second end. For each packing tube 908*g*, 908*h*, 908*i*, the nozzle ring 1200 includes an opening or hole 1202*a*, 1202*b*, 1202*c*. Each hole 1202*a*, 1202*b*, 1202*c* extends from an outer surface of the nozzle ring 1200 toward a central point in the radial direction. Each hole 1202*a*, 1202*b*, 1202*c* interferes with or intersects, at least partially, the at least one channel 1204*g*, 1204*h*, 1204*i* to keep the packing tubing there through in place by an insert (not shown). For each channel 1204*g*, 1204*h*, 1204*i* having an interfering hole 1202*a*, 1202*b*, 1202*c*, there is also an outlet 1206*a*, 1206*b*, 1206*c* extending from the channel wall through the nozzle ring 1200. The outlet 1206*a*, 1206*b*, 1206*c* has a central axis oriented perpendicular to the central axis of the hole 1202*a*, 1202*b*, 1202*c*. Each packing tube 908*g*, 908*h*, 908*i* inserted through a channel having a hole 1202*a*, 1202*b*, 1202*c* includes a perforation in fluid flow communication with an outlet 1206*a*, 1206*b*, 1206*c*.

Additional details concerning the load sleeve 1000, the torque sleeve 1100 and the nozzle ring 1200 are provided in U.S. Pat. No. 7,938,184.

Returning to FIG. 9A, in the illustration of FIG. 9A, the sand screen assembly 900 and its components are shown in a horizontal orientation. In the horizontal orientation, gravel material may be packed around sand screen segments for a successful gravel packing. However, a problem of settling of gravel material can sometimes take place, particularly in vertical or generally deviated wellbores. This causes inconsistent packing of gravel, with upper portions of a sand screen segment being directly exposed to the surrounding formation.

Figure 13C:
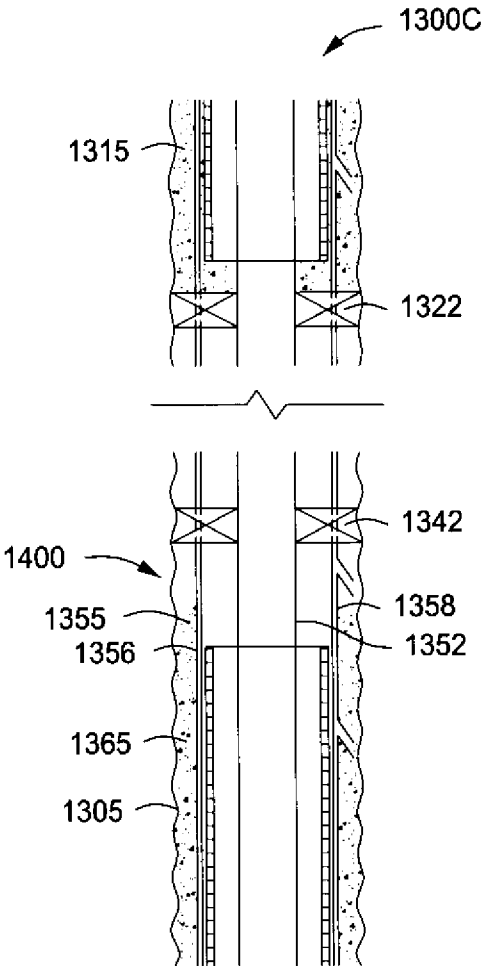
FIG. 13C is another side view of the wellbore of FIG. 13A. Here, a joint assembly of the present invention has been placed above the lower sand screen. The joint assembly allows a reserve of gravel to be placed above the lower sand screen in anticipation of future settling.
Figure 13B:
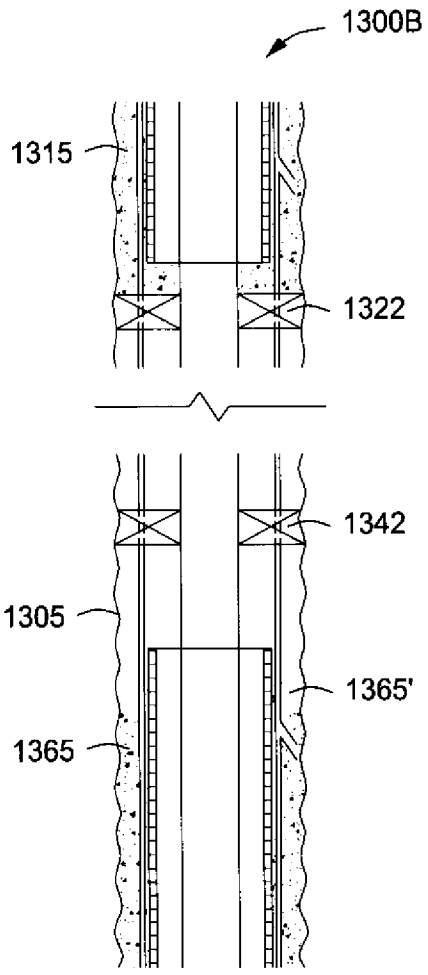
FIG. 13B is another side view of the wellbore of FIG. 13A. Here, the gravel in the gravel pack surrounding the lower sand screen has settled, leaving a portion of the sand screen immediately exposed to the surrounding formation.
Figure 13A:
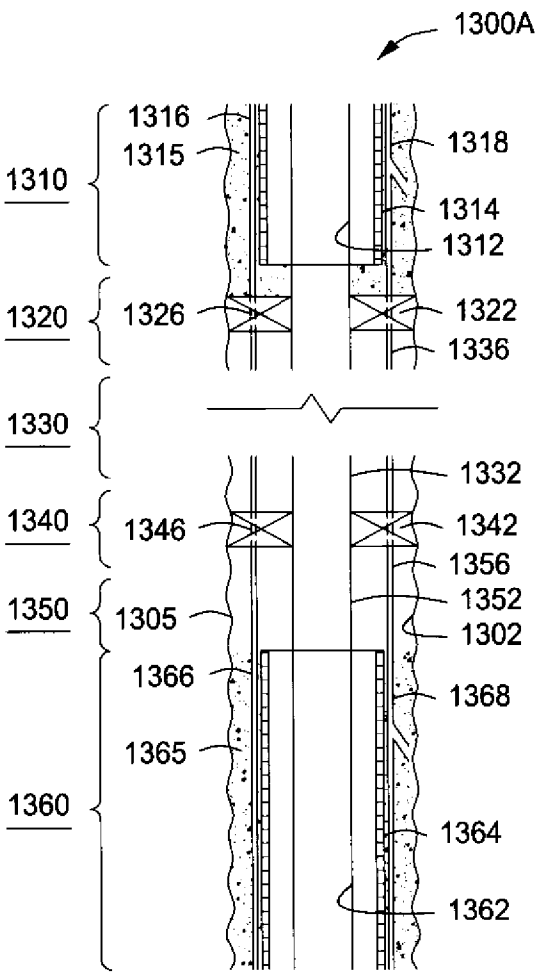
FIG. 13A is a side view of a wellbore having undergone a gravel packing operation. In this view, a gravel pack has been placed around sand screens above and below a packer assembly.

FIG. 13A is a side view of a wellbore 1300A having undergone a gravel packing operation with zonal isolation. The wellbore 1300A has a wellbore wall 1305.

A series of components are indicated by brackets in FIG. 13A. First, bracket 1310 is indicative of a first, or upper, sand control segment. The sand control segment 1310 includes a perforated base pipe 1312 and a surrounding filtering medium 1314. The sand control segment 1310 also includes one or more transport conduits 1316 and one or more packing conduits 1318. In the arrangement of FIG. 13A, one transport conduit 1316 and one packing conduit 1318 is shown. However, it is understood that any number of such conduits 1316, 1318 may be employed in order to provide an alternate flow path for a gravel slurry.

In FIG. 13A, a gravel pack has been placed around the first sand control segment 1310. Gravel material is shown at 1315. The gravel material, or "pack," 1315 provides support for the surrounding wellbore wall 1305 and also serves to filter out particles from the surrounding formation.

Brackets 1320 and 1340 are also shown. These are indicative of respective packer assemblies. The packer assemblies 1320, 1340 each include a sealing element 1322, 1342. Further, each of the packer assemblies 1320, 1340 includes alternate flow channels 1326 and 1346, respectively. The packer assemblies 1320, 1340 are preferably mechanically-set packers such as packer 600 shown in FIGS. 6A and 6B. In the view of FIG. 13A, each of packer assemblies 1320, 1340 is set within the wall 1305 of the wellbore 1300A.

Next, bracket 1330 is shown. Bracket 1330 represents an elongated space between packer assemblies 1320 and 1340. The elongated space 1330 includes a section of blank pipe 1332. The blank pipe 1320 may be one, two, or multiple joints of steel tubing. The elongated space 1330 may traverse a non-producing section of subsurface formation. Alternatively, the elongated space 1330 may simply be a short spacing between packers 600.

Bracket 1350 is also provided. Bracket 1350 represents another section of blank pipe 1352. In this instance, only one or two pup joints or other joints make up pipe 1352 may be used. Alternatively, bracket 1350 may represent an extended length of blank pipe 1352.

It is noted that alternate flow channels are also extended along pipes 1332 and 1352. These are shown at 1336 and 1356, respectively. The alternate flow channels 1336, 1356 serve as transport conduits for the delivery of gravel slurry to a next sand control segment.

A final bracket is shown at 1360. Bracket 1360 is indicative of another sand control segment. This is a second, or lower sand control segment. The sand control segment 1360 also includes a slotted base pipe 1362 and a surrounding filtering medium 1364. The sand control segment 1360 further includes one or more transport conduits 1366 and one or more packing conduits 1368. In the arrangement of FIG. 13A, one transport conduit 1366 and one packing conduit 1368 is shown. However, it is again understood that any number of such conduits 1366, 1368 may be employed in order to provide an alternate flow path for a gravel slurry.

In FIG. 13A, a gravel pack has been placed around the second sand control segment 1360. Gravel material is shown at 1365. The gravel material, or "pack," 1365 provides support for the surrounding wellbore wall 1305 and also serves to filter out particles from the surrounding formation. It is observed that the gravel pack 1365 tops out at the upper end of the sand control segment 1360, as is customary in multi-zone completions.

FIG. 13B is another side view of the wellbore 1300A of FIG. 13A. Here, the wellbore is shown at 1300B. Wellbore 1300B is identical to wellbore 1300A; however, in the wellbore 1300B, gravel in the gravel pack 1365 surrounding the lower sand screen 1360 has settled. A settled portion is shown at 1365'. The result is that an upper portion of the sand screen 1364 is immediately and undesirably exposed to the surrounding formation.

FIG. 13C is another side view of the wellbore 1300A of FIG. 13A. Here, the wellbore is shown at 1300C. In this view, a joint assembly 1400 of the present invention has been placed above the lower sand control segment 1360. The joint assembly 1400 includes not only the blank pipe 1352 and the transport conduits 1356, but also one or more packing conduits 1358. The packing conduits 1358 in this zone are novel, and allow a reserve of gravel to be placed above the filtering medium 1364 in the lower sand screen 1360 in anticipation of future settling.

In the view of FIG. 13C, gravel material 1355 is seen extending above the lower sand control segment 1360. This gravel material 1355 serves as a reserve for future settling, thereby preventing the exposed portion 1365' seen in FIG. 13B.

Figure 14:
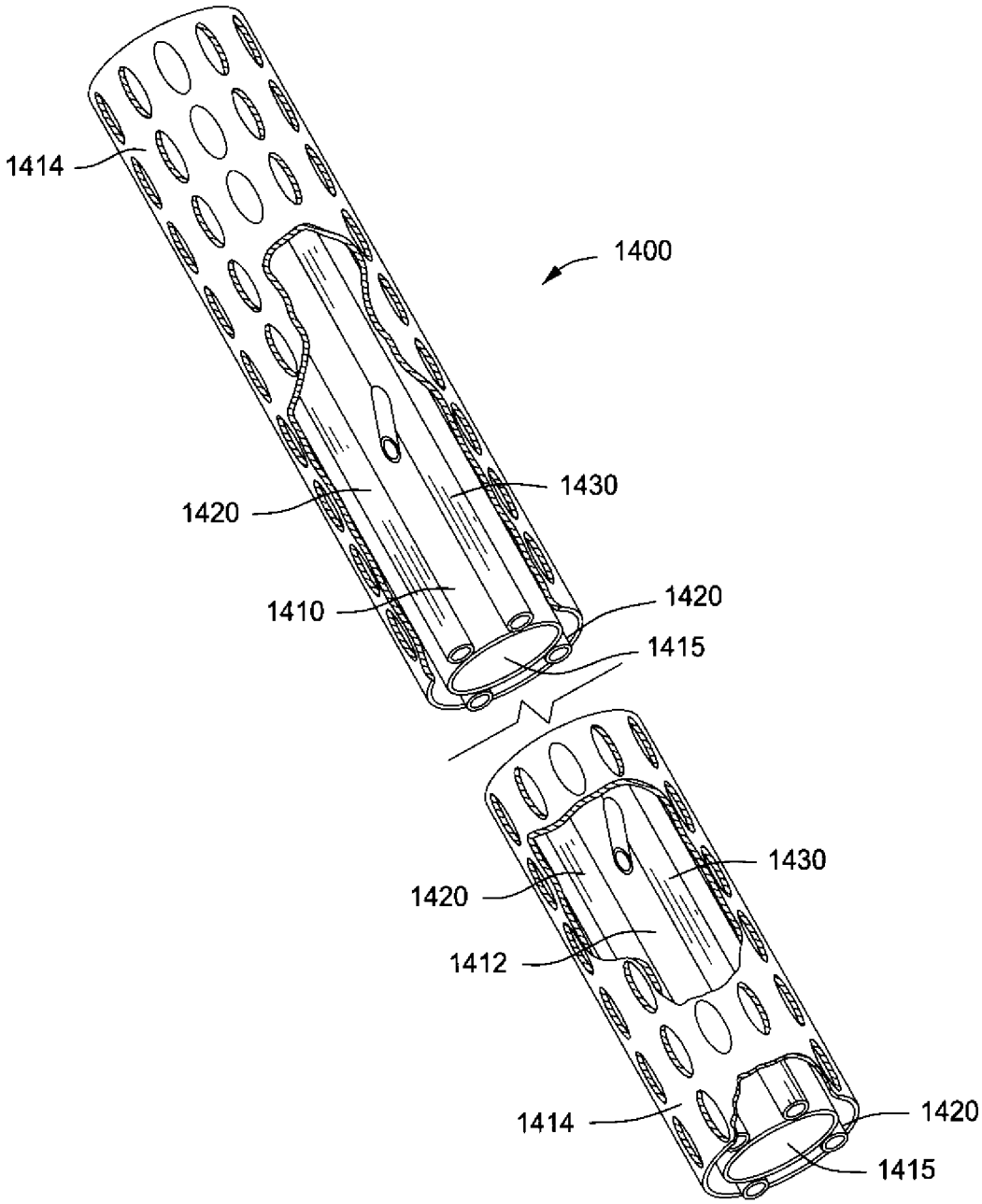
FIG. 14 is a perspective cut-away view of a joint assembly as may be utilized in the wellbore completion apparatus of the present invention, in one embodiment.

FIG. 14 is a perspective cut-away view of a joint assembly 1400 as may be utilized in a wellbore completion apparatus of the present invention, in one embodiment. The wellbore completion apparatus generally includes the packer assembly 1340, the joint assembly 1400 and the lower sand control segment 1360 of FIG. 13C.

In FIG. 14, it can be seen that the joint assembly 1400 first includes a base pipe 1412. The base pipe 1412 defines one or more joints of blank pipe. In one aspect, the base pipe 1412 is between about 8 feet and 40 feet (2.4 meters to 12.2 meters) in length. The base pipe 1412 corresponds to the blank pipe 1352 of FIG. 13C. The base pipe 1412 forms an elongated bore 1415 that extends generally along the length of the joint assembly 1400.

The joint assembly 1400 also includes at least one transport conduit 1420 and at least one packing conduit 1430. In the arrangement of FIG. 14, the conduits 1420, 1430 are disposed along an outer diameter of the base pipe 1412. The transport conduits 1420 and the packing conduits 1430 are designed to carry gravel slurry during a gravel packing operation.

The joint assembly 1400 optionally also includes a shroud 1414. The shroud 1414 defines a generally cylindrical body that circumnavigates the transport conduits 1420 and the packing conduits 1430. The shroud 1414 represents a thin porous medium or a perforated or slotted pipe that allows gravel slurry to freely flow through the shroud 1414 while still providing a modicum of mechanical support or protection for the external conduits 1420, 1430.

It is noted that an upstream end of the joint assembly 1400 may include a load sleeve, such as the load sleeve 1000 of FIGS. 10A and 10B. An opposite downstream end of the joint assembly 1400 would then include a torque sleeve, such as the torque sleeve 1100 of FIG. 11.

Figure 15:
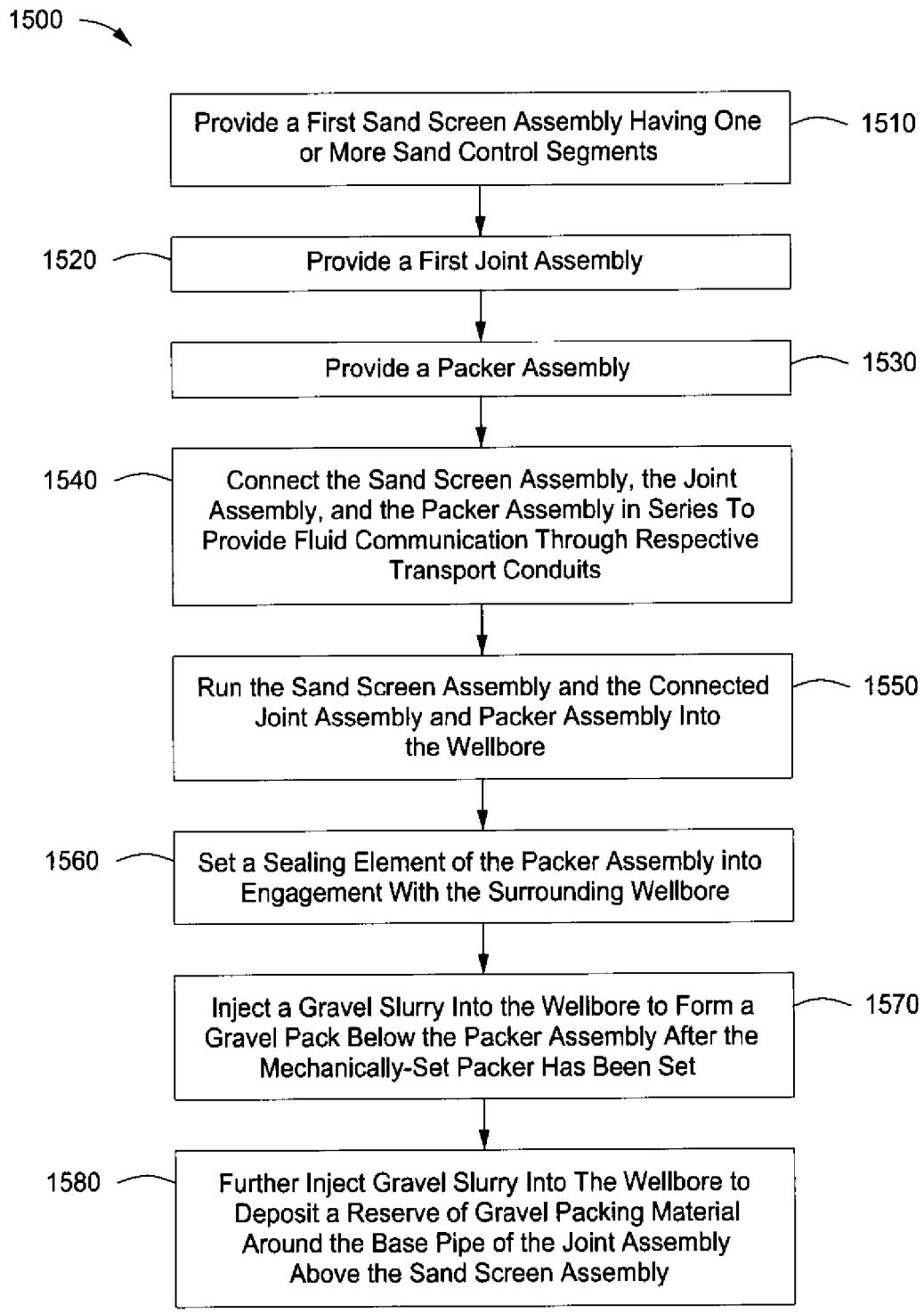
FIG. 15 is a flowchart for a method of completing a wellbore, in one embodiment. The method involves running a sand control device, a joint assembly and a packer assembly into a wellbore, setting a packer, and installing a gravel pack in the wellbore.

Based on the above descriptions, a method for completing an open-hole wellbore is provided herein. The method is presented in FIG. 15. FIG. 15 provides a flow chart presenting steps for a method 1500 of completing a wellbore, in certain embodiments.

The method 1500 first includes providing a first sand screen assembly. This is shown at Box 1510. The sand screen assembly includes one or more sand control segments connected in series. Each of the one or more sand control segments includes a base pipe. The base pipes of the sand control segments define joints of perforated or slotted tubing. Each sand control segment further comprises a filtering medium, which surrounds the base pipe along a substantial portion of the base pipe. The filtering medium may comprise a wire-wrapped screen, a slotted liner, a membrane screen, an expandable screen, a sintered metal screen, a wire-mesh screen, a shape memory polymer, or a pre-packed solid particle bed. Together, the base pipe and the filtering medium form a sand screen.

The sand screens are arranged to have alternate flow path technology. In this respect, each sand screen includes at least one transport conduit configured to bypass the base pipe. The transport conduits extend substantially along the base pipe. Each sand control device further comprises at least one packing conduit. Each packing conduit has a nozzle configured to release gravel packing slurry into an annular region between the filtering medium and a surrounding subsurface formation.

The method 1500 also includes providing a first joint assembly. This is provided at Box 1520. The joint assembly comprises a non-perforated base pipe, at least one transport conduit extending substantially along the non-perforated base pipe, and at least one packing conduit. The transport conduits carry gravel packing slurry along the joint assembly, while the packing conduits each have a nozzle configured to release gravel packing slurry into an annular region between the non-perforated base pipe and a surrounding subsurface formation.

The method 1500 also includes providing a packer assembly. This is provided at Box 1530. The packer assembly comprises at least one sealing element. The sealing elements are configured to be actuated to engage a surrounding wellbore wall. The packer assembly also has an inner mandrel. Further the packer assembly has at least one transport conduit. The transport conduits extend along the inner mandrel and carry gravel packing material through the packer assembly.

In one aspect, the packer assembly represents a mechanically-set packer, such as the packer 600 described above in connection with FIGS. 6A and 6B. In another aspect, the packer assembly represents a pair of spaced-apart mechanically-set packers or annular seals. These represent an upper packer and a lower packer. Each mechanically-set packer has a sealing element that may be, for example, from about 6 inches (15.2 cm) to 24 inches (61.0 cm) in length. Each mechanically-set packer also has an inner mandrel in fluid communication with the base pipes of the sand control segments.

Intermediate the at least two mechanically-set packers may optionally be at least one swellable packer element. The swellable packer element is preferably about 3 feet (0.91 meters) to 40 feet (12.2 meters) in length. In one aspect, the swellable packer element is fabricated from an elastomeric material. The swellable packer element is actuated over time in the presence of a fluid such as water, gas, oil, or a chemical. Swelling may take place, for example, should one of the mechanically-set packer elements fails. Alternatively, swelling may take place over time as fluids in the formation surrounding the swellable packer element contact the swellable packer element.

The method 1500 further includes connecting the sand screen assembly, the first joint assembly and the packer assembly in series. This is indicated at Box 1540. The connection is such that the perforated base pipe of the one or more sand control devices, the non-perforated base pipe of the joint assembly, and the inner mandrel of the packer assembly are in fluid communication. The connection is further such that the at least one transport conduit in the one or more sand control devices, the at least one transport conduit in the joint assembly, and the at least one transport conduit in the packer assembly are in fluid communication. The transport conduits provide alternate flow paths for gravel slurry, and delivery slurry to packing conduits. Thus, gravel packing material may be diverted to different depths and intervals along a subsurface formation.

The method 1500 next includes running the sand screen assembly and connected joint assembly and packer assembly into the wellbore. This is provided at Box 1550. The sand screen assembly and connected packer assembly are placed along the open-hole portion of the wellbore.

The method 1500 also includes setting the at least sealing element of the packer. This is seen in Box 1560. The setting step of Box 1560 is done by actuating the sealing element of the packer into engagement with the surrounding open-hole portion of the wellbore. Thereafter, the method 1500 includes injecting a gravel slurry into an annular region formed between the sand screen and the surrounding open-hole portion of the wellbore. This is shown at Box 1570.

The method 1500 further includes injecting the gravel slurry through the packing conduits of the joint assembly. This is indicated at Box 1580. This additional injection is done in order to deposit a reserve of gravel packing material around the non-perforated base pipe above the sand screen assembly.

It is noted that the transport channels of the packer assembly and the joint assembly allow the gravel slurry to bypass the sealing element and the non-perforated base pipe, respectively. In this way, the open-hole portion of the wellbore is gravel-packed above and below the packer after the packer has been set in the wellbore. It is also noted that the transport conduits of the sand control segments allow the gravel slurry to bypass any premature sand bridges and areas of borehole collapse.

In one aspect, each mechanically-set packer will have an inner mandrel, and alternate flow channels around the inner mandrel. The packers may further have a movable piston housing and an elastomeric sealing element. The sealing element is operatively connected to the piston housing. This means that sliding the movable piston housing along each packer (relative to the inner mandrel) will actuate the respective sealing elements into engagement with the surrounding wellbore.

The method 1500 may further include running a setting tool into the inner mandrel of the packers, and releasing the movable piston housing in each packer from its fixed position. Preferably, the setting tool is part of or is run in with a washpipe used for gravel packing. The step of releasing the movable piston housing from its fixed position then comprises pulling the washpipe with the setting tool along the inner mandrel of each packer. This serves to shear the at least one shear pin and shift the release sleeves in the respective packers. Shearing the shear pin allows the piston housing to slide along the piston mandrel and exert a force that sets the elastomeric packer elements.

The method 1500 may also include providing a second joint assembly. The second joint assembly is generally constructed in accordance with the first joint assembly, but does not include packing conduits. The second joint assembly is placed above the packer assembly, such as intermediate a second sand screen assembly and the packer assembly.

The second sand screen assembly has one or more sand control segments in accordance with the one or more sand control segments of the first sand screen assembly. The second joint assembly is positioned such that (i) the non-perforated base pipe of the second joint assembly, the perforated base pipe of the second sand screen assembly, and the inner mandrel of the packer assembly are in fluid communication; and (ii) the at least one transport conduit in the second joint assembly, the at least one transport conduit in the second sand screen assembly, and the at least one transport conduit in the packer assembly are in fluid communication. The method 1500 then includes operatively connecting the packer assembly, the second joint assembly, and the second sand screen assembly in series, thereby placing the perforated base pipe of the second sand screen assembly in fluid communication with the perforated base pipe of the first sand screen assembly.

In one aspect, a second joint assembly and a third joint assembly are placed in series between the second sand screen assembly and the packer assembly. The third joint assembly is constructed in accordance with the first joint assembly, that is, it includes packing conduits. The first and third joint assemblies may be, for example, 15 foot pup joints. More than one second joint assembly may optionally be provided and more than one third joint assembly may optionally be provided to extend the overall joint assembly length.

In another aspect, the second joint assembly is placed in series with the first joint assembly. This provides additional gravel pack length below the packer assembly, or between the packer assembly and the first sand screen assembly. The first and second joint assemblies may be, for example 5 meter (15') pup joints. More than one second joint assembly may optionally be provided and more than one first joint assembly may optionally be provided in series to extend the overall joint assembly length.

In another aspect, two or more first joint assemblies, that is, joint assemblies having both transport conduits and packing conduits, are placed in series below the packer assembly without a second joint assembly. Alternatively, one or more second joint assemblies are placed in series between the first joint assembly and the first sand screen assembly.

Figure 16:
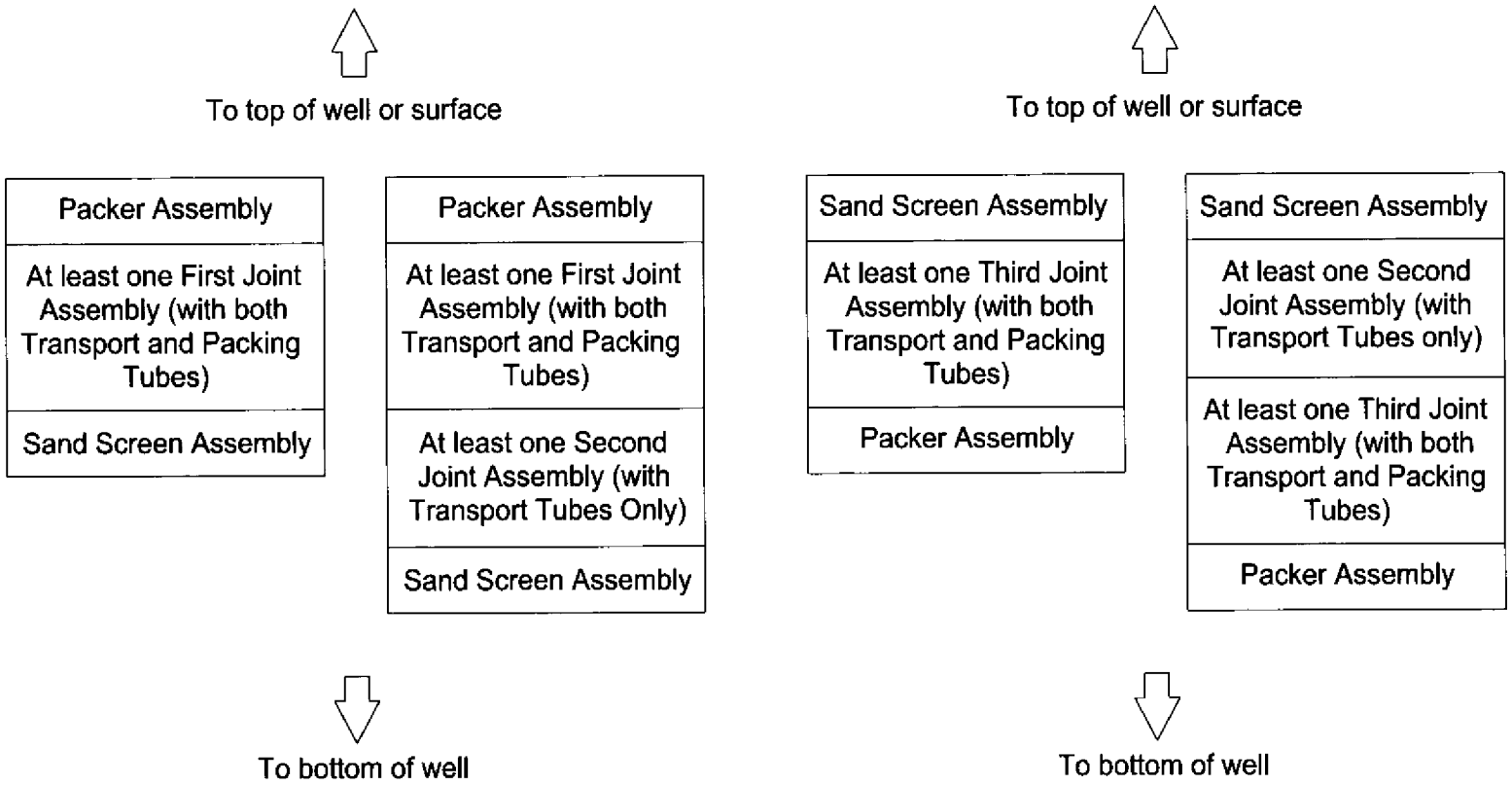
FIG. 16 is a schematic diagram presenting various options for arranging a wellbore completion apparatus of the present invention.

FIG. 16 is a schematic diagram presenting various options for arranging a wellbore completion apparatus of the present invention. This diagram demonstrates some of the aspects described above.

The above method 1500 may be used to selectively produce from or inject into multiple zones. This provides enhanced subsurface production or injection control in a multi-zone completion wellbore.

Figure 17:
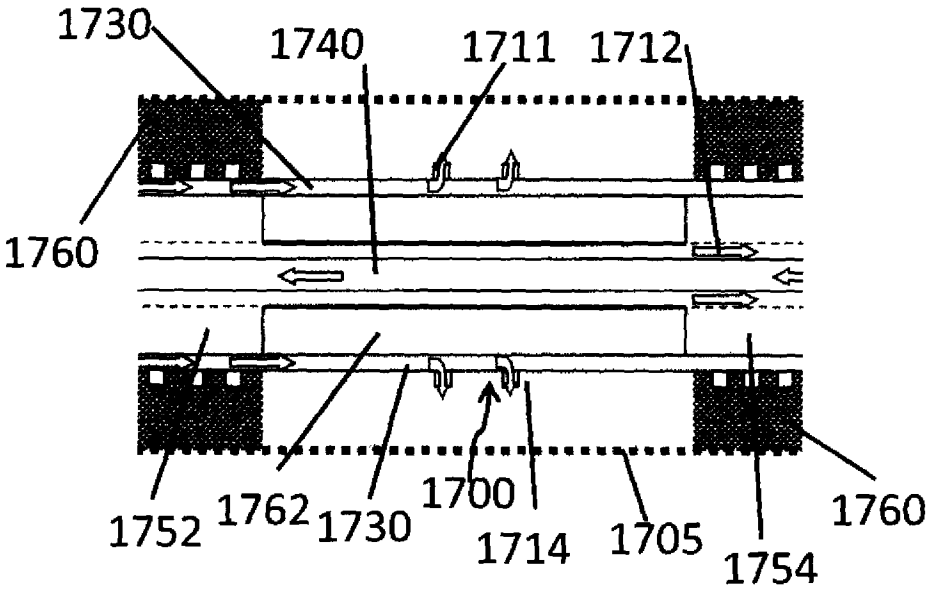
FIG. 17 is a general illustration of an exemplary embodiment that does not include a packer, and instead includes a shunted tubular intermediate two sand screens, the shunted intermediate tubular for transporting and/or placing gravel in an annular area between the sand screens.

In another aspect, the above technology may be employed without using the packer assembly between joints. In such embodiments, the packer assembly may be replaced with a joint assembly connected between a first sand screen assembly and a second sand screen assembly, such as a shunted blank (without including a gravel placement nozzle) and/or a shunted nozzle-containing joint that may both transport gravel through and beyond the joint assembly, while placing a portion of the gravel assembly in the annular region between the joint assembly and the bore hole wall. Such configuration is illustrated generally in FIG. 17. In FIG. 17, the joint assembly 1700 has a non-perforated base pipe 1762 and at least one transport conduit (not illustrated, but similar to packing conduit 1730 except without nozzles 1714) in fluid communication with the alternate paths in the first 1752 and second 1754 sand screens. The joint assembly 1700 also has at least one packing conduit 1730 equipped with at least one nozzle 1714 to deposit gravel pack 1760 in the wellbore annulus for zonal isolation purposes, either a primary zonal isolation or a contingency to a packer. A washpipe 1740 is placed inside the basepipe 1762. FIG. 17*a* illustrates two nozzles 1714 on one packing conduit 1730 in the joint assembly 1700. During gravel packing, gravel slurry 1711 in the wellbore annulus deposits gravel pack 1760 around the first and the optional second sand screens, while the fluid phase 1712 in the gravel slurry leaks off into screens, flows down in the annulus between the base pipe and wash pipe, and flows upward inside the wash pipe to the surface. After the sand screens are packed with gravel, the slurry exiting the nozzles 1714 begin to deposit gravel pack in the annulus region between the joint assembly and the wellbore 1705 from both sand screens. The gravel pack continues to be accumulated while the fluid phase leaks off through screens. The accumulation of gravel pack in the annulus stops when reaching or passing the nozzles 1714 as shown in FIG. 17. In some embodiments, the gravel placed in the annulus behind the intermediate joint assembly 1700 may be of a different gravel size or type than the gravel placed behind the sand screens. Thereby, the sand behind the intermediate joint assembly 1700 may by virtue of reduced permeability, provide some annular region zonal restriction between the first and second screen assemblies. The gravel pack between the joint assembly and the wellbore forms a zonal isolation during well production or injection. The annular zonal isolation may be achieved from the Darcy (flow) resistance of the "intermediate" gravel pack behind the intermediate joint assembly 1700 to the axial flow.

The amount or the length of gravel pack deposited in the annulus depends on the pressure and duration of gravel slurry exiting the nozzles. The prolonged gravel packing or higher gravel packing pressure would generate longer gravel pack or more effective zonal isolation. When a packer is installed further downstream to the joint assembly, gravel slurry must bypass the packer and be diverted via transport conduit to gravel pack the interval below the packer. Such slurry diversion increases the gravel slurry pressure in both the transport and packing conduits in the joint assembly. Before sand-out in a gravel packing operation, high pressure squeezing and cycling would further extend the gravel pack reserve against the joint assembly.

While it will be apparent that the inventions herein described are well calculated to achieve the benefits and advantages set forth above, it will be appreciated that the inventions are susceptible to modification, variation and change without departing from the spirit thereof. Improved methods for completing an open-hole wellbore are provided so as to seal off one or more selected subsurface intervals. An improved zonal isolation apparatus is also provided. The inventions permit an operator to produce fluids from or to inject fluids into a selected subsurface interval.

What is claimed:

1. A method for completing a wellbore in a subsurface formation, the method comprising: providing a first sand screen assembly having one or more sand control segments; providing a second sand screen assembly having one or more sand control segments; providing a first joint assembly comprising: a non-perforated base pipe, at least one transport conduit extending substantially along the non-perforated base pipe, at least one packing conduit having at least one nozzle configured to release gravel packing slurry into an annular region between the non-perforated base pipe and the subsurface formation; a load sleeve including an inner diameter, with the load sleeve being operably attached to the non-perforated base pipe at or near a first end, the load sleeve having at least one transport conduit and at least one packing conduit; a coupling assembly operably attached to at least a portion of the first end of the non-perforated base pipe, the coupling assembly including a coupling and a manifold region, with the manifold region being located in an annulus exterior to the coupling and is at least partially defined by an exterior surface of the coupling and the manifold region is configured to be in fluid flow communication with the at least one transport conduit and at the least one packing conduit of the load sleeve; and a torque sleeve comprising an inner diameter, with the torque sleeve being operably attached to the non-perforated base pipe at or near the second end, the torque sleeve comprising at least one transport conduit; connecting the first joint assembly in series between the first sand screen assembly and the second sand screen assembly; running the first sand screen assembly, the first joint assembly, and the second sand screen assembly into the wellbore; and injecting a gravel slurry into the wellbore to form a gravel pack around the first and the second sand screen assemblies and at least a portion of the injected gravel slurry introduced into the annular region through the at least one nozzle.

2. The method of claim 1, further comprising: at least one or more sand control segments comprises; a perforated base pipe having one or more joints, at least one transport conduit extending substantially along the base pipe for transporting gravel packing slurry, a filtering medium radially around the base pipe along a substantial portion of the base pipe so as to form a sand screen, and at least one packing conduit having a nozzle; and releasing gravel packing slurry through the nozzle and into the annular region between the filtering medium and the surrounding subsurface formation.

3. The method of claim 2, wherein connecting the first sand screen assembly, the first joint assembly, and the second sand screen assembly in series comprises providing that the at least one transport conduit in the first and second sand control segment is in fluid communication with the at least one transport conduit in the first joint assembly, and the first joint assembly is in fluid communication with the second sand screen assembly.

4. The method of claim 2, wherein at least one of providing the first and second sand screen assemblies comprises providing at least one of a wire-wrapped screen, a slotted liner, a ceramic screen, a membrane screen, an expandable screen, a sintered metal screen, a wire-mesh screen, a shape memory polymer, and a pre-packed solid particle bed.

5. The method of claim 3, further comprising:

providing a second joint assembly comprising:

a non-perforated base pipe, and at least one transport conduit extending substantially along the non-perforated base pipe.

6. The method of claim 5, wherein the second joint assembly does not include a nozzle.

7. The method of claim 3, further comprising:

providing the at least one transport conduit of the first joint assembly with at least three transport conduits placed concentrically around the non-perforated base pipe, and providing the at least one packing conduit of the first joint assembly with at least two packing conduits.

8. The method of claim 3, further comprising injecting the gravel slurry through the nozzle and into the wellbore to deposit gravel packing material around at least a portion of the non-perforated base pipe.

9. The method of claim 1, wherein providing the joint assembly further comprises:

providing a protective shroud radially around at least a portion of the at least one transport conduit and the at least one packing conduit.

10. The method of claim 9, wherein the protective shroud is permeable and gravel slurry thereby passes through the protective shroud.

11. A system for completing a wellbore in a subsurface formation, the system comprising:

a first sand screen assembly having one or more sand control segments;

second sand screen assembly having one or more sand control segments;

a first joint assembly comprising;

a non-perforated base pipe, at least one transport conduit extending substantially along the non-perforated base pipe, at least one packing conduit having at least one nozzle configured to release gravel packing slurry into an annular region between the non-perforated base pipe and the subsurface formation, a load sleeve including an inner diameter, with the load sleeve being operably attached to the non-perforated base pipe at or near a first end, the load sleeve having at least one transport conduit and at least one packing conduit;

a coupling assembly operably attached to at least a portion of the first end of the non-perforated base pipe, the coupling assembly including a coupling and a manifold region, with the manifold region being located in an annulus exterior to the coupling and is at least partially defined by an exterior surface of the coupling and the manifold region is configured to be in fluid flow communication with the at least one transport conduit and at the least one packing conduit of the load sleeve; and a torque sleeve comprising an inner diameter, with the torque sleeve being operably attached to the non-perforated base pipe at or near the second end, the torque sleeve comprising at least one transport conduit;

the first joint assembly connected in series between the first sand screen assembly and the second sand screen assembly;

running the first sand screen assembly, the first joint assembly, and the second sand screen assembly into the wellbore; and injecting a gravel slurry into the wellbore to form a gravel pack around the first and the second sand screen assemblies and at least a portion of the injected gravel slurry introduced into the annular region through the at least one nozzle.

12. The method of claim 1, wherein at least one or more sand control segments comprises: a perforated base pipe having one or more joints, at least one transport conduit extending substantially along the base pipe for transporting gravel packing slurry, a filtering medium radially around the base pipe along a substantial portion of the base pipe so as to form a sand screen, and at least one packing conduit having a nozzle configured to release gravel packing slurry into an annular region between the filtering medium and the surrounding subsurface formation.

13. The system of claim 11, wherein connecting the first sand screen assembly, the first joint assembly, and the second sand screen assembly in series comprises providing that the at least one transport conduit in the first and second sand control segment is in fluid communication with the at least one transport conduit in the first joint assembly, and the first joint assembly is in fluid communication with the second sand screen assembly.

14. The system of claim 11, wherein at least one of providing the first and second sand screen assemblies comprises providing at least one of a wire-wrapped screen, a slotted liner, a ceramic screen, a membrane screen, an expandable screen, a sintered metal screen, a wire-mesh screen, a shape memory polymer, and a pre-packed solid particle bed.

15. The system of claim 11, further comprising:

providing a second joint assembly comprising:

a non-perforated base pipe, and at least one transport conduit extending substantially along the non-perforated base pipe.

16. The system of claim 15, wherein the second joint assembly does not include a nozzle.

17. The system of claim 11, further comprising:

providing the at least one transport conduit of the first joint assembly with at least three transport conduits placed concentrically around the non-perforated base pipe, and providing the at least one packing conduit of the first joint assembly with at least two packing conduits.

18. The system of claim 17, further comprising injecting the gravel slurry through the nozzle and into the wellbore to deposit gravel packing material around at least a portion of the non-perforated base pipe.

19. The system of claim 11, wherein providing the joint assembly further comprises:

providing a protective shroud radially around at least a portion of the at least one transport conduit and the at least one packing conduit.

20. The system of claim 19, wherein the protective shroud is permeable and gravel slurry thereby passes through the protective shroud.

* * * * *